US009776820B2

(12) United States Patent
Nireki

(10) Patent No.: US 9,776,820 B2
(45) Date of Patent: Oct. 3, 2017

(54) PAPER STOCK PROCESSING DEVICE

(71) Applicant: Universal Entertainment Corporation, Koto-ku, Tokyo (JP)

(72) Inventor: Takao Nireki, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 20 days.

(21) Appl. No.: 14/785,337

(22) PCT Filed: Mar. 13, 2014

(86) PCT No.: PCT/JP2014/056649

§ 371 (c)(1),
(2) Date: Oct. 17, 2015

(87) PCT Pub. No.: WO2014/171231

PCT Pub. Date: Oct. 23, 2014

(65) Prior Publication Data

US 2016/0075531 A1 Mar. 17, 2016

(30) Foreign Application Priority Data

Apr. 19, 2013 (JP) ..... 2013-088486
Apr. 19, 2013 (JP) ..... 2013-088487
(Continued)

(51) Int. Cl.
*B65H 31/26* (2006.01)
*B65H 29/22* (2006.01)
(Continued)

(52) U.S. Cl.
CPC ..... *B65H 29/22* (2013.01); *B65H 31/02* (2013.01); *B65H 31/26* (2013.01);
(Continued)

(58) Field of Classification Search
CPC .... B65H 31/26; B65H 31/06; G07D 11/0021; G07D 11/0012; G07D 11/0006
See application file for complete search history.

(56) References Cited

U.S. PATENT DOCUMENTS 7,303,117 B2 * 12/2007 Ito ..... G07D 11/0021 235/379
7,708,272 B2 * 5/2010 Van Opstal ..... B65H 31/36 271/220
(Continued)

FOREIGN PATENT DOCUMENTS

JP 2001146351 5/2001
JP 2002331158 11/2002
(Continued)

OTHER PUBLICATIONS

International Search Report issued in connection with underlying PCT application No. PCT/JP2014/056649.

*Primary Examiner* — Luis A Gonzalez
(74) *Attorney, Agent, or Firm* — KMF Patent Services, PLLC; Kenneth M. Fagin; S. Peter Konzel

(57) ABSTRACT

A paper money processing device is provided with: a storage unit for forming a storage space in which paper money is layered and stored; a conveyance mechanism for conveying paper money to the storage unit; and a movable piece capable of emerging and sinking the storage space, the movable piece being provided in a direction orthogonal to the conveyance direction of the paper money conveyed by the conveyance mechanism. Conveyance is stopped in a position where the trailing end part of the paper money to be conveyed to the storage unit by the conveyance mechanism is facing the moveable piece, the trailing end part of the paper money in a position facing the moveable piece is thereafter moved to the storage space side and the paper
(Continued)

money is layered and stored in the storage space by the emerging/sinking operation of the movable piece.

10 Claims, 54 Drawing Sheets

(30) Foreign Application Priority Data

| | | |
|---|---|---|
| Apr. 19, 2013 | (JP) | 2013-088488 |
| Apr. 19, 2013 | (JP) | 2013-088489 |
| Apr. 19, 2013 | (JP) | 2013-088490 |
| Jan. 27, 2014 | (JP) | 2014-012585 |
| Jan. 27, 2014 | (JP) | 2014-012775 |
| Jan. 27, 2014 | (JP) | 2014-012776 |
| Jan. 27, 2014 | (JP) | 2014-012777 |
| Jan. 27, 2014 | (JP) | 2014-012778 |

(51) Int. Cl.

| | |
|---|---|
| ***B65H 31/02*** | (2006.01) |
| ***B65H 31/30*** | (2006.01) |
| ***G07D 11/00*** | (2006.01) |

(52) U.S. Cl.
CPC ..... *B65H 31/3027* (2013.01); *G07D 11/0021* (2013.01); *G07D 11/0084* (2013.01); *B65H 2301/321* (2013.01); *B65H 2301/4213* (2013.01); *B65H 2301/4214* (2013.01); *B65H 2403/512* (2013.01); *B65H 2403/942* (2013.01); *B65H 2404/1442* (2013.01); *B65H 2404/153* (2013.01); *B65H 2405/575* (2013.01); *B65H 2405/581* (2013.01); *B65H 2408/13* (2013.01); *B65H 2701/1313* (2013.01); *B65H 2701/1912* (2013.01)

(56) References Cited

U.S. PATENT DOCUMENTS

| | | | | |
|---|---|---|---|---|
| 7,980,544 | B2 * | 7/2011 | Baba | B65H 31/26 270/58.08 |
| 2006/0180428 | A1 | 8/2006 | Yoshioka | |

FOREIGN PATENT DOCUMENTS

| | | |
|---|---|---|
| JP | 2006227910 | 8/2006 |
| JP | 2006290564 | 10/2006 |
| JP | 2009020546 | 1/2009 |

* cited by examiner

OVERLAP CHECK PROCESS

※WHEN THE TOTAL SUM OF THE VALUES OF THE PIXELS IS NOT SMALLER THAN PREDETERMINED VALUE, IT IS DETERMINED THAT OVERLAP HAS OCCURRED

PIXEL VALUE = 0 (BLACK) TO 255 (WHITE)

PAPER MONEY TYPICALLY HAS MARGIN REGION OUTSIDE PRINTED REGION PIXEL VALUES ARE GREAT IN MARGIN REGION

TRANSMITTED LIGHT
·INFRARED
·RED COLOR

PAPER STOCK PROCESSING DEVICE

CROSS-REFERENCE TO RELATED APPLICATIONS

This application is the U.S. National Phase of PCT application PCT/JP2014/056649 filed Mar. 13, 2014, the contents of which are incorporated herein by reference. That PCT application is based on and claims the priority benefit of the following ten Japanese priority applications, the contents of all of which are incorporated herein by reference: 1) 2013-088486, filed Apr. 19, 2013; 2) 2013-088487, filed Apr. 19, 2013; 3) 2013-088488, filed Apr. 19, 2013; 4) 2013-088489, filed Apr. 19, 2013; 5) 2013-088490, filed Apr. 19, 2013; 6) 2014-012585, filed Jan. 27, 2014; 7) 2014-012776, filed Jan. 27, 2014; 8) 2014-012777, filed Jan. 27, 2014; 9) 2014-012778, filed Jan. 27, 2014; and 10) 2014-012775, filed Jan. 27, 2014.

TECHNICAL FIELD

The present invention relates to a paper stock processing device which is configured to store paper stock such as paper money.

BACKGROUND ART

The paper stock processing device is mounted in service equipment for providing products and services in response to the insertion of paper stock such as paper money and coupons, e.g., gaming machines in amusement centers, or in vending machines and ticket machines in public spaces. The paper stock processing device is configured to identify the validity of inserted paper stock and store the paper stock if it is valid.

The paper money processing device provided in, for example, an amusement center sandwiched machine recited in PTL 1 includes a paper money identifier configured to identify the validity of paper money inserted through a paper money insertion slot and a stacker in which pieces of valid paper money are layered and stored.

The stacker includes a plate-shaped pressurizer, a storage box having a paper money intake port which is made through a surface opposing the pressurizer and through which the pressurizer can be inserted, a drive unit which is configured to cause the pressurizer to approach or move away from the storage box, a holding plate provided in the storage box to oppose the pressurizer, and a spring biasing the holding plate. The paper money inserted into the paper money insertion slot is conveyed on the paper money identifier along the length of the paper money and is sent to the gap between the storage box and the pressurizer. In the width direction of the paper money (orthogonal to the conveyance direction), the width of the pressurizer and the aperture width of the paper money intake port are slightly shorter than the width of the paper money. When the paper money is transported to the gap between the storage box and the pressurizer, the pressurizer is moved to the storage box side by the drive unit, and the paper money is pushed into the storage box. The paper money stored in the storage box is sandwiched between the holding plate biased by the spring and the inner surface of the storage box (to be more specific, a peripheral part of the paper money intake port).

CITATION LIST

Patent Literature

[PTL 1] Japanese Unexamined Patent Publication No. 2002-331158

SUMMARY OF THE INVENTION

Technical Problem

In the paper money processing device of PTL 1, the end portions in the width direction of the paper money sent from the paper money identifier to the gap between the storage box and the pressurizer (i.e., the both end portions in the direction orthogonal to the conveyance direction) jut from the pressing plate. As the pressurizer is moved to the storage box side, the jutting parts of the paper money jutting from the pressurizer are folded by the pressurizer and the paper money intake port and the paper money passes through the paper money intake port, with the result that the paper money is stored in the storage box. On this account, when the position of the paper money sent from the paper money identifier is deviated in the width direction of the paper money (i.e., the direction orthogonal to the conveyance direction), a jutting part of the paper money jutting from the pressurizer is long, and hence the paper money may not be fully pushed into the storage box even if the pressurizer is moved to the storage box side. To put it differently, when a piece of the paper money sent from the paper money identifier is not at a proper position, the piece may not be stacked on the pieces of the paper money which have already been stored in the storage box.

An object of the present invention is to provide a paper stock processing device which is capable of stacking a piece of paper stock on stored pieces of paper stock, even if the piece is conveyed to a position deviated from a correct position.

Technical Solution

A paper stock processing device of a first group has the following structures.

Namely, a paper stock processing device of the first group has a first structure which includes: a storage unit having a storage space in which paper stock is layered and stored; a conveyance mechanism for conveying paper stock to the storage unit; and a movable piece extending in a direction perpendicular to a conveyance direction in which paper stock is conveyed by the conveyance mechanism, the movable piece being configured to emerge and sink with respect to the storage space, wherein, after conveyance of paper stock to the storage unit by the conveyance mechanism stops in a position where a trailing end part of paper stock faces the movable piece, an emerging/sinking operation of the movable piece is executed so as to move the trailing end part of the paper stock, which is in the position to face the movable piece, is moved toward the storage space, thereby layering and storing the paper stock in the storage space.

In the above first structure, the paper stock processing device has a movable piece extending in a direction perpendicular to a conveyance direction in which paper stock is conveyed by the conveyance mechanism, the movable piece being configured to emerge and sink with respect to the storage space. After conveyance of paper stock to the storage unit by the conveyance mechanism stops in a position where a trailing end part of paper stock faces the movable piece, an emerging/sinking operation of the movable piece is executed so as to move the rear end part of the paper stock relative to the conveyance direction, which part is in the position to face the movable piece, is moved toward the paper stock in the storage space, thereby layering and storing the paper stock in the storage space. Therefore, the trailing end parts of pieces of the paper stock are aligned and stacked (layered and stored), without being affected by misalignment of the paper stock relative to the width direction.

The paper stock processing device having the first structure of the first group may have a second structure, in which the movable piece, while being on a side of the storage space of the storage unit, forms an import space through which paper stock conveyed by the conveyance mechanism is carried into the storage space.

In the above second structure, the movable piece is positioned on a side of the storage space to ensure the import space in an occasion of conveying the paper stock by the conveyance mechanism, so that the paper stock is conveyed to and stored in the storage space through the import space. Further, it is possible to prevent pieces of paper stock already layered and stored in the storage space from disturbing movement of another piece of paper stock carried in.

The paper stock processing device having the second structure of the first group may have a third structure which further includes: a hole formed on a wall part of the storage unit, in which hole the movable piece emerges and sinks; a guide piece facing the movable piece, which moves integrally with the movable piece; a drive source for causing emerging and sinking operation of the movable piece; and a control unit configured to control the drive source, wherein the control unit controls the drive source so that the movable piece is moved toward the storage space to close the hole with the guide piece, and after conveyance of paper stock to the storage unit by the conveyance mechanism stops in the position where the trailing end part of the paper stock faces the movable piece, an emerging/sinking operation is executed in which operation the movable piece is moved in a direction from the storage space toward an import space so that the movable piece enters a sunk state with respect to the hole and then the movable piece in the sunk state is moved back toward the storage space.

In the third structure, the control unit controls the drive source so that the movable piece is moved toward the storage space to close the hole with the guide piece, and after the paper stock is conveyed by the conveyance mechanism to the position where the trailing end part of the paper stock faces the movable piece, the emerging/sinking operation is executed in which operation the movable piece is moved in a direction from the storage space toward an import space so that the movable piece enters a sunk state with respect to the hole and then the movable piece in the sunk state is moved back toward the storage space. Therefore, for example, when a piece of paper stock is to be stored in the storage space through the import space, the structure allows that piece of paper stock to be layered and stored and further stacks its trailing end part, while preventing a problem such as paper jam which takes place when an end portion of the piece of paper stock is caught on the hole and the like.

The paper stock processing device of the first group having any of the above first to third structures may have a fourth structure further including a pair of contact members configured to pinch paper stock layered and stored in the storage space.

In the above fourth structure, the pair of contact members pinches the paper stock layered and stored in the storage space. This facilitates holding pieces of paper stock with their trailing end parts aligned, when the movable piece is emerged or sunk.

The paper stock processing device having the first structure of the first group may have a fifth structure further including an insertion slot to which the paper stock is inserted, wherein the storage unit is disposed in a position to face the movable piece, and includes a pressing plate configured to pinch the layered and stored paper stock between the movable piece and the pressing plate, and the pressing plate has, at a surface in contact with the layered and stored paper stock, a first regulating member whose friction force is larger when the paper stock moves toward the storage unit than when the paper stock moves toward the insertion slot.

The fifth structure above prevents the layered state of the paper stock layered and stored in the storage unit from being disturbed when the paper stock inserted into the insertion slot is conveyed to the storage unit.

The paper stock processing device having the first structure of the first group may have a sixth structure, in which the movable piece has a second regulating member with which the friction force between a surface of the movable piece in contact with the layered and stored paper stock and the layered and stored paper stock is larger than the friction force between pieces of the layered and stored paper stock.

The sixth structure prevents the stored paper stock from becoming unstable as pieces of the paper stock layered and stored in the storage unit are deviated from one another on account of a shock at the emergence of the movable piece in the import space.

A paper stock processing device of a second group has the following structures.

Namely, a paper stock processing device of the second group has a first structure which includes: an insertion slot in which paper stock is inserted, a storage unit configured to store paper stock inserted into the insertion slot, and a conveyance mechanism which is able to convey the paper stock inserted into the insertion slot to the storage unit, wherein the conveyance mechanism is able to convey the paper stock stored in the storage unit toward the insertion slot until the paper money is ejected from the insertion slot.

In the first structure, the paper stock inserted into the insertion slot is conveyed by the conveyance mechanism and stored in the storage unit. Further, when collecting the paper stock stored in the storage unit, the paper stock in the storage unit is conveyed to the insertion slot by the conveyance mechanism, and is ejected from the insertion slot. That is to say, the insertion slot to which the paper stock is inserted also serves as an ejection slot for ejecting the paper stock stored in the storage unit. This is advantageous in terms of downsizing of the device, as compared with cases of separately providing the insertion slot and the ejection slot. In the paper money processing device of Tokukai 2002-331158 on the other hand, a paper money collection port is rotatably provided on a side surface of the stacker. Therefore, the width of the stacker (the width of the paper money processing device) is inevitably large. However, the first structure in which the insertion slot to which the paper stock is inserted also serve as an ejection slot for ejecting the paper stock contributes to downsizing of the device as compared with cases of separately providing the insertion slot and the ejection slot.

The paper stock processing device having the first structure of the second group may have a second structure such that the conveyance mechanism is able to convey pieces of paper stock inserted into the insertion slot one by one to the storage unit, and is able to convey plural pieces of the paper stock layered and stored in the storage unit toward the insertion slot.

With the second structure, a plurality of pieces of paper stock stored in the storage unit are conveyed and ejected from the insertion slot in bundle.

The paper stock processing device having the first structure of the second group may have a third structure such that the insertion slot is able to change the aperture width in the thickness direction of the paper stock, and when the paper stock stored in the storage unit is conveyed toward the insertion slot by the conveyance mechanism, the aperture width is widened.

In the third structure, the aperture width of the insertion slot is narrowed to an extend that allows insertion of a piece of paper stock in normal occasions. However, since the aperture width of the insertion slot is expanded at the time of collecting the paper stock, it is possible to eject a plurality of pieces of paper stock from the insertion slot. Further, a narrow aperture width of the insertion slot in normal occasions prevents paper stock from being illegally pulled out through the insertion slot.

The paper stock processing device having the second or the third structure of the second group may have a fourth structure which further includes: a conveyance path where the paper stock passes is provided between the insertion slot and the storage unit, the conveyance path is able to change the aperture width in the thickness direction of the paper stock, and when the paper stock stored in the storage unit is conveyed toward the insertion slot by the conveyance mechanism, the aperture width is widened.

In the fourth structure, the aperture width of the conveyance path is narrow in normal occasions. Therefore, a piece of paper stock is conveyed by the conveyance mechanism provided in the conveyance path. Further, since the aperture width of the conveyance path is expanded when the paper stock stored is collected, the conveyance path will not cause a difficulty in conveyance of the paper stock even if the storage unit stores a large number of pieces of paper stock.

The paper stock processing device having the first or second structure of the second group may have a fifth structure further including a pair of conveyance members which are able to pinch the paper stock stored in the storage unit in the thickness direction, the conveyance member on one side is provided with a first contact member which is deformed when making contact with the paper stock and presses the paper stock by utilizing the elastic force which is power of returning to the original stage from the deformed stage, the conveyance mechanism is arranged to be able to convey the paper stock sandwiched by the conveyance member, and when the paper stock inserted into the insertion slot is conveyed toward the storage unit by the conveyance mechanism, the relative distance between the pair of conveyance members is changed so that the first contact member is in contact with the paper stock.

In the fifth structure above, in the storing of the paper stock in which the paper stock is conveyed toward the storage unit, the first contact member is in contact with the layered paper stock on account of the force generated by elastic deformation of the first contact member. With this, it is possible to apply a constant friction force to the conveyed paper stock and the conveyance member irrespective of the state of the layered paper stock. This makes it possible to more stably perform the operations in the storing of the paper stock, than traditional structures.

The paper stock processing device having the fifth structure of the second group may have a sixth structure such that a conveyance member on one side includes a second contact member which is smaller in diameter than the first contact member and harder than the first contact member and wherein, when the paper stock stored in the storage unit is conveyed toward the insertion slot, the relative distance between the conveyance member pair so that the second contact member is in contact with the paper stock.

In the sixth structure above, in the paper stock collection in which the paper stock is conveyed toward the insertion slot, the paper stock is arranged to be in contact with the second contact member. Because the second contact member is harder than the first contact member, the first contact member is crushed and hence the second contact member is in contact with the paper stock. With this, two types of rollers are switched only by changing the movement amount of the conveyance member, and hence unnecessary arrangements and controls are omitted and cost reduction is achieved.

The paper money processing device having the first structure of the second group may have a seventh structure such that the conveyance mechanism includes a contact member which is in contact with the surface of the paper stock stored in the storage unit in the thickness direction of the paper stock, wherein, the surface of a contact part of this contact member is convex and concave as two types of elastic members which are different in hardness are alternately provided, when the paper stock inserted into the insertion slot one by one is conveyed to the storage unit, the convex parts of the surfaces of the elastic members are in contact with the surface of the paper stock, whereas, when plural pieces of the paper stock layered and stored in the storage unit are conveyed toward the insertion slot, the contact force when in contact with the surface of the paper stock is changed so that the convex parts are elastically deformed and the concave parts of the surfaces of the elastic members are in contact with the surface of the paper stock.

In the seventh structure above, the conveyance mechanism is able to easily change the contact force when in contact with the paper stock between a case where pieces of the paper stock are conveyed one by one from the insertion slot and a case where pieces of the paper stock stored in the storage unit are conveyed toward the insertion slot, by utilizing the difference in the hardness between the contact members. As a result, the contact force is lowered to prevent the occurrence of jamming or the like when the paper stock is inserted through the insertion slot, whereas the contact force is increased when the paper stock layered in the storage unit is conveyed toward the insertion slot, with the result that layered pieces of the paper stock is stably conveyed to the insertion slot.

A paper stock processing device of a third group has the following structures.

Namely, the paper stock processing device of the third group has a first structure including: an insertion slot in which paper stock is inserted, a storage unit in which plural pieces of the paper stock inserted into the insertion slot are layered in the thickness direction and stored, a conveyance member which is able to pinch, in the thickness direction, the paper stock stored in the storage unit, and a conveyance mechanism which is able to convey the paper stock pinched by the conveyance member toward the insertion slot until the paper stock is ejected from the insertion slot.

In the first structure, the paper stock stored in the storage unit is pinched by the conveyance member and conveyed to the insertion slot so that the paper stock is ejected from the insertion slot. This way, the paper stock stored in the storage unit is collected. The structure therefore improves the efficiency of work for collecting the paper stock, as compared with cases of collecting paper stock from a part other than the insertion slot. In the paper money processing device described in the publication of Tokukai 2002-331158, a lock device is unlocked when collecting the paper stock stored in a stacker, and then a paper stock verifier and the stacker are drawn forward relative to the sandwiched machine, and the paper money collection port is rotated to a side to take out the bundle of paper stock in the stacker from the paper money collection port. After the collection, a work for putting everything back to the original state is necessary. Therefore, the work efficiency of collecting the paper money is not good. Unlike this structure, the first structure allows improvement of work efficiency of collecting paper stock stored in the storage unit, as it enables ejection of paper stock stored in the storage unit from the insertion slot.

The paper stock processing device having the first structure of the third group may have a second structure such that the conveyance member includes: a drive source which is formed of paired members provided on the respective sides in the thickness direction of the paper stock stored in the storage unit, is connected with the conveyance member, and is movable between the paired members in the direction of pinching the paper stock; and a control unit configured to control the drive source, wherein the control unit controls the drive source so that the friction force between the conveyance member and the paper stock is smaller than the friction force between the pieces of the paper stock.

In the second structure, the control unit moves the paired members in directions to pinch the paper stock and adjust the distance between the paired members so that the friction force between the conveyance member and the paper stock is smaller than the friction force between the pieces of the paper stock. This allows pinching and conveying of a plurality of pieces of paper stock while restraining any piece of paper stock from slipping off from the rest.

The paper stock processing device having the first or second structure of the third group may have a third structure such that a conveyance path where the paper stock passes is provided between the insertion slot and the storage unit, the conveyance path is able to change the aperture width in the thickness direction of the paper stock, and the aperture width is widened when the paper stock stored in the storage unit is conveyed toward the insertion slot.

In the third structure, the aperture width of the conveyance path is expanded when the paper stock stored in the storage unit is collected from the insertion slot. Therefore, the conveyance path will not cause a difficulty in conveyance of the paper stock even if the storage unit stores a large number of pieces of paper stock.

The paper stock processing device having any one of the first to third structure of the third group may have a fourth structure such that the distance between the insertion slot and the conveyance member is shorter than the length in the conveyance direction of the paper stock.

In the fourth structure, the space between the insertion slot and the conveyance member is shorter than the length of the paper stock relative to the conveyance direction. Therefore, the conveyance member is able to convey the paper stock stored in the storage unit to a position where the paper stock sticks out from the insertion slot.

The paper stock processing device having second structure of the third group may have a fifth structure such that a member on one side includes a first contact member which deforms when being in contact with the paper stock and presses the paper stock by utilizing an elastic force generated when the deformed first contact member returns to the original shape, a conveyance mechanism is able to convey the paper stock inserted into the insertion slot toward the storage unit, and a control unit changes the relative distance between paired members to cause the first contact member to be in contact with the paper stock, when the paper stock inserted into the insertion slot is conveyed toward the storage unit by the conveyance mechanism.

In the fifth structure above, in the storing of the paper stock in which the paper stock is conveyed toward the storage unit, the first contact member is in contact with the layered paper stock on account of the force generated by elastic deformation of the first contact member. With this, it is possible to apply a constant friction force to the conveyed paper stock and the conveyance member irrespective of the state of the layered paper stock. This makes it possible to stably perform the operations in the storing of the paper stock.

The paper stock processing device having the fifth structure of the third group may have a sixth structure such that a conveyance member on one side includes a second contact member which is smaller in diameter than the first contact member and harder than the first contact member and an axis in which the first contact member and the second contact member are provided, wherein, when the paper stock stored in the storage unit is conveyed toward the insertion slot, the relative distance between the conveyance member pair so that the second contact member is in contact with the paper stock.

In the sixth structure above, in the paper stock collection in which the paper stock is conveyed toward the insertion slot, the paper stock is arranged to be in contact with the second contact member. Because the second contact member is harder than the first contact member, the first contact member is crushed and hence the second contact member is in contact with the paper stock. With this, two types of the contact members are switched only by changing the movement amount of the conveyance member, and hence unnecessary arrangements and controls are omitted and cost reduction is achieved.

The paper stock processing device having the first structure of the third group may have a seventh structure such that the conveyance mechanism includes a contact member which is in contact with the surface of the paper stock stored in the storage unit in the thickness direction of the paper stock, wherein, the surface of a contact part of this contact member is convex and concave as two types of elastic members which are different in hardness are alternately provided, when the paper stock inserted into the insertion slot one by one is conveyed to the storage unit, the convex parts of the surfaces of the elastic members are in contact with the surface of the paper stock, whereas, when plural pieces of the paper stock layered and stored in the storage unit are conveyed toward the insertion slot, the contact force when in contact with the surface of the paper stock is changed so that the convex parts are elastically deformed and the concave parts of the surfaces of the elastic members are in contact with the surface of the paper stock.

In the seventh structure above, the conveyance mechanism is able to easily change the contact force when in contact with the paper stock between a case where pieces of the paper stock are conveyed one by one from the insertion slot and a case where pieces of the paper stock stored in the storage unit are conveyed toward the insertion slot, by utilizing the difference in the hardness between the contact members. As a result, the contact force is lowered to prevent the occurrence of jamming or the like when the paper stock is inserted through the insertion slot, whereas the contact force is increased when the paper stock layered in the storage unit is conveyed toward the insertion slot, with the result that layered pieces of the paper stock is stably conveyed to the insertion slot.

A paper stock processing device of a fourth group has the following structures.

The paper stock processing device of the fourth group has a first structure comprising: an insertion slot in which paper stock is inserted, a storage unit capable of storing plural pieces of paper stock inserted in the insertion slot to be layered in the thickness direction, conveyance members capable of pinching the paper stock stored in the storage unit from one and the other sides in the thickness direction, a conveyance mechanism capable of conveying the paper stock pinched by the conveyance member from the storage unit to the insertion slot, and a change unit which is configured to change the relative distance between the conveyance members on the one side and the other side so as to change the friction force between the conveyance members and the paper stock and the friction force between pieces of the paper stock.

In the first structure, the paper stock stored in the storage unit is pinched by the conveyance member and conveyed to the insertion slot so that the paper stock is ejected from the insertion slot. At this time, for example, the relative distance between the conveyance members on the one side and the other side is varied by the change unit to set the pinching force such that the friction force between the conveyance members and the paper stock is smaller than the friction force between pieces of the paper stock. This way, a plurality of pieces of paper stock is pinched and conveyed by the conveyance members without any piece of paper stock slipping off from the rest. Thus, the work efficiency for collecting the paper stock is improved. In the paper money processing device described in the publication of Tokukai 2002-331158, a lock device is unlocked when collecting the paper stock stored in a stacker, and then a paper stock verifier and the stacker are drawn forward relative to the sandwiched machine, and the paper money collection port is rotated to a side to take out the bundle of paper stock in the stacker from the paper money collection port. After the collection, a work for putting everything back to the original state is necessary. Therefore, the work efficiency of collecting the paper money is not good. Unlike this structure, the first structure allows improvement of work efficiency of collecting paper stock stored in the storage unit, as it enables ejection of paper stock stored in the storage unit from the insertion slot.

The paper stock processing device having the first structure of the fourth group may have a second structure such that a drive source which is connected with the change unit and moves in the direction of pinching the paper stock between the conveyance members on the one side and the other side, a control unit configured to control the drive source, and a memory unit configured to store the number of pieces of the paper stock stored in the storage unit are provided, the conveyance mechanism is able to convey the paper stock inserted in the insertion slot toward the storage unit, and the control unit changes the relative distance in accordance with the number of pieces of the paper stock stored in the memory unit.

For example, by changing the relative distance between the conveyance members by the change unit to set a pinching force such that the friction force between the conveyance members and the paper stock is greater than the friction force between pieces of paper stock in an occasion of conveying a piece of paper stock inserted into the insertion slot to the storage unit by the conveyance mechanism, the piece of paper stock inserted into the insertion slot is layered and stored on a plurality of pieces of paper stock already stored in the storage unit while maintaining the layered state of the already stored pieces of paper stock.

In the second structure, the control unit controls the drive source to change the relative distance between the conveyance members by the change unit, according to the number of pieces of the paper stock stored in the memory unit. Therefore, the friction force between the paper stock and the conveyance members and the friction force between pieces of the paper stock are suitably adjustable, irrespective of variation in the thickness of the paper stock due to a change in the number of pieces of the paper stock.

The paper stock processing device having the first or second structure of the fourth group may have a third structure such that a conveyance path where the paper stock passes is provided between the insertion slot and the storage unit, the conveyance path is able to change the aperture width in the thickness direction of the paper stock, and the aperture width is widened when the paper stock stored in the storage unit is conveyed toward the insertion slot.

In the third structure, the aperture width of the conveyance path is expanded when the paper stock stored in the storage unit is collected from the insertion slot. Therefore, the conveyance path will not cause a difficulty in conveyance of the paper stock even if the storage unit stores a large number of pieces of paper stock.

The paper stock processing device having the second structure of the fourth group may have a fourth structure such that a member on one side includes a first contact member which deforms when being in contact with the paper stock and presses the paper stock by utilizing an elastic force generated when the deformed first contact member returns to the original shape, a conveyance mechanism is able to convey the paper stock inserted into the insertion slot toward the storage unit, and a control unit changes the relative distance between paired members to cause the first contact member to be in contact with the paper stock, when the paper stock inserted into the insertion slot is conveyed toward the storage unit by the conveyance mechanism.

In the fourth structure above, in the storing of the paper stock in which the paper stock is conveyed toward the storage unit, the first contact member is in contact with the layered paper stock on account of the force generated by elastic deformation of the first contact member. With this, it is possible to apply a constant friction force to the conveyed paper stock and the conveyance member irrespective of the state of the layered paper stock. This makes it possible to stably perform the operations in the storing of the paper stock.

The paper stock processing device having the fourth structure of the fourth group may have a fifth structure such that a conveyance member on one side includes a second contact member which is smaller in diameter than the first contact member and harder than the first contact member and an axis in which the first contact member and the second contact member are provided, wherein, when the paper stock stored in the storage unit is conveyed toward the insertion slot, the relative distance between the conveyance member pair so that the second contact member is in contact with the paper stock.

In the fifth structure above, in the paper stock collection in which the paper stock is conveyed toward the insertion slot, the paper stock is arranged to be in contact with the second contact member. Because the second contact member is harder than the first contact member, the first contact member is crushed and hence the second contact member is in contact with the paper stock. With this, two types of the contact members are switched only by changing the movement amount of the conveyance member, and hence unnecessary arrangements and controls are omitted and cost reduction is achieved.

The paper stock processing device having the first structure of the fourth group may have a sixth structure such that the conveyance mechanism includes a contact member which is in contact with the surface of the paper stock stored in the storage unit in the thickness direction of the paper stock, wherein, the surface of a contact part of this contact member is convex and concave as two types of elastic members which are different in hardness are alternately provided, when the paper stock inserted into the insertion slot one by one is conveyed to the storage unit, the convex parts of the surfaces of the elastic members are in contact with the surface of the paper stock, whereas, when plural pieces of the paper stock layered and stored in the storage unit are conveyed toward the insertion slot, the contact force when in contact with the surface of the paper stock is changed so that the convex parts are elastically deformed and the concave parts of the surfaces of the elastic members are in contact with the surface of the paper stock.

In the sixth structure above, the conveyance mechanism is able to easily change the contact force when in contact with the paper stock between a case where pieces of the paper stock are conveyed one by one from the insertion slot and a case where pieces of the paper stock stored in the storage unit are conveyed toward the insertion slot, by utilizing the difference in the hardness between the contact members. As a result, the contact force is lowered to prevent the occurrence of jamming or the like when the paper stock is inserted through the insertion slot, whereas the contact force is increased when the paper stock layered in the storage unit is conveyed toward the insertion slot, with the result that layered pieces of the paper stock is stably conveyed to the insertion slot.

A paper stock processing device of a fifth group has the following structures.

Namely, the paper stock processing device of the fifth group has a first structure including an insertion slot in which paper stock is inserted, a storage unit in which plural pieces of the paper stock inserted into the insertion slot are layered in the thickness direction and stored, a conveyance mechanism capable of conveying the paper stock stored in the storage unit toward the insertion slot, and an expansion mechanism which changes the aperture width of the insertion slot in a direction in which the hole is widened in the thickness direction, when the paper stock stored in the storage unit is conveyed toward the insertion slot by the conveyance mechanism.

With the first structure, the expansion mechanism allows conveyance and ejection of paper stock stored in the storage unit from the insertion slot, and the insertion slot also serves as an ejection slot. Therefore, unlike traditional structures, there is no need of separately providing an ejection slot. This facilitates reduction of the thickness of the paper stock processing device and enables downsizing. In the paper stock processing device described in the publication of Tokukai 2005-208734, an opening is provided on the front surface of the paper stock processing device separately from the insertion slot. To collect the paper stock stored in the stacker, the storage unit in the paper stock processing device is taken out from this separate opening. As such, the reduction of the thickness of the paper stock processing device has been difficult. In cases of adopting a paper stock processing device generally known as "Sando" such as the paper stock processing device suggested in the publication of Tokukai 2005-208734, which is to be provided between gaming machines, the paper stock processing device will be provided in every space between adjacent gaming machines. Therefore, reduction of the thickness of the paper stock processing device is crucial to set up as many gaming machines as possible in a given space for setting up the gaming machines. In this regard, the first structure above is advantageous in that it enables reduction of the thickness and downsizing of the paper stock processing device.

The paper stock processing device having the first structure of the fifth group may have a second structure such that conveyance member pair capable of pinching the paper stock stored in the storage unit in the thickness direction, a change unit which moves one of the conveyance member pair toward the other conveyance member, a cam configured to operate the expansion mechanism and the change unit, a drive source configured to drive the cam, and a control unit configured to control the drive source are provided, the conveyance member pair is driven to convey the paper stock by the conveyance mechanism, the control unit controls the drive source so as to control the change unit to pinch the paper stock stored in the storage unit when the paper stock stored in the storage unit is conveyed toward the insertion slot by the conveyance member pair, and controls the expansion mechanism so that the aperture width of the insertion slot is changed in a direction in which the insertion slot is widened in the thickness direction.

In the second structure above, the change unit and the expansion mechanism are jointed to the cam which is operated by a single drive source, and are driven by the single drive source. This is advantageous in terms of costs, as compared with cases of driving the change unit and the expansion mechanism by separate drive sources, respectively.

The paper stock processing device having the second structure of the fifth group may have a third structure such that the cam is shaped to stop the operation of one of the expansion mechanism and the change unit when the other one of them is in operation.

In the third structure, the cam is structured so that an operation to change the aperture width of the insertion slot by the expansion mechanism and an operation of changing the relative distance between the pair of conveyance members by the change unit are not carried out at the same time. Therefore, the load of the drive source to drive the cam is reduced, and the chances of breakdown are reduced.

The paper stock processing device having any one of the first to third structures of the fifth group may have a fourth structure such that insertion conveyance member pair which are provided between the insertion slot and the storage unit, pinches the paper stock inserted in the insertion slot in the thickness direction, and are capable of driving the conveyance mechanism to convey the paper stock toward the storage unit, wherein, the expansion mechanism widens the aperture width of the insertion slot so as to change the relative distance between the insertion conveyance member pair.

In the fourth structure above, the paper stock processing device has the insertion conveyance member pair configured to pinch and convey the paper stock inserted into the insertion slot to the storage unit. When the paper stock stored in the storage unit is to be conveyed to the insertion slot, the expansion mechanism expands the aperture width of the insertion slot and expands the relative distance between the insertion conveyance member pair. Therefore, even if the storage unit stores a large number of pieces of the paper stock, the pieces of paper stock are conveyed to the insertion slot without the insertion conveyance member pair disturbing the conveyance.

The paper stock processing device having any one of the first to fourth structures of the fifth group may have a fifth structure including a reader unit including a light emitter which is provided on one side in the thickness direction of the paper stock passing the space between the insertion slot and the storage unit and configured to apply light to the paper stock and a light receiver which is provided on the other side in the thickness direction of the paper stock passing the space between the insertion slot and the storage unit and is configured to receive the light from the light emitter, wherein, the expansion mechanism is capable of widening the relative distance between the light emitter and the light receiver by widening the aperture width of the insertion slot.

In the fifth structure, the paper stock processing device has the reader unit including the light emitter and light receiver configured to read information of the paper stock passing between the insertion slot and the storage unit. When the paper stock stored in the storage unit is to be conveyed to the insertion slot, the expansion mechanism expands the aperture width of the insertion slot and expands the relative distance between the light emitter and the light receiver. Therefore, even if the storage unit stores a large number of pieces of the paper stock, the pieces of paper stock are conveyed to the insertion slot without the light emitter and the light receiver disturbing the conveyance.

The paper stock processing device having the fifth structure of the fifth group may have a sixth structure such that the reader unit is an image sensor.

In regard to the sixth structure, when the light emitter and the light receiver are brought back to their original positions after the relative distance therebetween is expanded by the expansion mechanism, the relative distance between the light emitter and the light receiver may be slightly different from that before the expansion of the relative distance. While a slightest change in the relative distance between a light receiver and a light emitter of a traditional optical sensor easily leads to an error in the read data, a change of a certain extent in the relative distance between the light emitter and the light receiver of the image sensor hardly causes an error in the read data, because the depth of field of the lens of the light receiver is set deep. Therefore, the accuracy of reading the paper stock is improved.

The paper stock processing device having any one of the second to sixth structure of the fifth group may have a seventh structure such that, when plural pieces of the paper stock layered and stored in the storage unit are conveyed toward the insertion slot by the conveyance member pair, the control unit drives the drive source and controls the change unit so as to set the relative distance between the conveyance member pair so that the friction force between the conveyance members and the paper stock is smaller than the friction force between the pieces of the paper stock.

In the seventh structure, the friction force between the conveyance members and the paper stock is smaller than the friction force between pieces of the paper stock when the pieces of the paper stock stored in the storage unit are conveyed to the insertion slot. Therefore, the pieces of the paper stock are pinched between the pair of conveyance members and conveyed, without any of the pieces slipping off from the rest.

The paper stock processing device having any one of the second to seventh structures of the fifth group may have an eighth structure such that the control unit is connected with a memory unit configured to store the number of pieces of the paper stock stored in the storage unit, and in accordance with the number of pieces of the paper stock stored in the memory unit, the control unit controls the change unit so as to set the relative distance between the conveyance member pair.

For example, by changing the relative distance between the conveyance member pair by the change unit to set a pinching force such that the friction force between the conveyance members and the paper stock is greater than the friction force between pieces of paper stock in an occasion of conveying a piece of paper stock inserted into the insertion slot to the storage unit by the conveyance mechanism, the piece of paper stock inserted into the insertion slot is layered and stored on a plurality of pieces of paper stock already stored in the storage unit while maintaining the layered state of the already stored pieces of paper stock.

The paper stock processing device having the second structure of the fifth group may have a ninth structure including a conveyance path which is provided between the insertion slot and the storage unit and where the paper stock passes and a shutter part which is able to emerge in and to be sunk from the conveyance path and prevents the conveyance of the paper stock toward the insertion slot by protruding into the conveyance path, wherein, the shutter part is arranged to be movable by a cam.

According to the ninth structure above, it is unnecessary to additionally provide a drive source for driving the shutter part, and hence cost reduction is achieved.

The paper stock processing device having the ninth structure of the fifth group may have a tenth structure such that, after the paper stock inserted in the insertion slot is stored in the storage unit and before the next paper stock is inserted in the insertion slot, the control unit controls the change unit to cause the paper stock stored in the storage unit to be pinched and causes the shutter part to protrude in the conveyance path.

The tenth structure above makes it difficult to take off the paper stock as the paper stock in the storage unit is pinched by the conveyance member pair, in addition to the take-off prevention by the shutter part.

The paper stock processing device having the second structure of the fifth group may have an eleventh structure such that a pressing plate opposing the paper stock stored in the storage unit, a biasing unit which biases the pressing plate in the thickness direction toward the paper stock stored in the storage unit to maintain the state of the layered pieces of the paper stock stored in the storage unit, and a second change unit configured to widen the relative distance from the paper stock stored in the pressing plate in the thickness direction, wherein, the second change unit is arranged to be operated by a cam, and the control unit widens the aperture width of the insertion slot by the expansion mechanism and controls the second change unit so as to widen the relative distance between the pressing plate and the paper stock stored in the storage unit.

According to the eleventh structure above, while the pressing plate is arranged to press the paper stock on account of the biasing force of the biasing unit, the second change unit configured to widen the aperture width of the insertion slot is arranged to be operated by the cam. As such, because the pressing plate and the second change unit independent operate, a malfunction at the time of expanding the conveyance space is prevented.

Advantageous Effects

With a paper stock processing device of the present invention, it is possible to stack a piece of paper stock on stored pieces of paper stock, even if the piece is conveyed to a position deviated from a correct position.

DESCRIPTION OF EMBODIMENTS

Embodiment 1

Figure 1A:
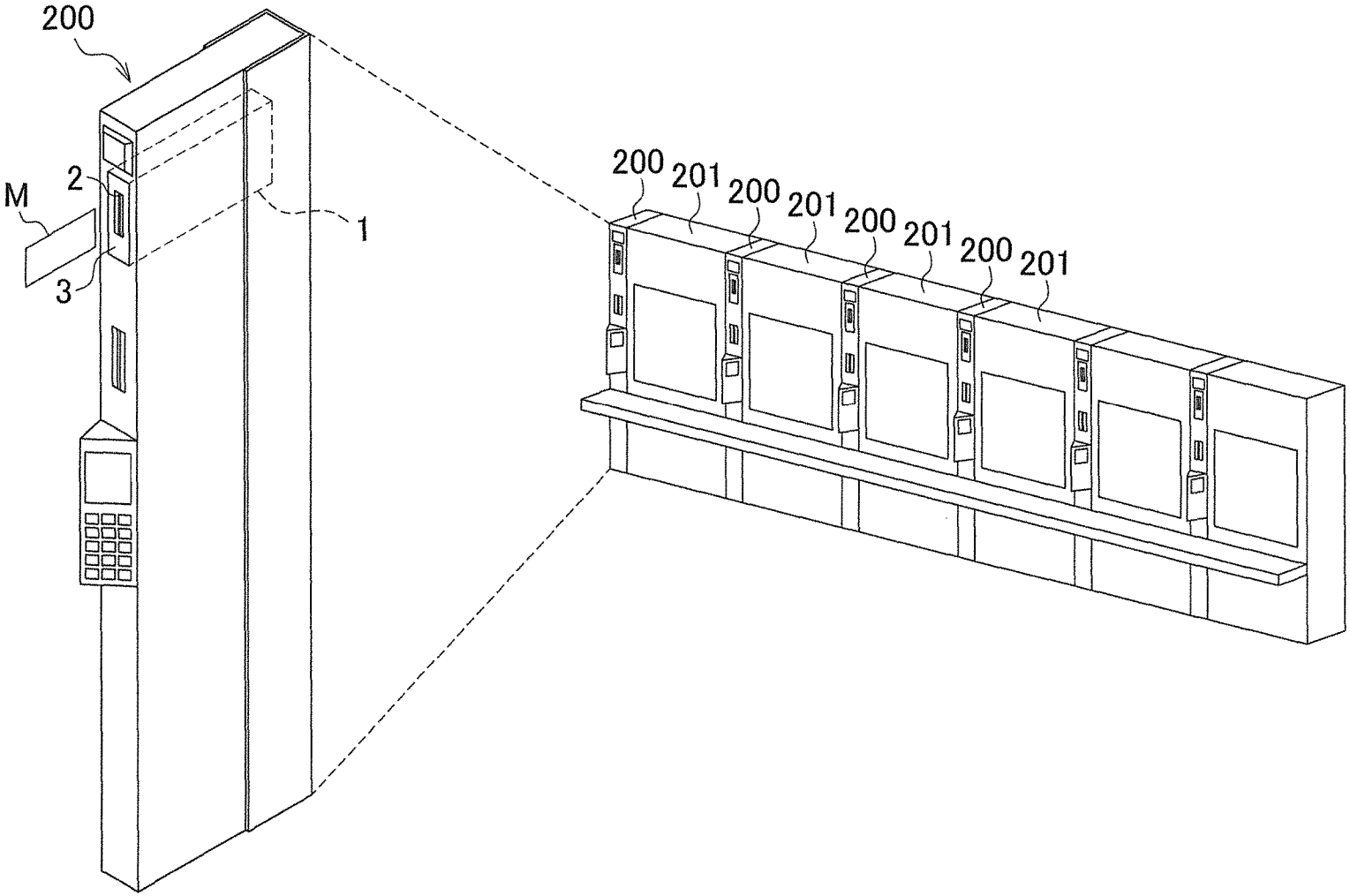
FIG. 1 is an oblique perspective showing an installation state of a gaming media lending device in which a paper money processing device of Embodiment 1 is mounted.

The following describes a paper money processing device 1 which is an embodiment of the paper stock processing device, according to the present invention. As shown in FIG. 1, the paper money processing device 1 of Embodiment 1 is integrated into a gaming media lending device (device interposed between gaming machines) 200 which is provided between gaming machines 201 of various kinds, such as slot machines. The gaming media lending device 200 has another device (e.g., a coin processing device, a storage medium processing device, a power source device, a display device, and the like) above or below the paper money processing device 1. When paper money M is inserted into the paper money processing device 1 and validated, a process such as a game media lending process or a writing process and the like relative to a storage medium such as an IC card is executed, according to the value of the paper money. The paper money processing device 1 has an insertion slot 2 configured to accept the paper money M inserted with its short side facing the insertion slot 2, and is integrated into the gaming media lending device 200 so that the insertion slot 2 is vertical. It should be noted that the number of types of paper money that the paper money processing device 1 can handle does not have to be only one type, and the device may be configured to handle a plurality of types of paper money with different lengths.

(Overview of Paper Money Processing Device 1)

Figure 2:
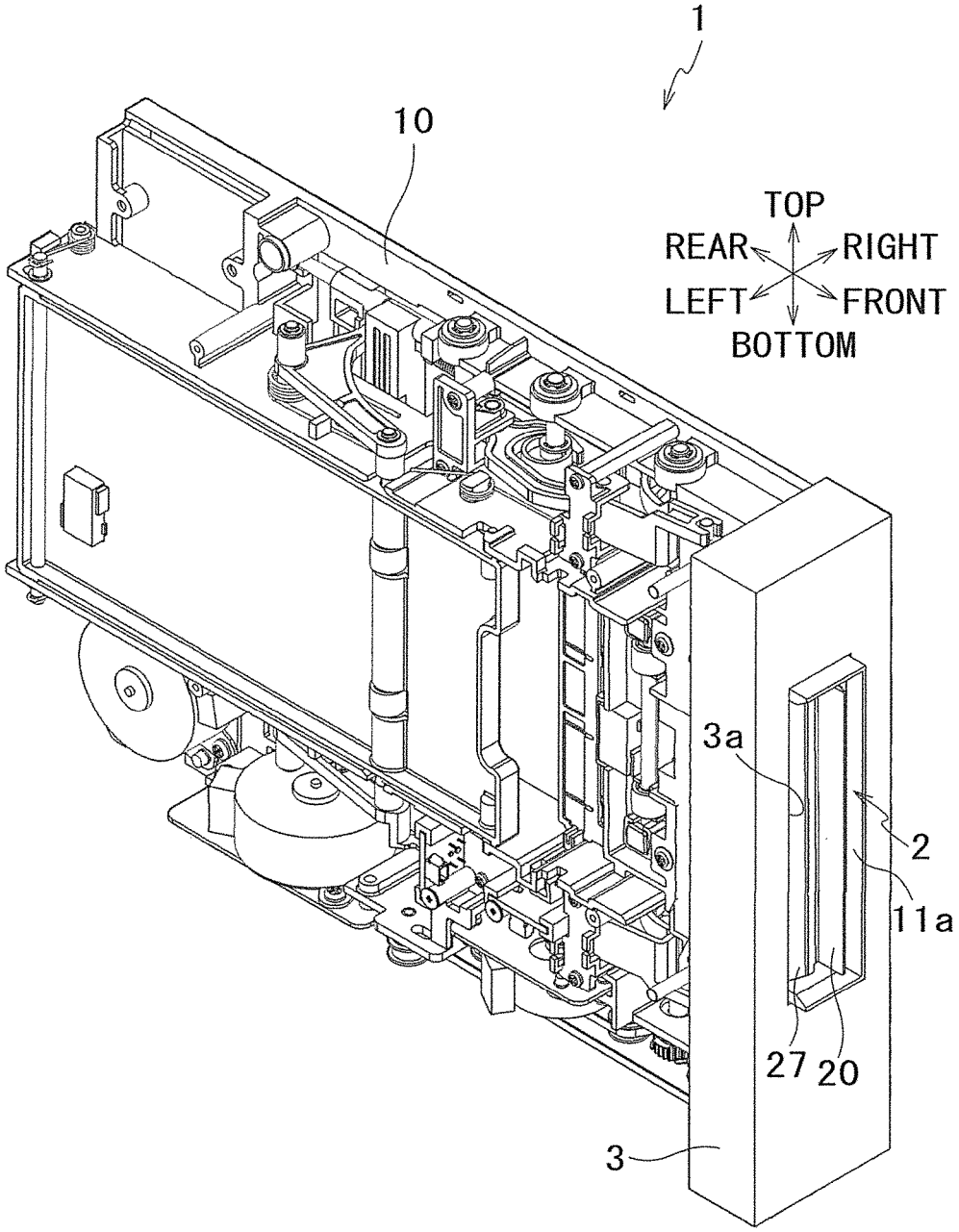
FIG. 2 is an oblique perspective of the paper money processing device.
Figure 3:
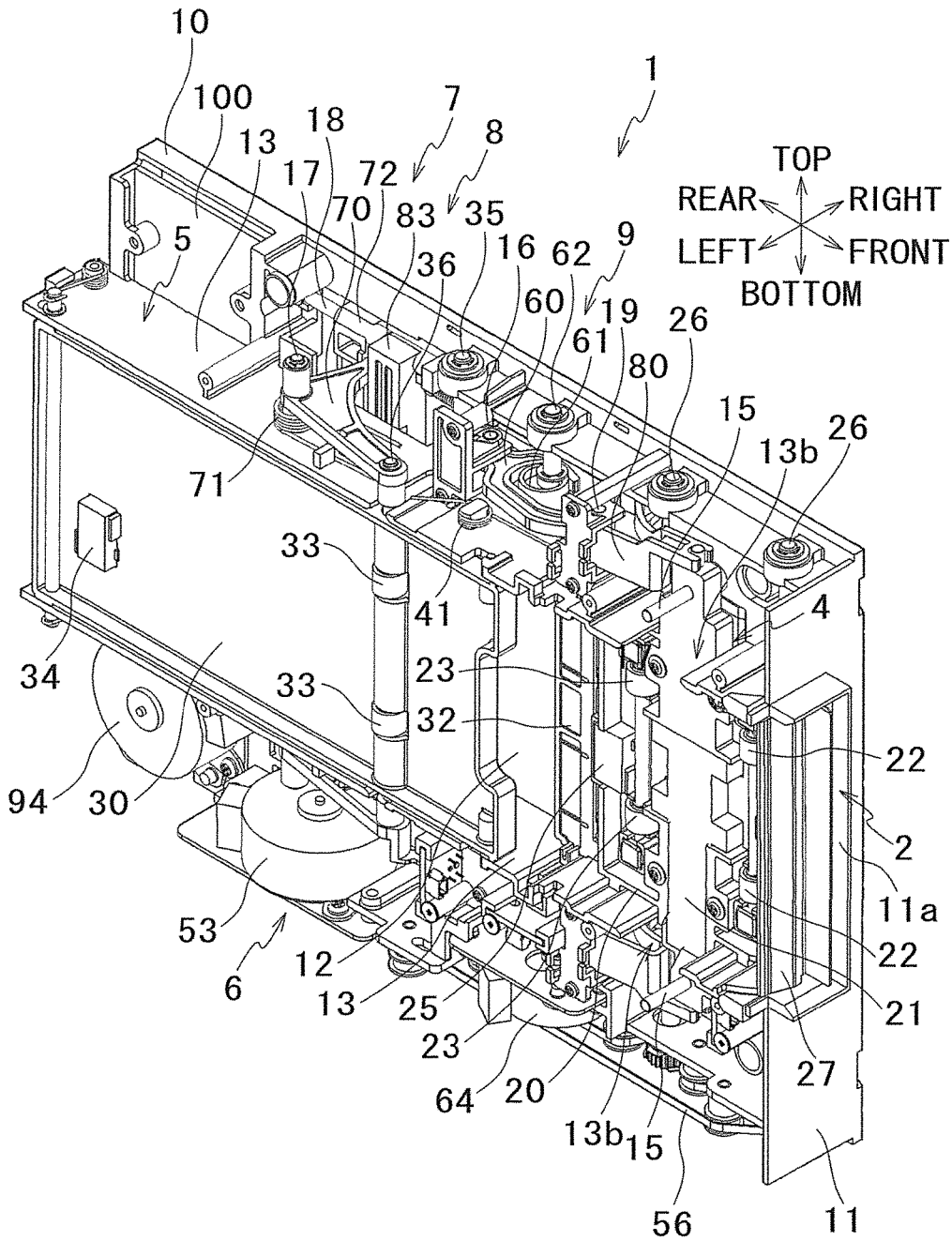
FIG. 3 is an oblique perspective showing a state in which a front cover is removed from the paper money processing device of FIG. 2.
Figure 4:
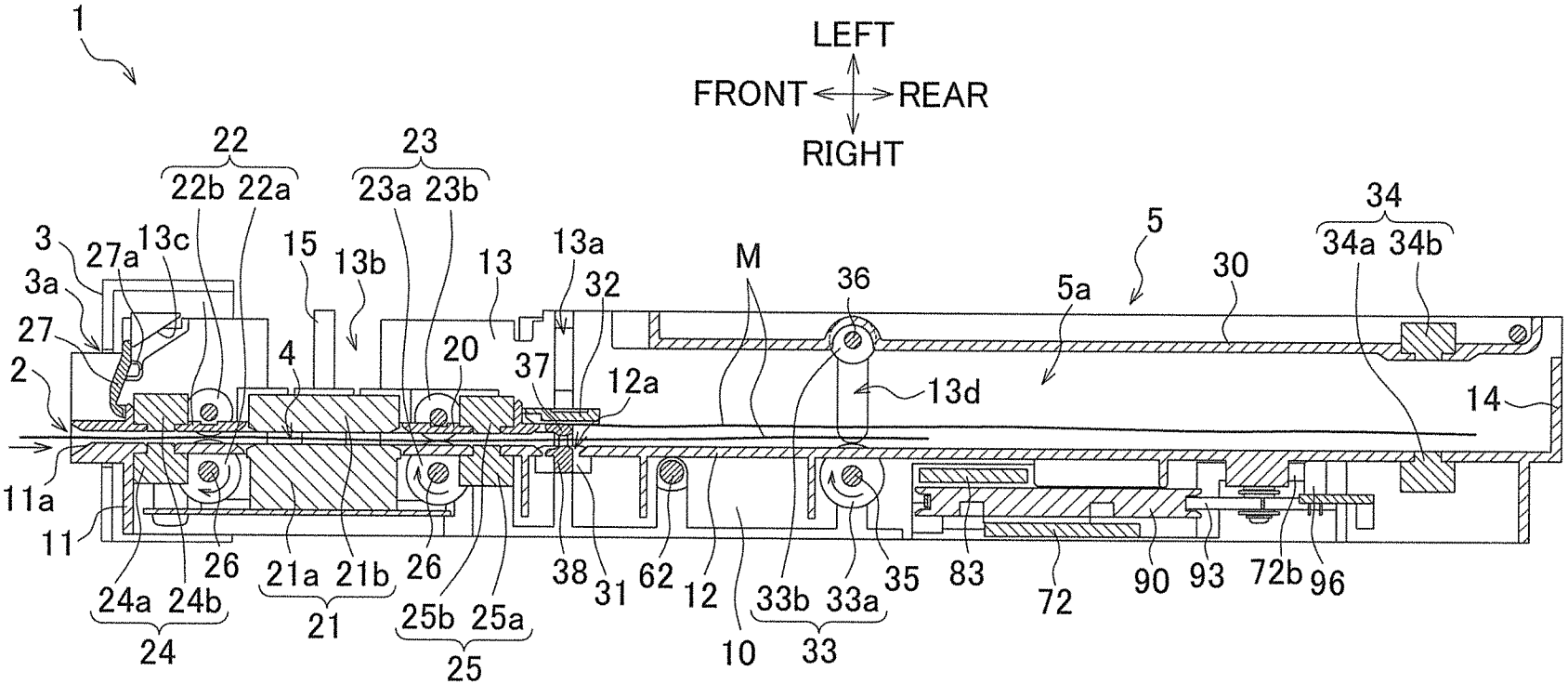
FIG. 4 is a cross sectional view of the paper money processing device, showing a state in which a piece of paper money inserted is being conveyed toward a storage unit.

As shown in FIG. 2 and FIG. 3, the paper money processing device 1 has a frame 10 to which various parts are assembled, a rectangular hole 3*a* that leaves the insertion slot 2 uncovered, and a front cover 3 arranged so as to cover a front wall 11 of the frame 10. In the following description of the paper money processing device 1, the front/back direction, the left/right direction, and the upward/downward direction are as indicated in FIG. 2 and FIG. 3. The front wall 11 of the frame 10 has a U-shaped part 11*a* with its left side opened. As shown in FIG. 4, the frame 10 has: a wall part 12 extended toward back from the right end of the U-shaped part 11*a*; upper/lower walls 13 extended backward from the upper and lower ends of the U-shaped part 11*a*, respectively; and a back wall 14 connected to backside ends of the upper/lower walls 13 and the wall part 12.

The paper money processing device 1 includes a conveyance path 4 configured to passing therethrough the paper money M inserted into the insertion slot 2; and a storage unit 5 in which a plurality of pieces of paper money M are stored (layered and stored) in the thickness direction (left/right direction). The conveyance path 4 and the storage unit 5 are formed between the upper/lower walls 13.

The paper money processing device 1 of the present embodiment is capable of conveying the paper money M inserted into the insertion slot 2 in a piece by piece manner to the storage unit 5; and conveying a plurality of pieces of paper money M (or a piece of paper money) layered and stored in the storage unit 5 to the insertion slot 2, and eject the paper money M from the insertion slot 2. Since the paper money stored in the storage unit 5 is collected from the insertion slot 2, the efficiency of work for collecting the paper money is improved as compared with cases of collecting paper money from a part other than the insertion slot 2. Further, since the insertion slot 2 to which the paper money is inserted serves also as an ejection hole for ejecting paper money stored in the storage unit 5, the thickness of the device (the left/right directional width) is reduced as compared with cases of separately providing an insertion slot and an ejection hole. This contributes to downsizing of the device. The paper money processing device 1 of the present embodiment is also capable of interrupting conveyance of the paper money M inserted into the insertion slot 2 to the storage unit 5, and conveying it back toward the insertion slot 2.

(Conveyance Path 4 and Insertion Slot 2)

The wall part 12 has a hole 12*a* in a frontward position of a middle portion of the wall part 12 relative to the front/back direction. The conveyance path 4 is formed by parts of the wall part 12 and the upper/lower walls 13, on the front side of the hole 12*a*; and an upper guide 20 facing a left side part of the wall part 12 on the front side of the hole 12*a*. In the conveyance path 4 are arranged a reader unit 21 configured to read image information of the paper money; insertion conveyance roller pairs 22 and 23 configured to pinch the paper money in the direction corresponding to the thickness direction of the paper money; paper money detection sensors 24 and 25 configured to detect the paper money M.

Figure 13:
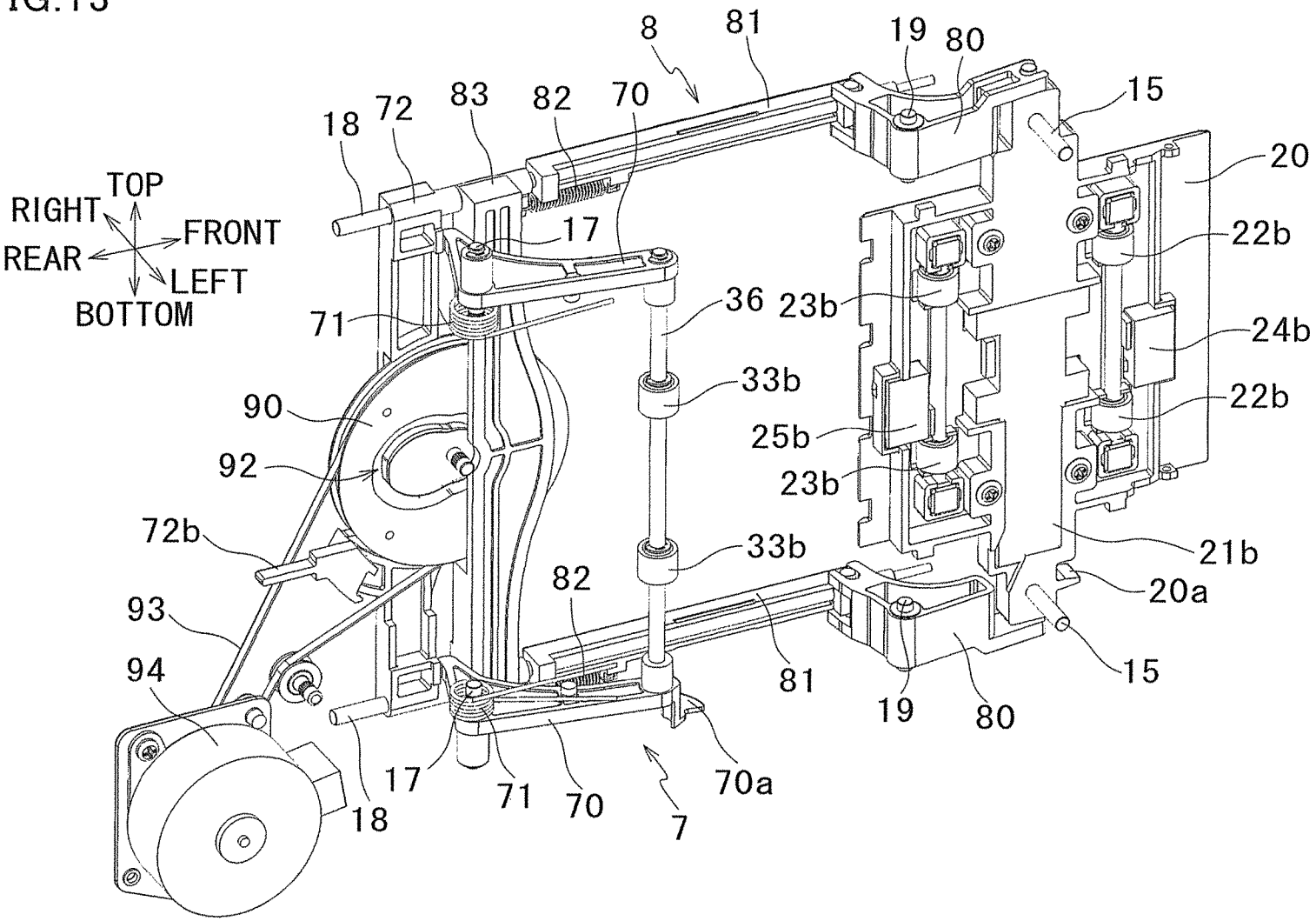
FIG. 13 is an oblique perspective of an upper guide, an expansion mechanism, a pinch roller of a conveyance roller pair, a change mechanism, a cam plate, and a cam driving motor when viewed from the left side in FIG. 1.

The upper guide 20 is a substantially plate-like member as shown in FIG. 13, and its front end part is arranged inside of the U-shaped part 11*a* of the front wall 11. The insertion slot 2 is formed by a space between the U-shaped part 11*a* and the front end part of the upper guide 20.

Figure 5:
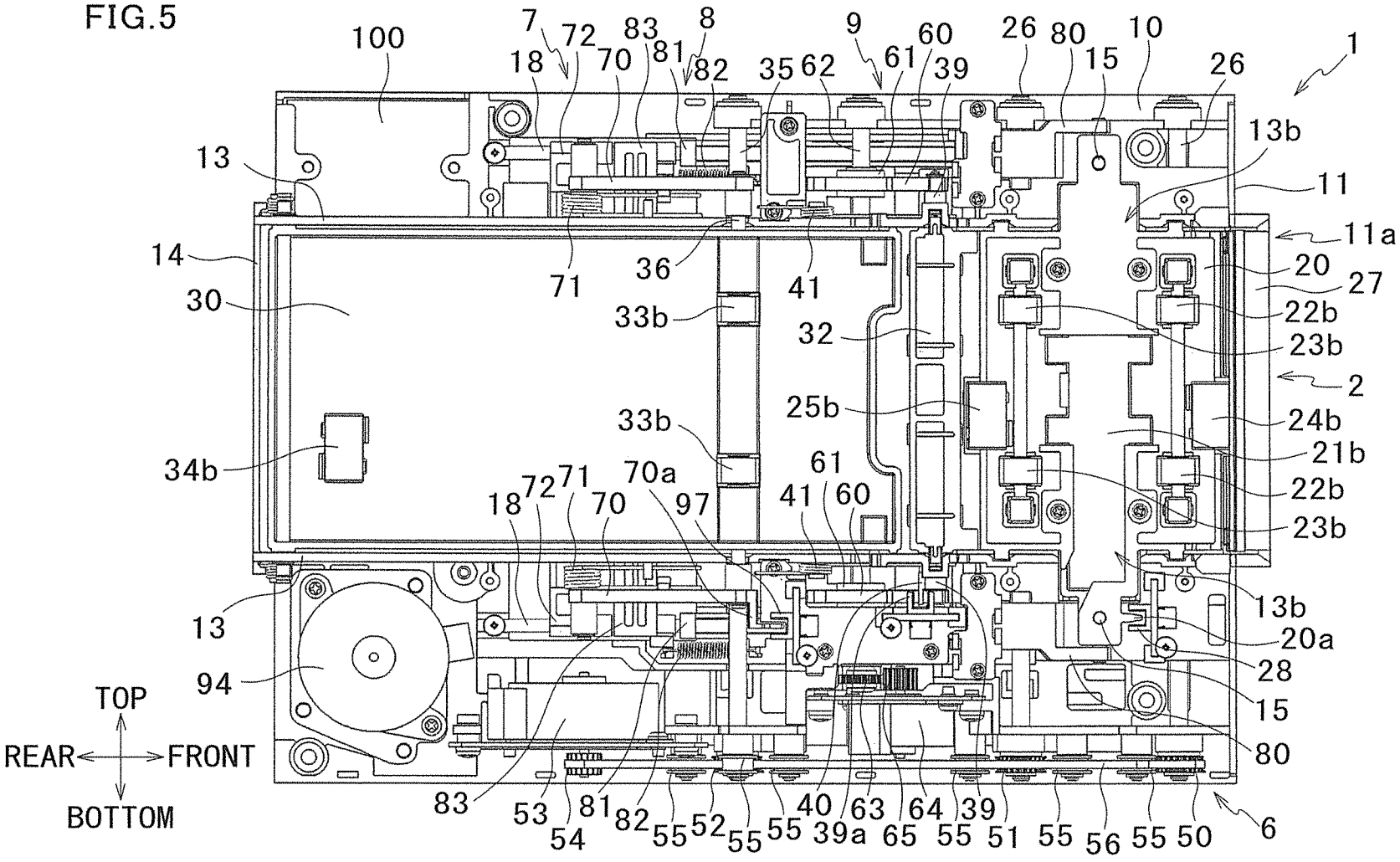
FIG. 5 shows the paper money processing device of FIG. 1 from the left side.

As shown in FIG. 5, the middle portions relative to the front/back direction of the upper and lower end portions of the upper guide 20 protrudes upward and downward, respectively, and these protruded portions are arranged inside slits 13*b* formed on the upper/lower walls 13. Through these upper and lower end portions penetrate guide shafts 15 fixed to the frame 10 which extend in the left/right direction. Therefore, the upper guide 20 is movable in the left/right directions (in the thickness direction of the paper money), along the guide shafts 15. The upper guide 20 is driven in the left/right directions, by an expansion mechanism 8 described later.

As shown in FIG. 4, the reader unit 21 is arranged in a middle portion relative to the front/back direction of the conveyance path 4, and is configured to read substantially across the entire width direction of the paper money passing the conveyance path 4. The reader unit 21 of the present embodiment is an image sensor capable of reading a reflection image and a see-through image of the paper money, and includes: a light emission/reception unit 21*a* including a light receiver and a light emitter for reflection of light, which is provided to the wall part 12; and a light emitter 21*b* for transmission of light (hereinafter, simply referred to as light emitter 21*b*), which is provided to the upper guide 20. The light emission/reception unit 21*a* is substantially flush with the left surface of the wall part 12, and the light emitter 21*b* is substantially flush with the right surface of the upper guide 20. The light emitter of the light emission/reception unit 21*a* and the light emitter 21*b* are capable of emitting visible light and infrared light. Light is casted from the both sides of the paper money M in the conveyance path 4, and the reader unit 21 reads the image information of the paper money by sensing the transmitted light and the reflected light by the light receiver. The image information of the paper money read by the reader unit 21 is transmitted to a later-described control circuit board 100, and the paper money is verified by comparing the image information with data of the genuine note stored in advance. It should be noted that a structure other than the one described above may be adopted as the reader unit 21 as long as the reader unit 21 is the image sensor.

In the vicinity of the insertion slot 2 is arranged a first paper money detection sensor 24. In the vicinity of the rear end of the conveyance path 4 is arranged a second paper money detection sensor 25. The first paper money detection sensor 24 is a retroreflection model photo sensor, and includes a sensor unit 24*a* provided to the wall part 12 and a prism unit 24*b* provided to the upper guide 20. The second paper money detection sensor 25 is a retroreflection model photo sensor as in the case of the first paper money detection sensor 24, and includes a sensor unit 25*a* provided to the wall part 12 and a prism unit 25*b* provided to the upper guide 20. It should be noted that the paper money detection sensors 24 and 25 may be sensors other than the ones described above, provided that the sensors are capable of detecting the paper money M.

The insertion conveyance roller pair 22 is arranged between the first paper money detection sensor 24 and the reader unit 21 and the insertion conveyance roller pair 23 is arranged between the reader unit 21 and the second paper money detection sensor 25. The insertion conveyance roller pair 22 includes a drive roller 22*a* arranged on the side of the wall part 12 and a pinch roller 22*b* arranged on the side of the upper guide 20. The insertion conveyance roller pair 22 is arranged in two positions, with a space between the positions relative to the upward/downward direction. As in the insertion conveyance roller pair 22, the insertion conveyance roller pair 23 includes a drive roller 23*a* arranged on the side of the wall part 12 and a pinch roller 23*b* arranged on the side of the upper guide 20. The insertion conveyance roller pair 23 is arranged in two positions, with a space between the positions relative to the upward/downward direction.

The drive rollers 22*a* and 23*a* are respectively fixed to drive shafts 26 rotatably supported by the frame 10, and slightly protrude from the left surface of the wall part 12. The drive shafts 26 are each driven by a later-described conveyance mechanism 6. The pinch rollers 22*b* and 23*b* are respectively fixed to shafts rotatably supported by the upper guide 20, and slightly protrude from the right surface of the upper guide 20. The outer circumferences of the drive rollers 22*a* and 23*a* are formed by a material having a high friction coefficient with respect to paper money.

With the upper guide 20 driven by the expansion mechanism 8 in the left/right direction, the light emitter 21*b*, the prism units 24*b* and 25*b*, and the pinch rollers 22*b* and 23*b* provided to the upper guide 20 also move, changing the aperture width (left/right directional width) of the conveyance path 4.

In a normal situation (when entering paper money), the upper guide 20 is positioned closest to the wall part 12, and the aperture width of the conveyance path 4 is the narrowest. At this time, the pinch roller 23*b* and the drive roller 23*a* contact each other with a suitable pressure to each other. When the drive shaft 26 are rotated to rotate the drive rollers 22*a* and 23*a* during this state, a piece of paper money M inserted into the insertion slot 2 is conveyed to the storage unit 5 by the insertion conveyance roller pairs 22 and 23, as shown in FIG. 4.

Figure 9A:
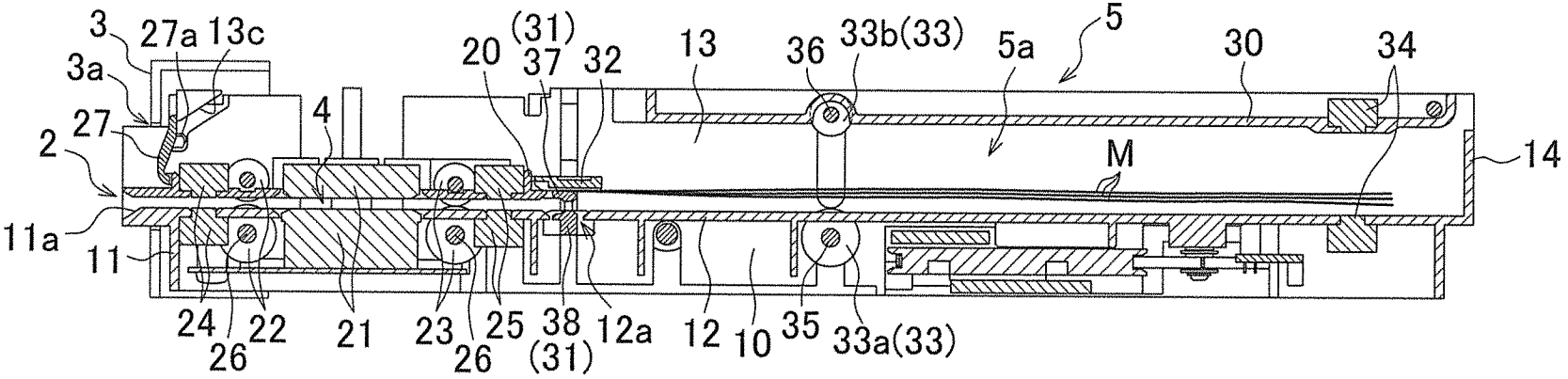
FIG. 9A is a cross sectional view for explaining an operation to collect the paper money layered and stored in the storage unit, through an insertion slot.
Figure 9B:
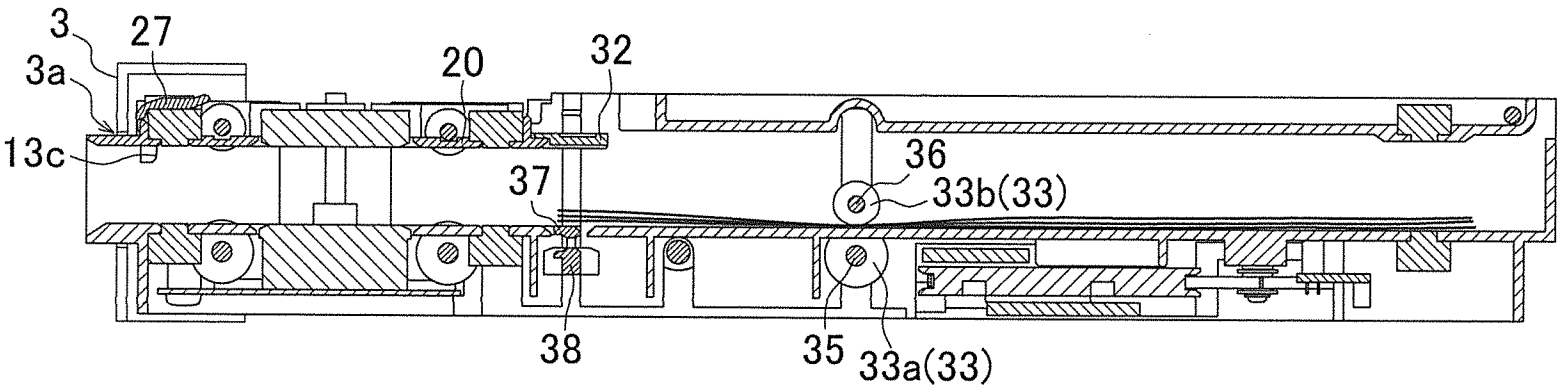
FIG. 9B is a cross sectional view for explaining an operation to collect the paper money layered and stored in the storage unit, through an insertion slot.
Figure 9C:
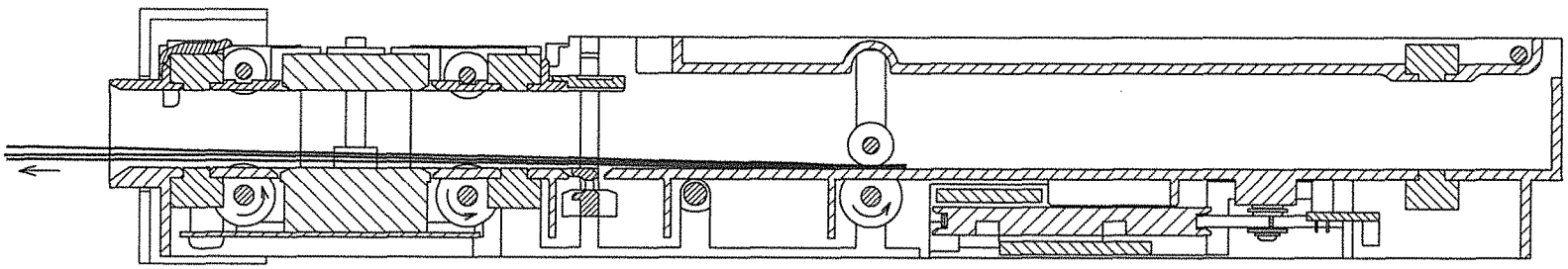
FIG. 9C is a cross sectional view for explaining an operation to collect the paper money layered and stored in the storage unit, through an insertion slot.

When collecting the paper money M stored in the storage unit 5 from the insertion slot 2, the upper guide 20 moves away from the wall part 12, thereby expanding the aperture width of the conveyance path 4, as shown in FIG. 9B and FIG. 9C. Therefore, even when a large number of pieces of paper money are stored in the storage unit 5, the upper guide 20 will not be in the way and the paper money is collectible through a single conveyance path 4.

When the upper guide 20 is brought back to original position after expanding the aperture width of the conveyance path 4, the relative distance of the light emitter 21*b* and the light receiver of the light emission/reception unit 21*a* of the reader unit 21 is slightly different from that before the expansion. While a slightest change in the relative distance between a light receiver and a light emitter of a traditional optical sensor leads to an error in the read data, a change of a certain extent in the relative distance between the light emitter 21*b* and the light receiver (21*a*) of the reader unit 21 serving as the image sensor hardly causes an error in the read data, because the depth of field of the lens of the light receiver is set deep.

As mentioned hereinabove, the insertion slot 2 is formed by a space between the U-shaped part 11*a* of the front wall 11 and the front end part of the upper guide 20. Therefore, the aperture width (left/right directional width) of the insertion slot 2 is variable by moving the upper guide 20 in the left/right direction. That is, similarly to the aperture width of the conveyance path 4, the aperture width of the insertion slot 2 is the narrowest in the normal occasions, but is expanded when collecting paper money M stored in the storage unit 5 from the insertion slot 2. The narrowest aperture width of the insertion slot 2 in the normal occasions prevents the paper money from being illegally pulled out through the insertion slot 2. Further, the expansion of the insertion slot 2 at the time of collecting the paper money stored in the storage unit 5 enables collection of a large quantity of paper money stored in the storage unit 5 through the insertion slot 2.

To close the space between the rectangular hole 3*a* of the front cover 3 and the upper guide 20, in association with the movement of the upper guide 20, a space cover 27 is attached to the front end part of the upper guide 20. The space cover 27 is rotatably jointed to the upper guide 20. Further, the space cover 27 has an engagement protrusion 27*a* which engages with a guide groove 13*c* formed on the upper/lower walls 13 of the frame 10. In the normal occasions (when the aperture width of the insertion slot 2 is the minimum), the engagement protrusion 27*a* is engaged with the front end part of the guide groove 13*c*, and the space cover 27*a* is arranged so as to close the space between the front end part of the upper guide 20 and the left end of the rectangular hole 3*a* of the front cover 3. When the upper guide 20 is moved away from the wall part 12 as shown in FIG. 9B, the engagement protrusion 27*a* moves along the guide groove 13*c*, thus rotating the space cover 27.

In the lower end portion of the upper guide 20 is formed a protrusion 20*a* protruding frontward, and the frame 10 is provided with an upper guide detection sensor 28 capable of detecting the protrusion 20*a* (see FIG. 5). The upper guide detection sensor 28 is monitoring for unauthorized movement of the upper guide 20 in the direction of expansion. The upper guide detection sensor 28 is a transmissive photosensor, and is installed so that the protrusion 20*a* is detected when the upper guide 20 is closest to the wall part 12 (i.e., when the aperture width of the conveyance path 4 is the minimum), and that the protrusion 20*a* is not detected when the upper guide 20 is spaced at least a predetermined distance away from the wall part 12.

(Storage Unit 5)

The storage unit 5 is formed on the backward side of the front end of the hole 12*a*, and has a storage space 5*a* in which pieces of paper money are layered and stored. The storage unit 5 is formed by parts of the wall part 12 and the upper/lower walls 13, on the back side of the hole 12*a*; a back wall 14; and a storage cover 30 facing the left side part of the wall part 12. Further, in the storage unit 5 are arranged a stack gate 31, a pressing plate 32, a conveyance roller pair 33 capable of pinching the paper money in the thickness directions, and an empty sensor 34 capable of detecting the paper money in the storage space 5*a*.

The storage cover 30 is rotatably jointed to a portion nearby the rear end of the upper/lower walls 13, and are capable of being opened and closed by a hand. The storage cover 30 is opened, for example, at the time of maintenance and when the paper money is jammed in the storage unit 5.

The empty sensor 34 is arranged in a position that enables detection of the rear end of the paper money stored in the storage unit 5. More specifically, the empty sensor 34 is arranged in a position where a longest piece of paper money entered is not detected before its trailing end (leading end) relative to the conveyance direction reaches a later-described escrow position, and where the longest piece of paper money stored in the storage unit 5 is detected. The empty sensor 34 is a retroreflection model photo sensor, and includes a sensor unit 34*a* provided to the wall part 12 and a prism unit 34*b* provided to the storage cover 30. It should be noted that a sensor other than the one described above may be adopted as the empty sensor 34, provided that the sensor is capable of detecting the paper money M.

The conveyance roller pair 33 includes a drive roller 33*a* arranged on the side of the wall part 12 and a pinch roller 33*b* arranged on the side of the storage cover 30. The conveyance roller pair 33 is arranged in two positions, with a space between the positions relative to the upward/downward direction. The space between the insertion slot 2 and the conveyance roller pair 33 is longer than the length of the paper money relative to the conveyance direction.

The drive roller 33*a* is fixed to a drive shaft 35 rotatably supported by the frame 10, and slightly protrudes from the left surface of the wall part 12. The drive shaft 35 is driven by the later-described conveyance mechanism 6. The pinch roller 33*b* is fixed to a spindle 36 inserted into a slit 13*d* formed on the upper/lower walls 13. The spindle 36 is driven in the left/right direction by the later-described change mechanism 7. During a state in which the spindle 36 is farthest from the drive shaft 35, the pinch roller 33*b* is exposed to the outside from an opening formed on the storage cover 30. The friction coefficient of the outer circumference of the drive roller 33*a* with respect to the paper money is greater than the friction coefficient of pieces of paper money with respect to each other. The friction coefficient of the outer circumference of the pinch roller 33*b* is greater than the friction coefficient of pieces of paper money with respect to each other.

Figure 6:
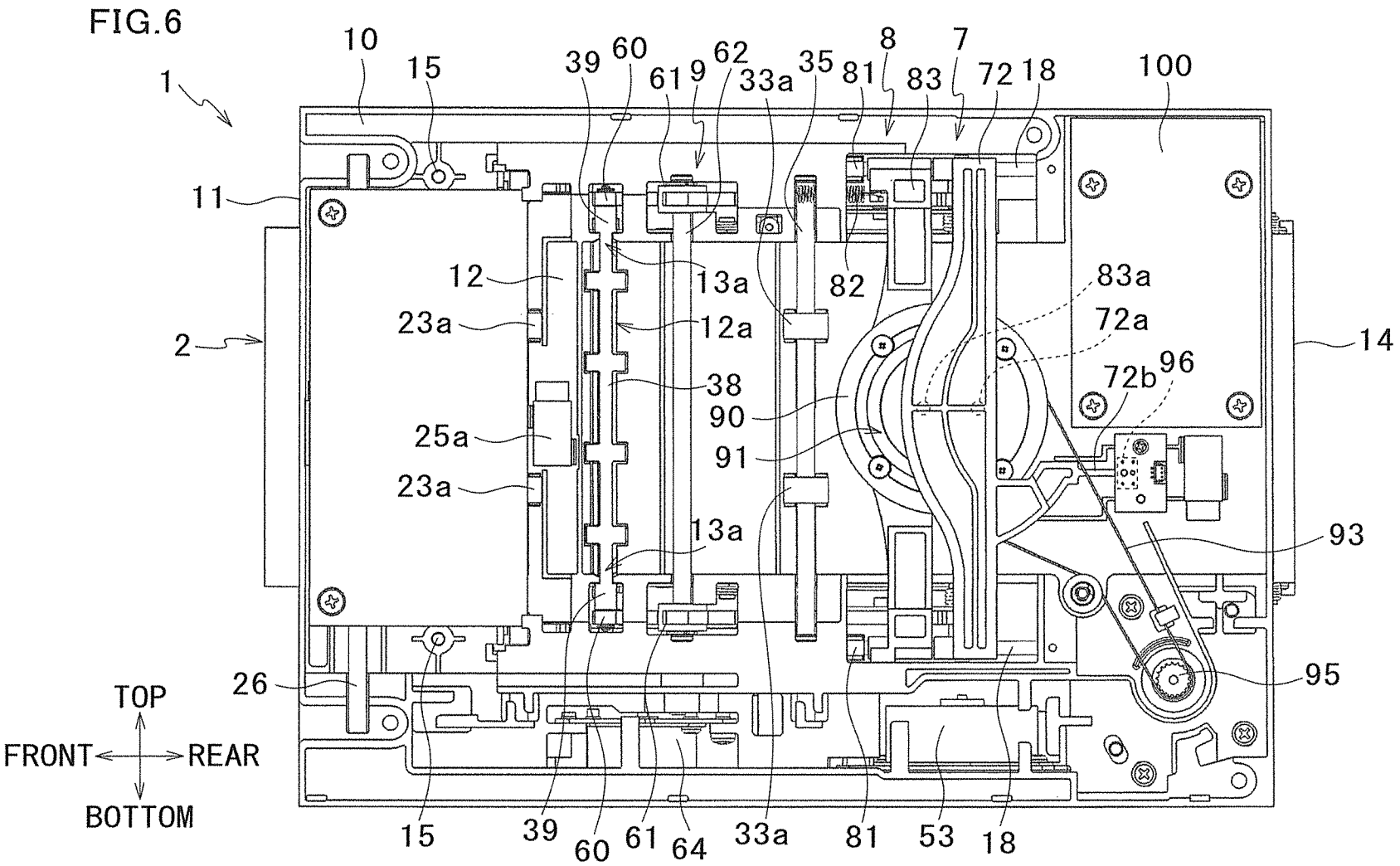
FIG. 6 shows the paper money processing device of FIG. 1 from the right side.
Figure 10A:
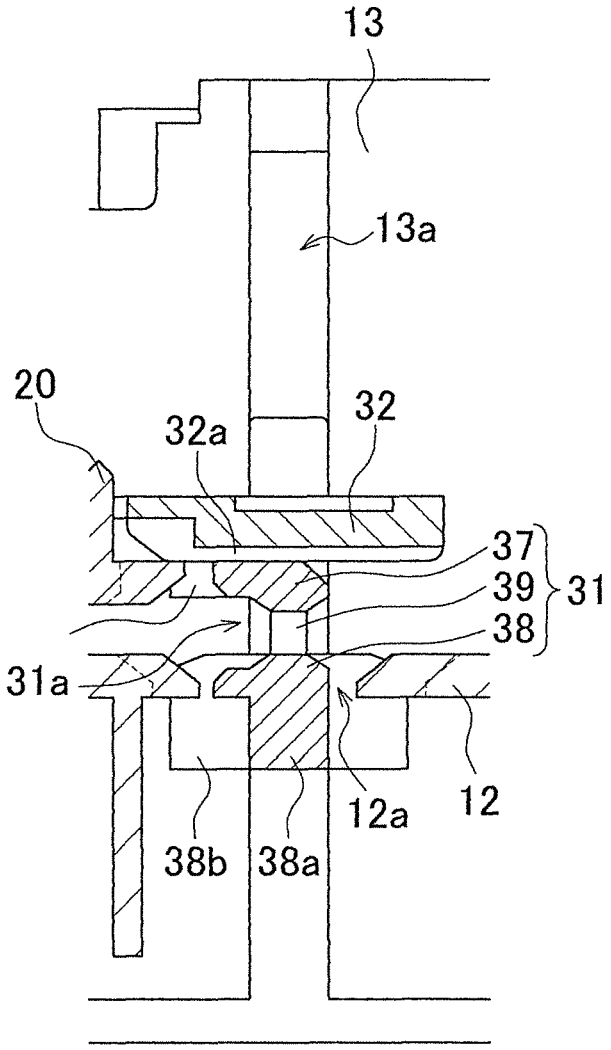
FIG. 10A is a partial enlarged cross sectional view of a stack gate and its surroundings, showing a state in which the stack gate is at an import position.

The front and rear ends of the hole 12*a* are formed in regular rectangular pulse shapes, when viewed in a left/right direction (see FIG. 6). As shown in FIG. 10A, the front and rear ends of the hole 12*a* both have a chamfered shape. Further, the upper/lower walls 13 have slits 13*a* each of which is in communication with the hole 12*a*. The slits 13*a* extend from the vicinities of the left ends of the upper/lower walls toward the right ends. Further, the rear end of the upper guide 20 is formed in a regular rectangular pulse shape which is substantially the same as the front end of the hole 12*a*, when viewed in a left/right direction (see FIG. 13).

The upper and lower ends of the stack gate 31 are arranged in the slits 13*a*, and are formed to be capable of being penetrating the hole 12*a* in the left/right direction. The stack gate 31 is driven in the left/right direction by a later-described stack gate drive mechanism 9.

Figure 11:
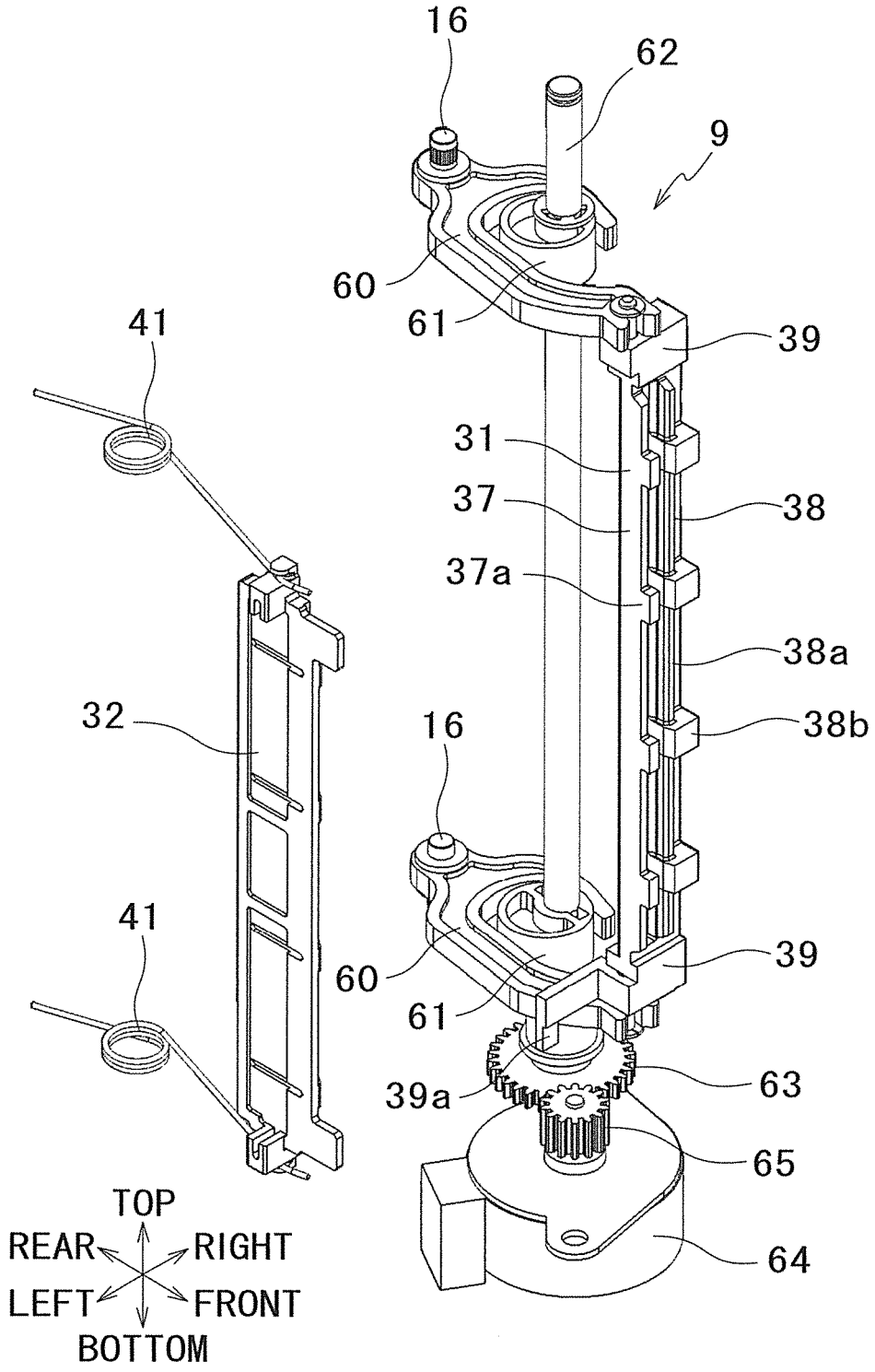
FIG. 11 is an oblique perspective of the stack gate, a stack gate drive mechanism, and a pressing plate when viewed from the left side in FIG. 1.

As shown in FIG. 11, the stack gate 31 has a stacking part 37 extending in an upward/downward direction (a direction perpendicular to the conveyance direction of the paper money), a guide 38 arranged on the right side of the stacking part 37 with a space therebetween so as to face the stacking part 37, and two joints 39 jointing the stacking part 37 and the guide 38 at their upper and lower ends. The joints 39 are each connected to the stack gate drive mechanism 9.

The stacking part 37 has a plurality of protrusions 37*a* protruding forward, which are arranged at equal intervals in the upward/downward direction. The protrusions 37*a* are formed in positions corresponding to the opening part of the hole 12*a*, and the front end of the stacking part 37 has a shape that matches with the front end of the hole 12*a*, when viewed in a left/right direction.

The right side surface (the surface facing the guide 38) of the stacking part 37 is formed so that its substantially back half portion protrudes toward the right, and the front and rear ends of the protruding part are chamfered. Further, the right ends of portions of the front end of the stacking part 37 having no protrusions 37*a* are chamfered. Further, the back left end of the stacking part 37 having no protrusions 37*a* is chamfered.

The guide 38 is structured by linear parts 38*a* and a widened parts 38*b* which is wider than the linear parts 38*a* relative to the front/back direction are alternately aligned in the upward/downward direction. The widened parts 38*b* are formed in positions corresponding to the opening part of the hole 12*a*, and the front and rear ends of the guide 38 both have a shape that match with the front end of the hole 12*a*, when viewed in the left/right direction.

The left side surface (the surface facing the stacking part 37) of each of the linear parts 38*a* is formed so that its substantially back half portion protrudes toward the right, and the front and rear ends of the protruding part are chamfered. The leading end surface of the protrusion faces the leading end surface of the protruding part formed on the substantially back half of the right surface of the stacking part 37. Further, the front left end of the linear part 38*a* is chamfered. Further, the front and rear ends of the left surface of the widened part 38*b* is chamfered.

Figure 10B:
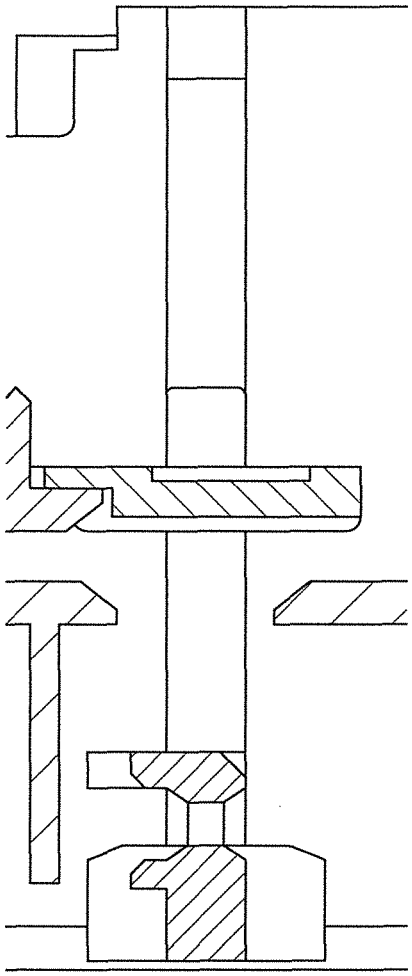
FIG. 10B is a partial enlarged cross sectional view of a stack gate and its surroundings, showing a state in which the stack gate is at a stack position.
Figure 10C:
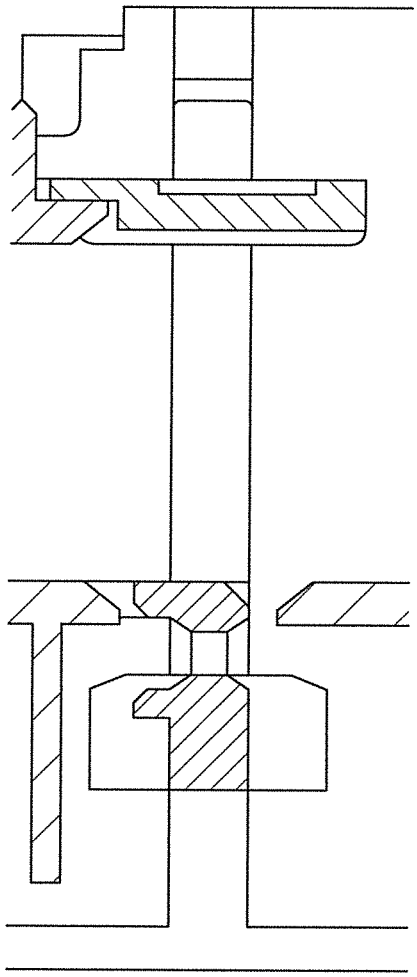
FIG. 10C is a partial enlarged cross sectional view of a stack gate and its surroundings, showing a state in which the stack gate is at an export position.

The stack gate 31 is driven by the later-described stack gate drive mechanism 9 within a range between a position where the left surface of the guide 38 is substantially flush with the left surface of the wall part 12 as shown in FIG. 10A (the position is hereinafter referred to as an import position) and a position where the stacking part 37 is sunk into the hole 12*a* as shown in FIG. 10B (the position is hereinafter referred to as stack position). As such, the stacking part 37 moves to and from the storage space 5*a* and the right side of the wall part 12. That is, the stacking part 37 is configured to emerge and sink with respect to the storage space 5*a*. A space formed between the guide 38 and the stacking part 37 while the stack gate 31 is in the import position is hereinafter referred to as import space 31*a*. Further, as shown in FIG. 10C, the position of the stack gate 31 in which the left surface of the stacking part 37 is substantially flush with the left surface of the wall part 12 as shown in FIG. 10C is referred to as an export position.

Of the two joints 39 of the stack gate 31, the lower joint 39 is provided with an L-shaped protrusion 39*a* protruding toward left, whose leading end has a portion extended downward (see FIG. 11). The frame 10 is provided with a stack gate detection sensor 40 capable of detecting that leading end of the protrusion 39*a* (see FIG. 5). The stack gate detection sensor 40 is a transmissive photosensor, and is arranged so as to detect the protrusion 39*a* while the stack gate 31 is in the import position, and not to detect the protrusion 39*a* while the stack gate 31 is at least a predetermined distance away, on the right side of the import position. The stack gate 31 is driven and controlled, based on the detection result of the stack gate detection sensor 40.

The pressing plate 32 is arranged to face the stacking part 37, on the left side of the same. The upper and lower ends of the pressing plate 32 are arranged inside the slits 13*a* formed on the upper/lower walls 13. Each of the upper and lower ends of the pressing plate 32 contacts with one end of a torsion coil spring 41 whose other end is engaged with the frame 10. With the torsion coil spring 41 on each of the upper and lower ends of the pressing plate 32, the pressing plate 32 is biased toward right.

Figure 7:
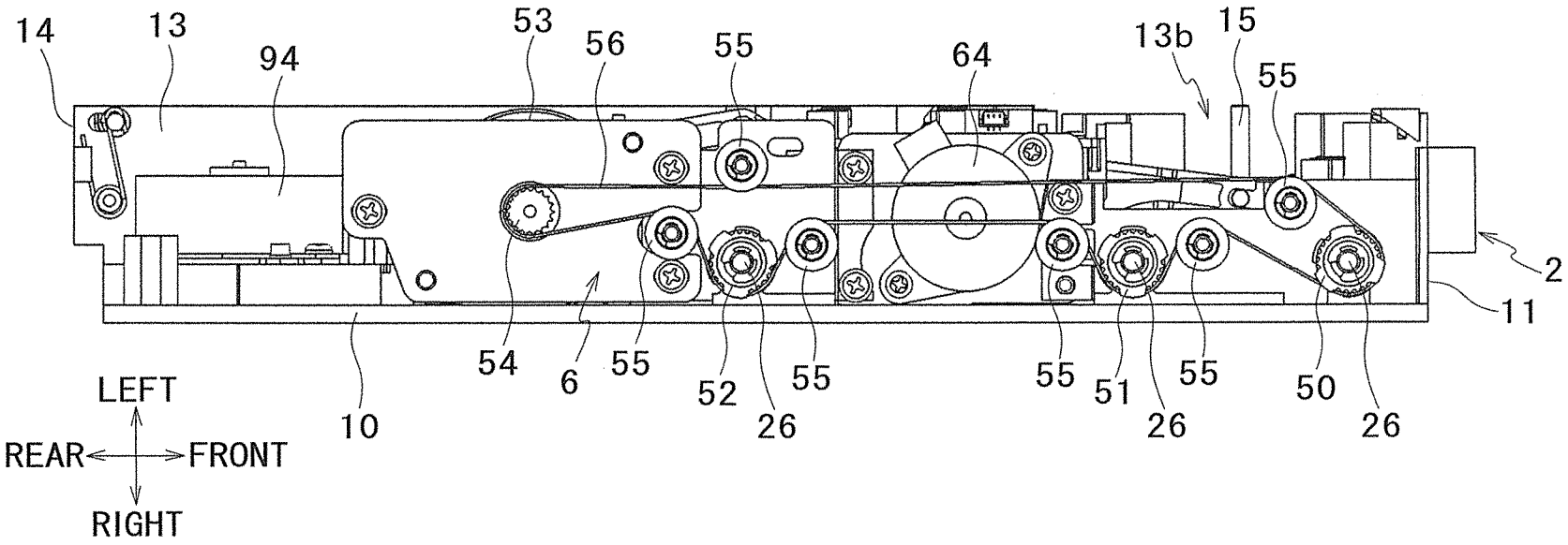
FIG. 7 is a bottom view of the paper money processing device.
Figure 12:
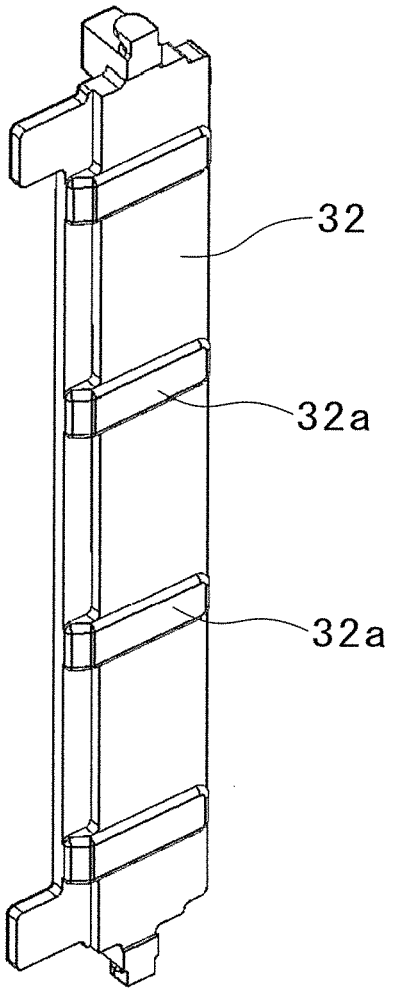
FIG. 12 is an oblique perspective of the pressing plate when viewed from the right side in FIG. 1.

As shown in FIG. 7 and FIG. 12, the right surface of the pressing plate 32 (the surface facing the stacking part 37) has a plurality of bumps 32*a* protruding toward right and extending in the front/back direction. The bumps 32*a* are formed at equal intervals in the upward/downward direction. The bumps 32*a* are formed in positions to face the protrusions 37*a* of the stacking part 37.

The front end part of the pressing plate 32 is arranged on the left side of the rear end part of the upper guide 20. Therefore, the pressing plate 32 contacts the upper guide 20 and will not move further in the rightward direction, even it is biased toward right by the torsion coil spring 41. Further, when the upper guide 20 moves in the direction of expanding the conveyance path 4, the pressing plate 32 is pressed and moved by the upper guide 20.

(Conveyance Mechanism 6)

The conveyance mechanism 6 is for rotating the drive shafts 26 and 35 to convey paper money M interposed between the insertion conveyance roller pairs 22 and 23, or between the conveyance roller pair 33. As shown in FIG. 7, the conveyance mechanism 6 includes: pulleys 50, 51, and 52 fixed at the lower ends of the drive shafts 26 and 35 of the drive rollers 22*a*, 23*a*, and 33*a*, respective; a conveyance motor 53 (see FIG. 3 and FIG. 5); a pulley 54 fixed to an output shaft of the conveyance motor 53; a plurality of tension pulleys 55; and a belt 56 looped around the pulleys 50 to 52, 54, and 55. The conveyance motor 53 is capable of rotating forward and backward. When the conveyance motor 53 rotates forward, the drive rollers 22*a*, 23*a*, and 33*a* rotate in the direction to convey the paper money M toward back. When the conveyance motor 53 rotates backward, the drive roller 22*a*, 23*a*, and 33*a* rotates in the direction to convey the paper money M toward front.

(Stack Gate Drive Mechanism 9)

The stack gate drive mechanism 9 is for driving the stack gate 31 in the left/right directions. The stack gate drive mechanism 9 includes: two stack arms 60 jointed to the two joints 39 of the stack gate 31, two eccentric cams 61, a drive shaft 62, and a stack gate motor 64 (see FIG. 11).

The two stack arms 60 are arranged on upper and lower ends of the upper/lower walls 13. Each of the stack arms 60 is formed in a Y-shape, and is rotatably jointed to the shaft 16 provided to the frame 10 at its root portion of the Y-shape. One branch of the Y-shaped stack arm 60 is rotatably jointed to the joint 39 of the stack gate 31. The surfaces of the branches of the Y-shape of the stack arm 60 are parallel to each other.

Between the branches of each Y-shaped stack arm 60 is arranged the eccentric cam 61. Each of the two eccentric cams 61 is fixed to the drive shaft 62 extended in the upward/downward direction. The centers of the two eccentric cams 61 are coaxial, and are offset from the center of the drive shaft 62.

The drive shaft 62 is rotatably supported by the frame 10 at its upper and lower end portions. In the vicinity of the drive shaft 62 is fixed a gear 63 which engages with an output gear 65 fixed to the output shaft of the stack gate motor 64.

Driving the stack gate motor 64 rotates the drive shaft 62, thus causing the eccentric cams 61 to rotate while pressing the stack arms 60. This causes the stack arms 60 to swing about the shaft 16, consequently moving the stack gate 31 jointed to the stack arms 60 in the left/right directions.

(Change Mechanism 7)

The change mechanism 7 is for changing the relative distance between the pinch roller 33*b* and the drive roller 33*a*, by moving the spindle 36 (and the pinch roller 33*b*) in the left/right directions. The change mechanism 7 is jointed to a later-described cam plate 90, and its operation is driven by a cam driving motor 94 for driving the cam plate 90. The change mechanism 7 has two arms 70 jointed to the upper and lower ends of a spindle 36, two torsion coil springs 71, and a slide member 72 (see FIG. 13).

The two arms 70 are arranged on the upper and lower sides of the upper/lower walls 13. Each of the arms 70 is formed substantially in an L-shape, when viewed in the left/right direction. At a portion in the vicinity of the corner of the L-shape, the arm 70 is rotatably jointed to a shaft 17 provided to the frame 10. One end portion of the L-shaped arm 70 is rotatably jointed to the spindle 36, and the other end portion contacts the front surface of the slide member 72.

The two torsion coil springs 71 are arranged between the arms 70 and the upper/lower walls 13. One ends of the springs are engaged with the upper/lower walls 13, while the other ends are engaged with a portion of the arm 70, substantially in the middle of a shaft 17 and the spindle 36. The arms 70 are biased in a direction to press the slide member 72 (in a direction to move the spindle 36 toward right) by the torsion coil springs 71.

The slide member 72 is arranged on the right side of the wall part 12 (see FIG. 6). Through the upper and lower ends of the slide member 72 are penetrated guide shafts 18 which are fixed to the frame 10 and extends in the front/back direction. The slide member 72 moves in the front/back directions along the guide shafts 18.

In a middle portion relative to the upward/downward direction of the left surface (the surface on the side of the wall part 12) of the slide member 72, an engagement protrusion 72*a* is formed. The engagement protrusion 72*a* is engaged with a first cam groove 91 formed on the right surface of the cam plate 90 on the left side of the slide member 72.

The cam plate 90 has a disc-like shape, and is rotatably supported at its center by a shaft provided to frame 10. On the outer circumference of the cam plate 90 is a belt 93 which is wound around the cam plate 90 and a pulley 95 fixed to the output shaft of the cam driving motor 94. Driving the cam driving motor 94 rotates the cam plate 90.

Figure 14A:
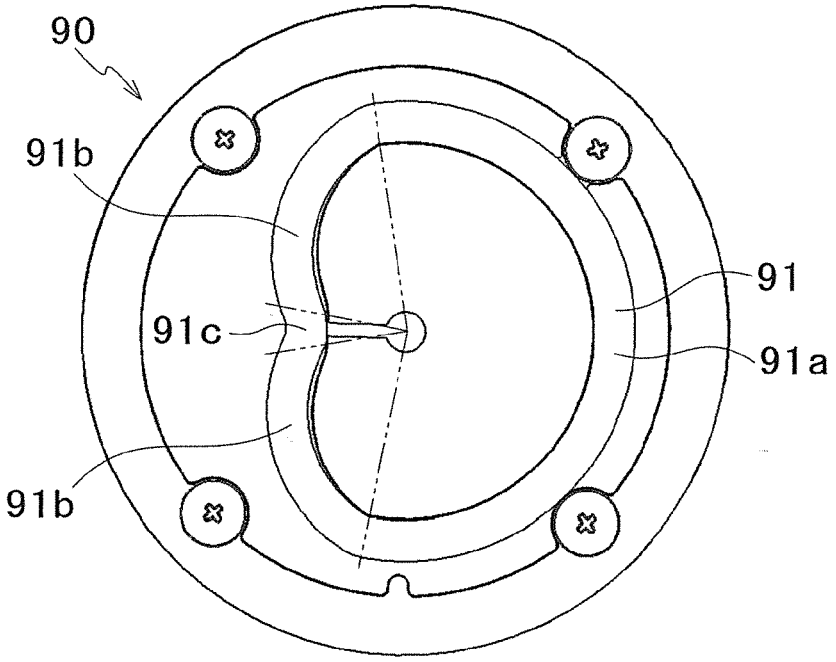
FIG. 14A shows one side of the cam plate.

As shown in FIG. 14A, the first cam groove is formed in an annular shape which includes: a large diameter portion 91*a* with a constant diameter; two intermediate portions 91*b* jointed on both sides of the large diameter portion 91*a*, whose respective diameters vary continuously; and a small diameter portion 91*c* with a constant diameter which is smaller than the diameter of the large diameter portion 91*a*. The angle of the large diameter portion 91*a* is 200 degrees, the angle of each of the two intermediate portions 91*b* is 70 degrees, and the angle of the small diameter portion 91*c* is 20 degrees. It should be noted that the angles of the groove portions 91*a* to 91*c* are not limited to those described above.

The engagement protrusion 72*a* of the slide member 72 is engaged with a portion of the first cam groove 91 which is on the back side of the center of the cam plate 90, and at the same height as the center of the cam plate 90 relative to the upward/downward direction.

Figure 15A:
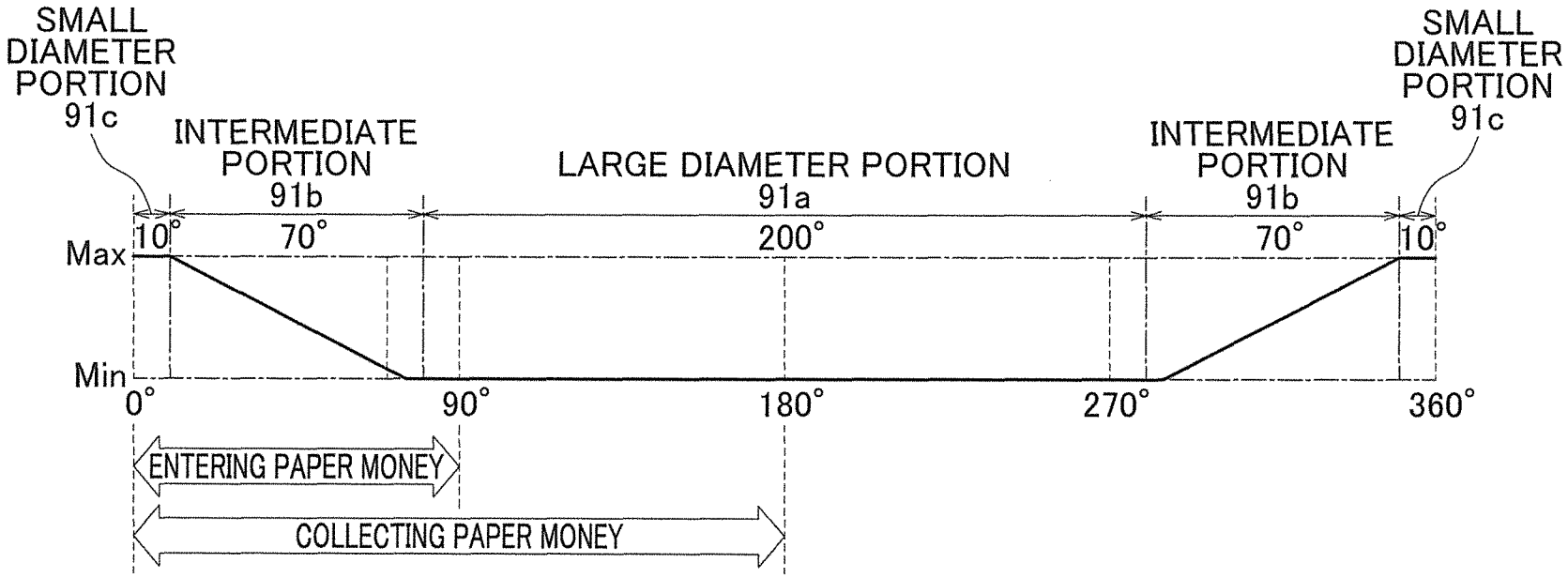
FIG. 15A is an explanatory diagram showing the relationship between the position of an engagement protrusion in a first cam groove during the rotation of the cam plate when no paper money is stored in the storage unit and the relative distance between the drive roller and the pinch roller in the conveyance roller pair.

When the cam plate 90 rotates and the engagement protrusion 72*a* moves in the small diameter portion 91*c*, the distance between the engagement protrusion 72*a* and the center of the cam plate 90 is the minimum and constant, and the slide member 72 stops at a foremost position. At this time, the arms 70 are pressed against the slide member 72 by the torsion coil spring 71, the relative distance between the pinch roller 33*b* and the drive roller 33*a* is the maximum as shown in FIG. 15A. It should be noted that FIG. 15A is a graph indicating the relation between the position of the engagement protrusion 72*a* in the first cam groove A91 while no paper money is stored in the storage unit 5, and the relative distance of the pinch roller 33*b* and the drive roller 33*a*. The horizontal axis represents the angle of the first cam groove A91, with the middle portion of the small diameter portion 91*c* relative to its circumference as the reference. The position of the cam plate 90 while the engagement protrusion 72*a* engages with the small diameter portion 91*c* is referred to as reference position, and the position of the pinch roller 33*b* during this state is hereinafter referred to as standby position.

Further, the engagement protrusion 72*a* moves in the large diameter portion 91*a*, the distance between the engagement protrusion 72*a* and the center of the cam plate 90 is the maximum and constant, and the slide member 72 stops at a rearmost position. At this time, the arms 70 and the slide member 72 are apart from each other, and the pinch roller 33*b* is pressed against the drive roller 33*a* by the resilience of the torsion coil spring 71. Therefore, while the storage unit 5 stores no paper money, the relative distance between the pinch roller 33*b* and the drive roller 33*a* is minimized.

Further, when the engagement protrusion 72*a* moves in the intermediate portion 91*b* toward the large diameter portion 91*a*, the distance between the engagement protrusion 72*a* and the cam plate 90 gradually expands, and the slide member 72 moves backward. This way, the arms 70 rotates by the resilience of the torsion coil springs 71. This causes the spindle 36 and the pinch roller 33*b* to move toward right, and the relative distance between the pinch roller 33*b* and the drive roller 33*a* is reduced. While the storage unit 5 stores no paper money, the pinch roller 33*b* contacts the drive roller 33*a* when the engagement protrusion 72*a* moves to the vicinity of the small diameter portion 91*a*. Moving the engagement protrusion 72*a* further toward the small diameter portion 91*a* causes the slide member 72 to move away from the arm 70, and the pinch roller 33*b* is pressed against the drive roller 33*a* by the resilience of the torsion coil springs 71.

Further, when the engagement protrusion 72*a* moves in the intermediate portion 91*b* toward the small diameter portion 91*c*, the distance between the engagement protrusion 72*a* and the cam plate 90 gradually shortens, and the slide member 72 moves forward. This way, the arms 70 is pressed and rotated by the slide member 72. This causes the spindle 36 and the pinch roller 33*b* to move toward left, and the relative distance between the pinch roller 33*b* and the drive roller 33*a* is increased. As described, the rotation movement of the cam plate 90 is converted into the movement in the left/right directions of the spindle 36 and the pinch roller 33*b*.

The rear end part of the slide member 72 has a protrusion 72*b* extending backward, and the frame 10 is provided with a cam detection sensor 96 capable of detecting the leading end portion of the protrusion 72*b* (see FIG. 6). The cam detection sensor 96 is a transmissive photosensor, and is arranged so as to detect the protrusion 72*b* while the cam plate 90 is in the reference position, and not to detect the protrusion 72*b* while the cam plate 90 is not in the reference position. The cam plate 90 is driven and controlled, based on the detection result of the cam detection sensor 96.

Further, in the front end part of the lower arm 70 out of the two arms 70, there is provided an L-shaped protrusion 70*a* whose leading end extends forward. The frame 10 is provided with a thickness detection sensor 97 capable of detecting this protrusion 70*a* (see FIG. 5). The thickness detection sensor 97 is for monitoring whether or not the thickness of a stack of paper money in the storage unit 5 reached a predetermined value (e.g., the maximum thickness storable). The thickness detection sensor 97 is a transmissive photosensor, and is arranged so as to detect the protrusion 70*a* while the thickness of a stack of paper money pinched by the conveyance roller pair 33 is a predetermined value or more, and not to detect the protrusion 70*a* when the thickness is less than the predetermined value. The predetermined value of thickness is for example the thickness of a stack of approximately 50 pieces of paper money.

The following describes the operations of the conveyance roller pair 33 and the stack gate 31 in occasions of entering and collecting the paper money. First, an operation in an occasion of entering paper money is described. In the normal occasion (when paper money is entered), the cam plate 90 is arranged in the reference position, and the pinch roller 33*b* is in the standby position, as shown in FIG. 4. Further, the stack gate 31 is arranged in the import position, and the pressing plate 32 is pressed against the stacking part 37 by the torsion coil springs 41.

Figure 8A:
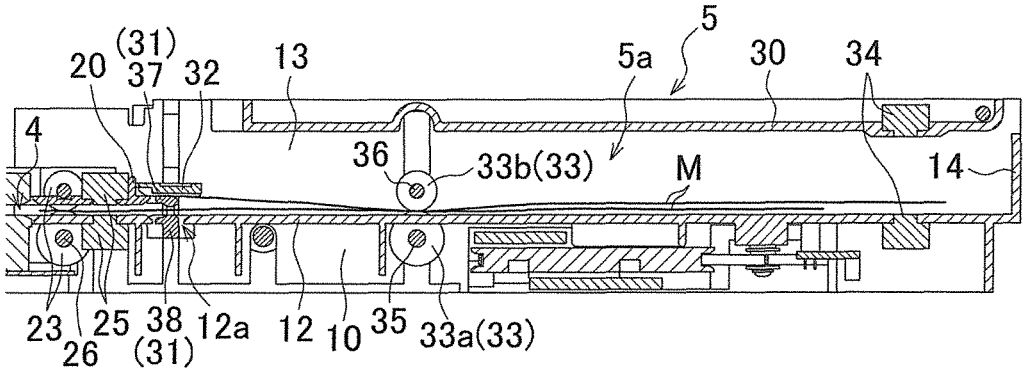
FIG. 8A is a cross sectional view for explaining an operation to cause paper money carried into the storage unit to be layered and stored in a storage unit.

The paper money M inserted into the insertion slot 2 is carried into the storage unit 5 through the import space 31*a*, by the insertion conveyance roller pairs 22 and 23. When the trailing end of the paper money M is conveyed to a position (escrow position) between the reader unit 21 and the second paper money detection sensor 25, by the insertion conveyance roller pairs 22 and 23, the conveyance is temporarily stopped and then the pinch roller 33*b* is driven toward the drive roller 33*a* to pinch the paper money between the conveyance roller pair 33 as shown in FIG. 8A, after which the drive roller 33*a* is rotated to convey the paper money M by the conveyance roller pair 33. At this time the pinching force by the conveyance roller pair 33 is set as follows according to the count of pieces of paper money in the storage unit 5, which is stored in a later-described RAM 103.

In cases where paper money M is conveyed to the storage unit 5 in the empty state, the engagement protrusion 72*a* of the slide member 72 engages with the large diameter portion 91*a*, and the pinch roller 33*b* is pressed against the drive roller 33*a* by the resilience of the torsion coil springs 71. In other words, the resilience of the torsion coil springs 71 serve as the pinching force of the conveyance roller pair 33 for pinching the paper money. The pinching force of the conveyance roller pair 33 for pinching the paper money, when the engagement protrusion 72*a* engages with the large diameter portion 91*a* is Fa.

In cases where the paper money M is conveyed to the storage unit 5 already storing paper money M, the engagement protrusion 72*a* of the slide member 72 engages with an intermediate portion 91*b* according to the number of pieces of paper money stored in the storage unit 5, and the pinching force of the conveyance roller pair 33 for pinching the paper money is set to a pinching force Fb which is smaller than the above mentioned pinching force Fa by a certain amount. The relative distance between the pinch roller 33*b* and the drive roller 33*a* at this time varies depending on the number of pieces of paper money stored in the storage unit 5. The value of the pinching force Fb is such that, while the drive roller 33*a* is rotated, the drive roller 33*a* is able to convey a piece of paper money M to be carried into the storage unit 5, without moving the already stored paper money M (i.e., without rotating the pinch roller 33*b*). In this case, the friction force between the drive roller 33*a* and the paper money is greater than the friction force between a piece of paper money conveyed and the adjacent piece of paper money. This way, a piece of paper money carried into the storage unit 5 is further layered on top of pieces of paper money already stored and layered in the storage unit 5, while maintaining the layers of already stored pieces of paper money.

Figure 8B:
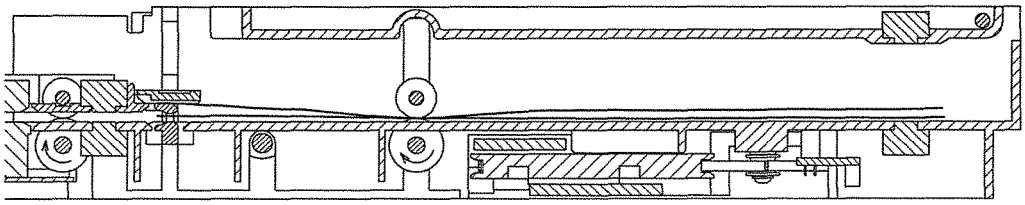
FIG. 8B is a cross sectional view for explaining an operation to cause paper money carried into the storage unit to be layered and stored in a storage unit.

As shown in FIG. 8B, the conveyance stops when the paper money M is conveyed by the conveyance roller pair 33 to a position such that the trailing end of the paper money M faces the stacking part 37. In cases where the paper money M is conveyed to the storage unit 5 already storing some paper money M, the cam plate 90 is driven and rotated so that the engagement protrusion 72*a* of the slide member 72 is positioned to engage with the large diameter portion 91*a*, the pinch roller 33*b* is pressed against the drive roller 33*a* by the resilience of the torsion coil springs 71, and the pinching force of the conveyance roller pair 33 for pinching the paper money varies to pinching force Fa. The relative distance between the pinch roller 33*b* and the drive roller 33*a* at this time varies depending on the thickness of the stack of the paper money stored in the storage unit 5. Further, since the twist angle of each torsion coil spring 71 varies depending on the thickness of the stack of paper money stored in the storage unit 5, the pinching force Fa of the conveyance roller pair 33 varies depending on the thickness of the stack of paper money stored in the storage unit 5.

Figure 8C:
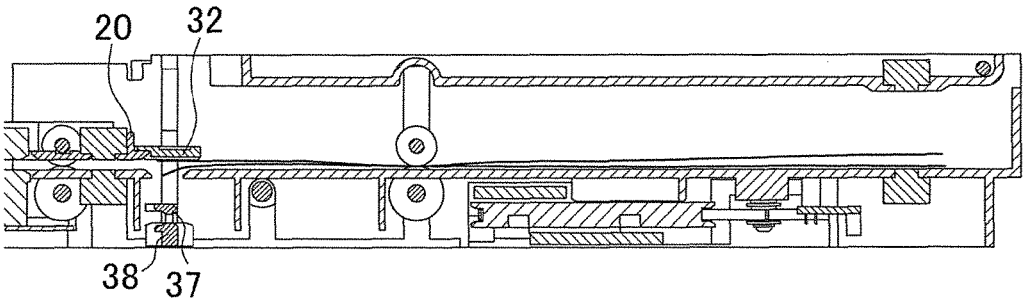
FIG. 8C is a cross sectional view for explaining an operation to cause paper money carried into the storage unit to be layered and stored in a storage unit.

Subsequently, the stack gate 31 is driven from the import position to the stack position as shown in FIG. 8C. Once the pressing plate 32 reaches the position to contact the upper guide 20 by the biasing force of the torsion coil springs 41, it does not move any further in the right direction. Therefore, the pressing plate 32 and the stacking part 37 separate from each other. The trailing end part of the paper money M carried in therefore move from the space between the stacking part 37 and the guide 38 to the space between the stacking part 37 and the pressing plate 32, over the stacking part 37.

Figure 8D:
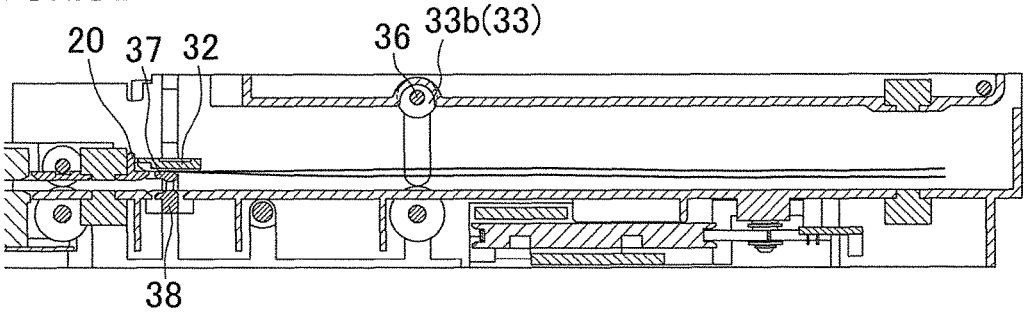
FIG. 8D is a cross sectional view for explaining an operation to cause paper money carried into the storage unit to be layered and stored in a storage unit.

Then, the stack gate 31 returns from the stack position to the import position as shown in FIG. 8D. By performing the above sequence of operations every time the paper money M is carried into the storage unit 5, pieces of paper money M are placed on one other (layered and stored) in the thickness direction between the stacking part 37 and the pressing plate 32.

As described hereinabove, in the present embodiment, the stacking part 37 extending in a direction perpendicular to the conveyance direction of the paper money emerges and sinks with respect to the storage space 5*a*. This moves the trailing end part of the paper money, which is in a position to face the stacking part 37 to move over to the storage space 5*a*, thereby having the paper money layered and stored in the storage space 5. Thus, pieces of paper money layered and stored have their trailing end parts aligned, even if the paper money carried into the storage unit 5 is off the normal position relative to the width direction.

Further, in the operation of emerging and sinking the stacking part 37 with respect to the storage space 5*a*, the paper money is pinched by the conveyance roller pair 33 with the pinching force Fa. Therefore, the piece of the paper money carried in and the pieces of already stored paper money are maintained with their trailing end parts aligned. Further, the chamfered shapes of the rear ends of the both left and right sides of the stacking part 37 facilitate the trailing end part of the paper money carried in to smoothly move over the stacking part 37, when the stacking part 37 is emerged or sunk.

With the stacking part 37 arranged in a position that ensures an import space 31*a* while the paper money is carried into the storage unit 5, it is possible to prevent the already stored paper money M in the storage unit 5 from disturbing the carriage of the paper money. Further, since the guide 38 is arranged in a position that closes the hole 12*a* while the paper money is carried into the storage unit 5, it is possible to prevent paper jam caused by, for example, an edge of the paper money being caught on the hole 12*a*.

Further, the front and rear edges of the hole 12*a* and the front and rear ends of the guide 38 are all formed in regular rectangular pulse shapes that engage with each other, and the rear end of the upper guide 20 and the front end of the stacking part 37 are formed in regular rectangular pulse shapes that engage with each other. This contributes to prevention of paper jam, by preventing an edge of the paper money carried into the storage unit 5 from being caught on the edge of the hole 12*a*, the rear end of the upper guide 20, and the stack gate 31.

Next, the following describes the operations of the conveyance roller pair 33 and the stack gate 31 in occasions of collecting the paper money. When a plurality of pieces of paper money M layered and stored in the storage unit 5 are to be collected from the insertion slot 2, the stack gate 31 is first driven from the import position to the export position as shown in FIG. 9A and FIG. 9B, the cam plate 90 is driven and rotated to bring the engagement protrusion 72*a* of the slide member 72 to a position to engage with the large diameter portion 91*a*, and the pinch roller 33*b* is pressed against the drive roller 33*a* by the resilience of the torsion coil springs 71, thereby setting the pinching force of the conveyance roller pair 33 for pinching the paper money to the pinching force Fa. As hereinabove mentioned, the pinching force Fa is dependent on the twist angles of the torsion coil springs 71, and on the thickness of the stack of paper money stored in the storage unit 5. Further, the relative distance between the pinch roller 33*b* and the drive roller 33*a* varies depending on the thickness of the stack of the paper money stored in the storage unit 5.

Then, as shown in FIG. 9C, the drive roller 33*a* is driven to rotate in a direction opposite to the direction in cases of inserting the paper money, thereby conveying the paper money M pinched by the conveyance roller pair 33 toward the insertion slot 2. At this time the pinch roller 33*b* is also rotated by the paper money conveyed, and the friction force between the conveyance roller pair 33 and the paper money is smaller than the friction force among the pieces of paper money. Therefore, the pieces of paper money are pinched and conveyed by the conveyance roller pair 33 without any piece slipping off from the rest. Consequently, the efficiency of collecting the paper money is improved.

As hereinabove described, the space between the insertion slot 2 and the conveyance roller pair 33 is set shorter than the length of the paper money relative to the conveyance direction, the conveyance roller pair 33 is capable of conveying the paper money stored in the storage unit 5 to a position where the paper money sticks out from the insertion slot 2.

Further, the front edge of the hole 12*a* and the front end of the stacking part 37 are formed in regular rectangular pulse shapes that engage with each other. This contributes to prevention of paper jam, by preventing an edge of the paper money from being caught on the edge of the hole 12*a* and the stack gate 37, at the time of collecting the paper money.

It should be noted that, although it is preferable to reduce the number of pieces of paper money that can be stored in the storage unit 5 in terms of reducing the thickness (left/right directional width) of the device 1, reducing the number of pieces of paper money that can be stored in the storage unit 5 may cause the number of pieces of paper money in the storage unit 5 to reach the maximum number more frequently, and as such, the work of collecting the paper money needs to be carried out more frequently during the open hours. Therefore, to efficiently collect the paper money in a short period, the thickness of the device 1 preferably has a thickness of a certain extent. This way, there is no need for interrupting games on gaming machines 201 by collecting the paper money, or even if the games are interrupted, the period of interruption is shortened.

(Expansion Mechanism 8)

The expansion mechanism 8 is for driving the upper guide 20 in the left/right directions. The expansion mechanism 8 is jointed to the cam plate 90, and its operation is driven by a cam driving motor 94. The expansion mechanism 8 includes: two arms 80 jointed to upper and lower end portions of the upper guide 20; two joining members 81; two torsion coil springs 82; and a slide member 83 (see FIG. 13).

The two arms 80 are arranged on the upper and lower sides of the upper/lower walls 13. Each of the arms 80 is formed substantially in an L-shape, when viewed in the left/right direction. At a portion in the vicinity of the corner of the L-shape, the arm 80 is rotatably jointed to a shaft 19 provided to the frame 10. One end portion of the L-shaped arm 80 is rotatably jointed to the upper guide 20, and the other end portion is rotatably jointed to the front end part of the joining member 81. The joining members 81 are each mounted to the guide shaft 18 and are movable along the guide shaft 18.

The slide member 83 is arranged on the backward of the joining member 81. Through the upper and lower ends of the slide member 83 are penetrated guide shafts 18. The slide member 83 moves in the front/back directions along the guide shafts 18. The both end portions of each torsion coil spring 82 is jointed to the joining member 81 and the slide member 83. The joining members 81 are biased toward the slide member 83 by the torsion coil springs 82.

Figure 14B:
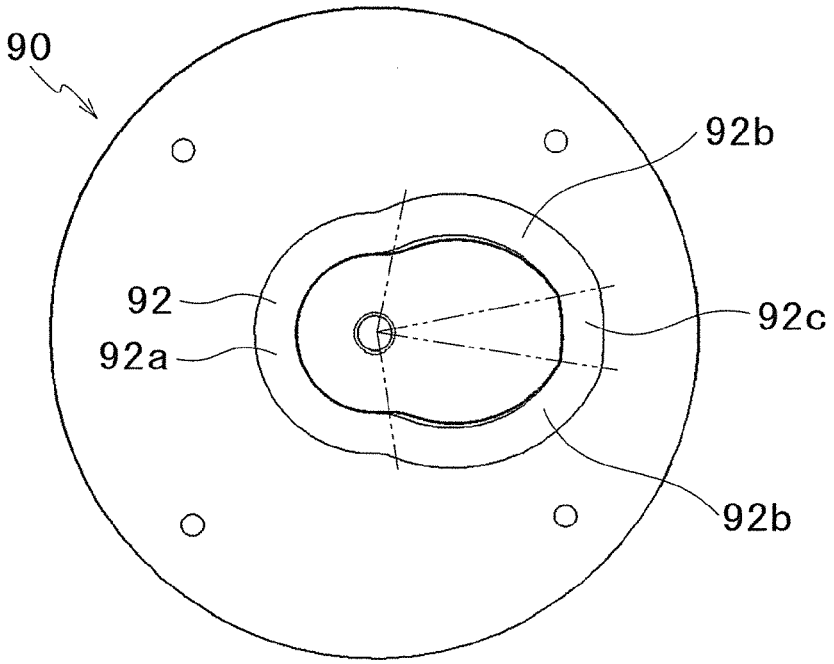
FIG. 14B shows the other side of the cam plate.

The slide member 83 is arranged between the cam plate 90 and the wall part 12, and has an engagement protrusion 83*a* formed in a middle portion of its right surface (the surface facing the cam plate 90) relative to the upward/downward direction. The engagement protrusion 83*a* is engaged with a second cam groove A92 formed on the left surface of the cam plate 90. As shown in FIG. 14B, the second cam groove A92 is formed in an annular shape which includes: a small diameter portion 92*a* with a constant diameter; two intermediate portions 92*b* jointed on both sides of the small diameter portion 92*a*, whose respective diameters vary continuously; and a large diameter portion 92*c* with a constant diameter which is larger than the diameter of the small diameter portion 92*a*. The angle of the small diameter portion 92*a* is 200 degrees, the angle of each of the two intermediate portions 92*b* is 70 degrees, and the angle of the large diameter portion 92*c* is 20 degrees. The large diameter portion 92*c* of the second cam groove A92 is provided on the back surface of the first cam groove A91, in a position shifted by 180 degrees from the small diameter portion 91*c* of the first cam groove A91. It should be noted that the angles of the groove portions 92*a* to 92*c* are not limited to those described above.

The engagement protrusion 83*a* of the slide member 83 is engaged with a portion of the second cam groove A92 which is on the front side of the center of the cam plate 90, and at the same height as the center of the cam plate 90 relative to the upward/downward direction.

Figure 15B:
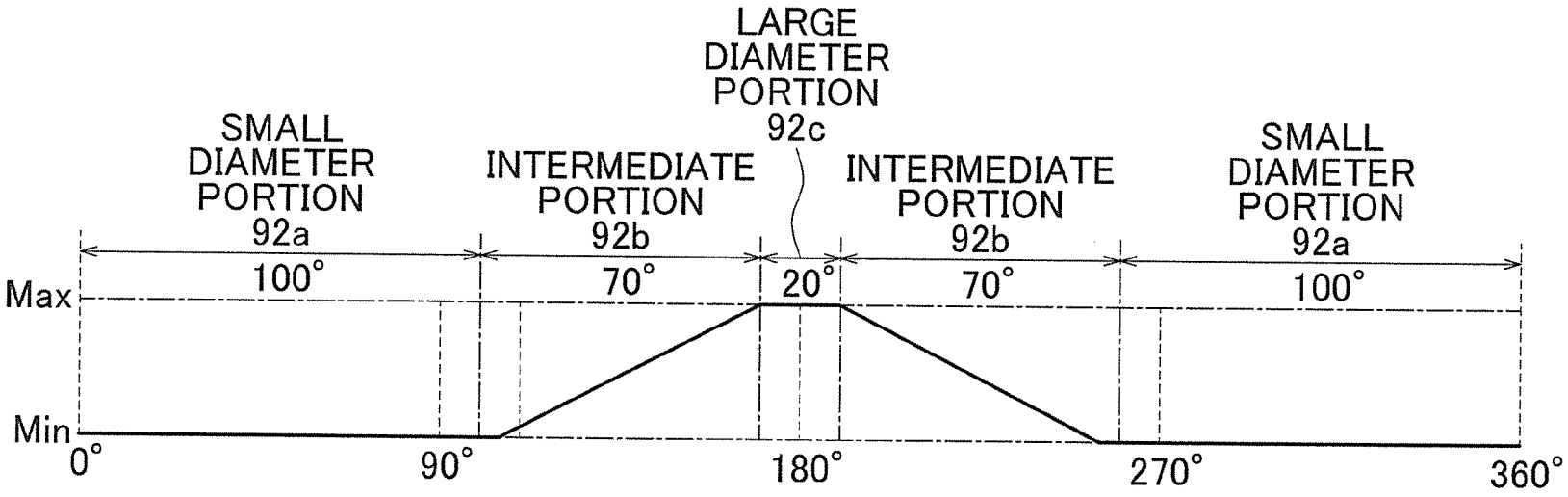
FIG. 15B is an explanatory diagram showing the relationship between the position of the engagement protrusion in a second cam groove and the aperture width of a conveyance path.

When the cam plate 90 rotates and the engagement protrusion 83*a* moves in the small diameter portion 92*a*, the distance between the engagement protrusion 83*a* and the center of the cam plate 90 is the minimum and constant, and the slide member 83 stops at a rearmost position. The upper guide 20 is in the rightmost position, and the aperture width of the conveyance path 4 (and the insertion slot 2) is the minimum as shown in FIG. 15B. At this time, the joining members 81 and the slide member 83 are apart from each other, and the pinch roller 23*b* is pressed against the drive roller 23*a* by the resilience of the expanded torsion coil springs 82. It should be noted that FIG. 15B is a graph indicating the relation between the position of the engagement protrusion 83*a* in the second cam groove A92, and the aperture width of the conveyance path 4. The horizontal axis represents the angle of the second cam groove A92, with the middle portion of the small diameter portion 92*a* relative to its circumference as the reference.

Further, when the engagement protrusion 83*a* moves in the large diameter portion 92*c*, the distance between the engagement protrusion 83*a* and the center of the cam plate 90 is the maximum and constant, and the slide member 83 stops at a foremost position. The upper guide 20 is in the leftmost position, and the aperture width of the conveyance path 4 (and the insertion slot 2) is the maximum.

Further, when the engagement protrusion 83*a* moves in the intermediate portion 92*b* toward the large diameter portion 92*c*, the distance between the engagement protrusion 83*a* and the cam plate 90 gradually expands, and the slide member 83 moves forward. This way, the joining members 81 are pressed foreword by the slide member 83, thus rotating the arms 80. This causes the upper guide 20 to move toward left, and the aperture width of the conveyance path 4 (and the insertion slot 2) is increased.

Further, when the engagement protrusion 83*a* moves in the intermediate portion 92*b* toward the small diameter portion 92*a*, the distance between the engagement protrusion 83*a* and the cam plate 90 gradually shortens, and the slide member 83 moves backward. This way, the joining members 81 move backward together with the slide member 83 by the resilience of the torsion coil springs 82, thus rotating the arms 80. This causes the upper guide 20 to move toward right, and the aperture width of the conveyance path 4 (and the insertion slot 2) is reduced. The pinch roller 23*b* contacts the drive roller 23*a* when the engagement protrusion 83*a* moves to the vicinity of the small diameter portion 92*a*. Moving the engagement protrusion 83*a* further toward the small diameter portion 92*a* causes the slide member 83 to move against the torsion coil springs 82, and separate from the joining members 81, and the pinch roller 23*b* is pressed against the drive roller 23*a* by the resilience of the expanded torsion coil springs 82. As described, the rotation movement of the cam plate 90 is converted into the movement in the left/right directions of the upper guide 20.

When the engagement protrusion 72*a* of the change mechanism 7 engages with the small diameter portion 91*c*, the engagement protrusion 83*a* of the expansion mechanism 8 engages with the middle portion of the small diameter portion 92*a* relative to its circumference. Therefore, it is possible to keep the maximum relative distance between the pinch roller 33*b* and the drive roller 33*a*, while keeping the minimum aperture width of the conveyance path 4 (and the insertion slot 2).

When the engagement protrusion 72*a* of the change mechanism 7 moves along the intermediate portions 91*b*, varying the relative distance between the pinch roller 33*b* and the drive roller 33*a*, the engagement protrusion 83*a* of the expansion mechanism 8 engages with the small diameter portion 92*a*, and the aperture width of the conveyance path 4 stays minimum. Therefore, after the paper money is conveyed to the storage unit 5 by the insertion conveyance roller pairs 22 and 23, it is possible to move the pinch roller 33*b* toward the drive roller 33*a* to pinch the paper money by the conveyance roller pair 33, while maintaining the minimum aperture width of the conveyance path 4.

Further, when the engagement protrusion 83*a* of the expansion mechanism 8 engages with the intermediate portions 92*b* and the large diameter portion 92*c*, the engagement protrusion 72*a* of the change mechanism 7 engages with the middle portion of the large diameter portion 91*a* relative to its circumference. Therefore, when the paper money in the storage unit 5 is to be collected from the insertion slot 2, it is possible to move the pinch roller 33*b* toward the drive roller 33*a* to pinch the paper money by the conveyance roller pair 33, while maintaining the maximum aperture width of the conveyance path 4.

In the present embodiment, the expansion mechanism 8 and the change mechanism 7 are joined by a single cam plate 90. This way, the expansion mechanism 8 and the change mechanism 7 are operated to drive the upper guide 20 and the pinch roller 33*b* by a single cam driving motor 94. Therefore, the costs for the device are reduced as compared with a case of driving the upper guide 20 and the pinch roller 33*b* by separate motors.

Further, by adopting a cam mechanism capable of converting the movement directions, the upper guide 20 and the pinch roller 33*b* are driven in the left/right directions (thickness directions of the paper money) by rotating the cam driving motor 94. This contributes to reduction of the thickness of the device (the width of the device relative to its thickness) as compared with a case of driving the upper guide 20 and the pinch roller 33*b* by using a drive source (e.g., electric pusher) for driving in the thickness directions of the paper money. Further, the above structure is made simple and contributes to downsizing of the device as compared with a case of adopting a rack and pinion for driving the upper guide 20 and the pinch roller 33*b*.

Further, the first cam groove A91 and the second cam groove A92 of the cam plate 90 are formed in shapes such that an operation of the expansion mechanism 8 to change the aperture width of the conveyance path 4 and the insertion slot 2 and an operation of the change mechanism 7 to change the relative distance between the pinch roller 33*b* and the drive roller 33*a* are not performed at the same time. This reduces the load of the cam driving motor 94 and reduces the chances of breakdown.

(Control Circuit Board 100)

Figure 16:
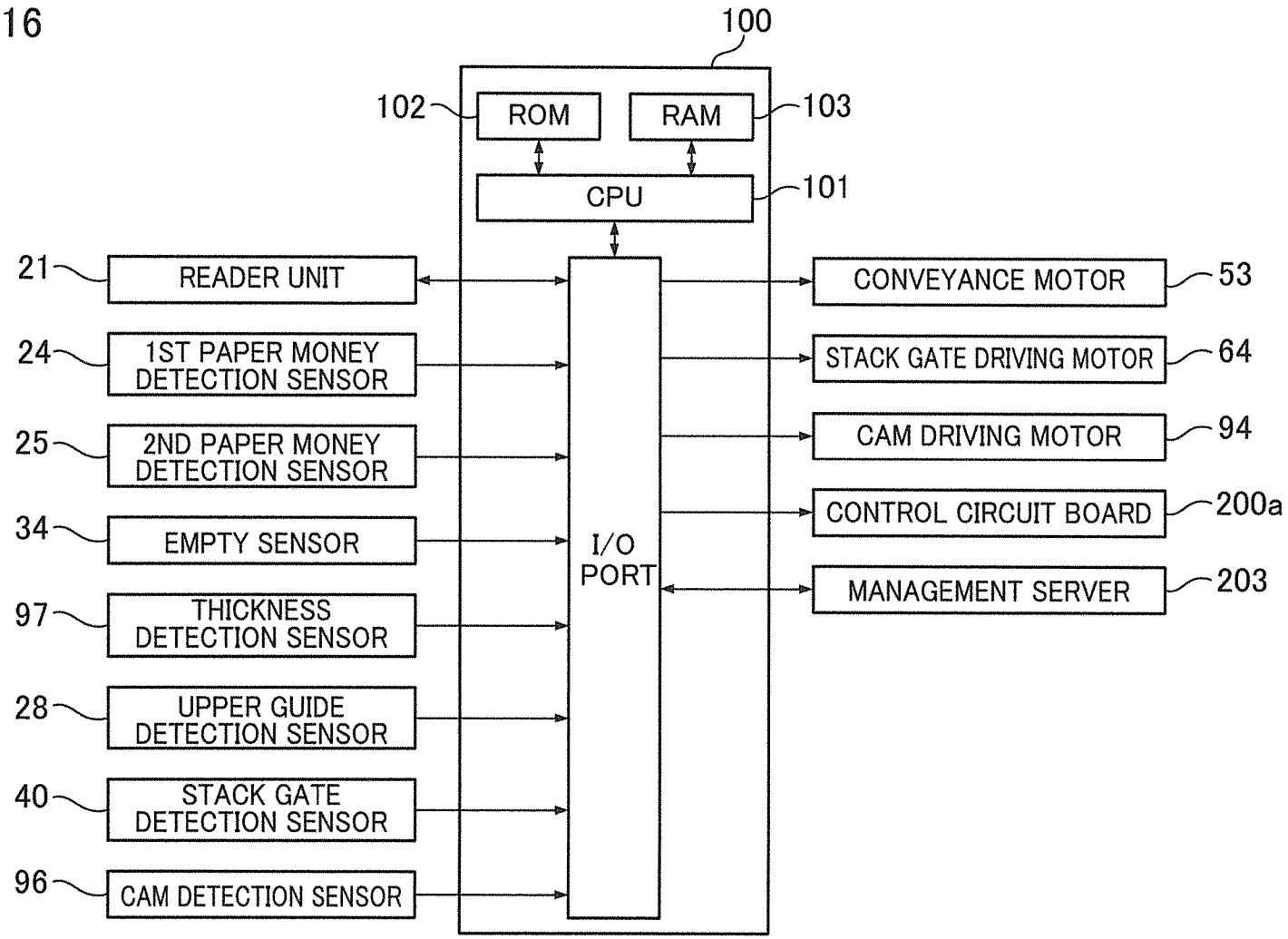
FIG. 16 is a control block diagram of the paper money processing device.

FIG. 16 is a control block diagram of the paper money processing device 1. As shown in FIG. 16, the paper money processing device 1 includes a control circuit board 100 configured to control operations of drive devices. The control circuit board 100 has thereon a CPU (Central Processing Unit) 101, a ROM (Read Only Memory) 102, and a RAM (Random Access Memory) 103.

The ROM 102 stores therein an actuation program for various drive devices such as a conveyance motor 53, a stack gate motor 64, and a cam driving motor 94; various programs such as a verification program; and permanent data such as reference data used in verification process. The reference data is obtained from the entire area of the genuine note, and contains for example tone data related to transmitted light and reflected light when infrared or visible light is applied to the paper money. It should be noted that the reference data is stored in the ROM 102 in the present embodiment; however, the reference data may be stored in a storage only for the reference data.

The CPU 101 generates control signals according to the actuation program stored in the ROM 102, executes input and output of signals among the above mentioned various drive devices via I/O ports 104, thereby controlling the various drive devices. More specifically, the CPU 101 is connected to the conveyance motor 53, the stack gate motor 64, and the cam driving motor 94 via the I/O ports 104. Operations of these drive devices are controlled by control signals from the CPU 101, which are generated according to the actuation program stored in the ROM 102.

Further, the CPU 101 is configured to receive, via the I/O ports 104, detection signals from various sensors such as the first paper money detection sensor 24, the second paper money detection sensor 25, the empty sensor 34, the stack gate detection sensor 40, and the cam detection sensor 96, and the above-mentioned various drive devices are controlled based on the detection signals.

Specifically, controls based on the detection signals from the stack gate detection sensor 40 means to drive the stack gate motor 64 a predetermined number of steps from the point where the stack gate detection sensor 40 detects the protrusion 39*a* so as to move the stack gate 31 from the import position to the export position or to the stack position; and to drive the stack gate motor 64 until the protrusion 39*a* is detected by the stack gate detection sensor 40 so as to bring back the stack gate 31 to the import position.

Specifically, controls based on the detection signals from the cam detection sensor 96 means to drive the cam driving motor 94 a predetermined number of steps from the point where the cam detection sensor 96 detects the protrusion 72*b* so as to rotate the cam plate 90 by a predetermined angle from the reference position; and to drive the cam driving motor 94 until the protrusion 72*b* is detected by the cam detection sensor 94 so as to bring back the cam plate 90 to the reference position.

Further, the CPU 101 is connected to the reader unit 21 via the I/O port 104, and the data read by the reader unit 21 is compared with the reference data stored in the ROM 102 for verification of the paper money.

The RAM 103 stores data and programs for use in operations by the CPU 101, and has a function of storing the number of pieces of paper money stored in the storage unit 5.

Further, the CPU 101 is connected to a control circuit 200*a* of the gaming media lending device 200 having the gaming media lending device 200, and to a management server 203 configured to control in bundle many gaming machines 201 and the gaming media lending device 200, and is configured to transmit information such as the amount or the number of pieces of the paper money.

When the upper guide detection sensor 28 detects an unauthorized movement, the CPU 101 transmits an unauthorized movement detection signal to the management server 203 and the control circuit 200*a* of the gaming media lending device 200.

Further, when the thickness of the stack of paper money detected by the thickness detection sensor 97 reaches a predetermined value, the CPU 101 transmits a filled-up signal to the management server 203 and the control circuit 200*a* of the gaming media lending device 200. The control circuit 200*a* of the gaming media lending device 200 having received the filled-up signal notifies of the filled-up state via a display device or an audio device mounted in the gaming media lending device 200.

Further, a manager of the management server 203 is able to transmit a paper money collection signal instructing collection of paper money stored in the storage unit 5, from the management server 203 to the paper money processing device 1 by operating the management server 203. It should be noted that the paper money collection signal is transmitted in cases where the filled-up signal is transmitted to the management server 203 and the manager collects the paper money, and in cases of collecting paper money from all the paper money processing devices 1 after the open hours of the gaming facility.

(Process Operation when Paper Money is Entered)

The following describes processing operation of the paper money processing device 1 when the paper money is entered, with reference to flowcharts of FIG. 17 to FIG. 20.

When an operator inserts paper money M into the insertion slot 2, the aperture width of the conveyance path 4 and that of the insertion slot 2 are minimum. The pinch roller 33*b* is in the standby position, and the stack gate 31 is in the import position.

Figure 17:
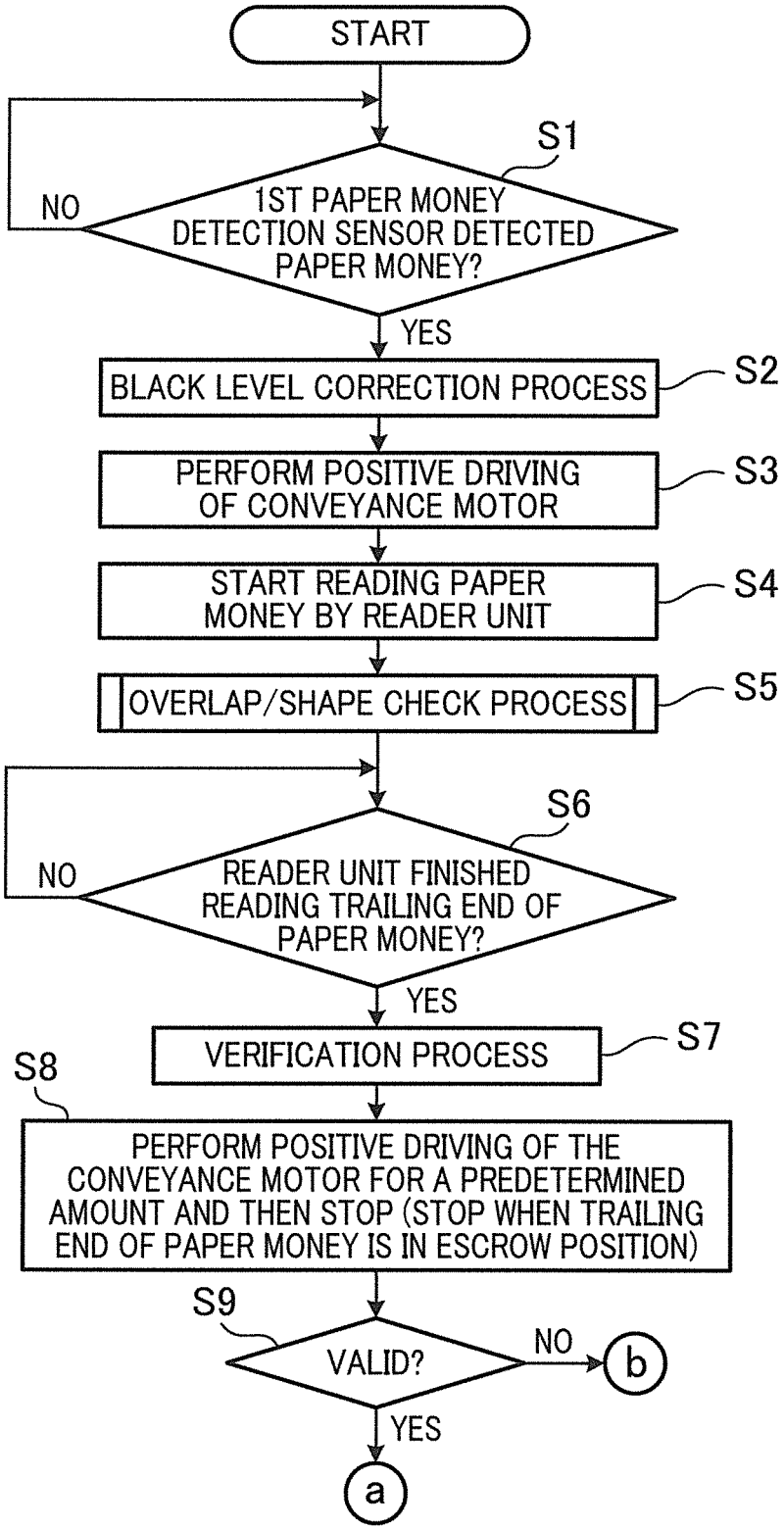
FIG. 17 is a flowchart showing processes up to the verification when paper money is inserted.

As shown in the flowchart of FIG. 17, when the paper money M is inserted into the insertion slot 2, and the paper money M is detected by the first paper money detection sensor 24 (step S1: Yes), a black level correction process is started (step S2). The black level correction process is a process to set (correct) the reference value of the lowest brightness, by obtaining detection signals from the light receiver of the reader unit 21, while lighting states of the light emitter for reflection of light and the light emitter 21*b* for transmission of light receiver are turned off. It should be noted that the black level correction process is completed before the start of a later-described reading process by the reader unit 21 with respect to the paper money.

Further, the conveyance motor 53 is driven forward (step S3) to convey the inserted paper money M to the storage unit 5 by the insertion conveyance roller pairs 22 and 23. The reading process for the paper money is started when the paper money M conveyed passes the reader unit 21 (step S4), and an overlap/shape check process is executed (step S5).

Figure 18:
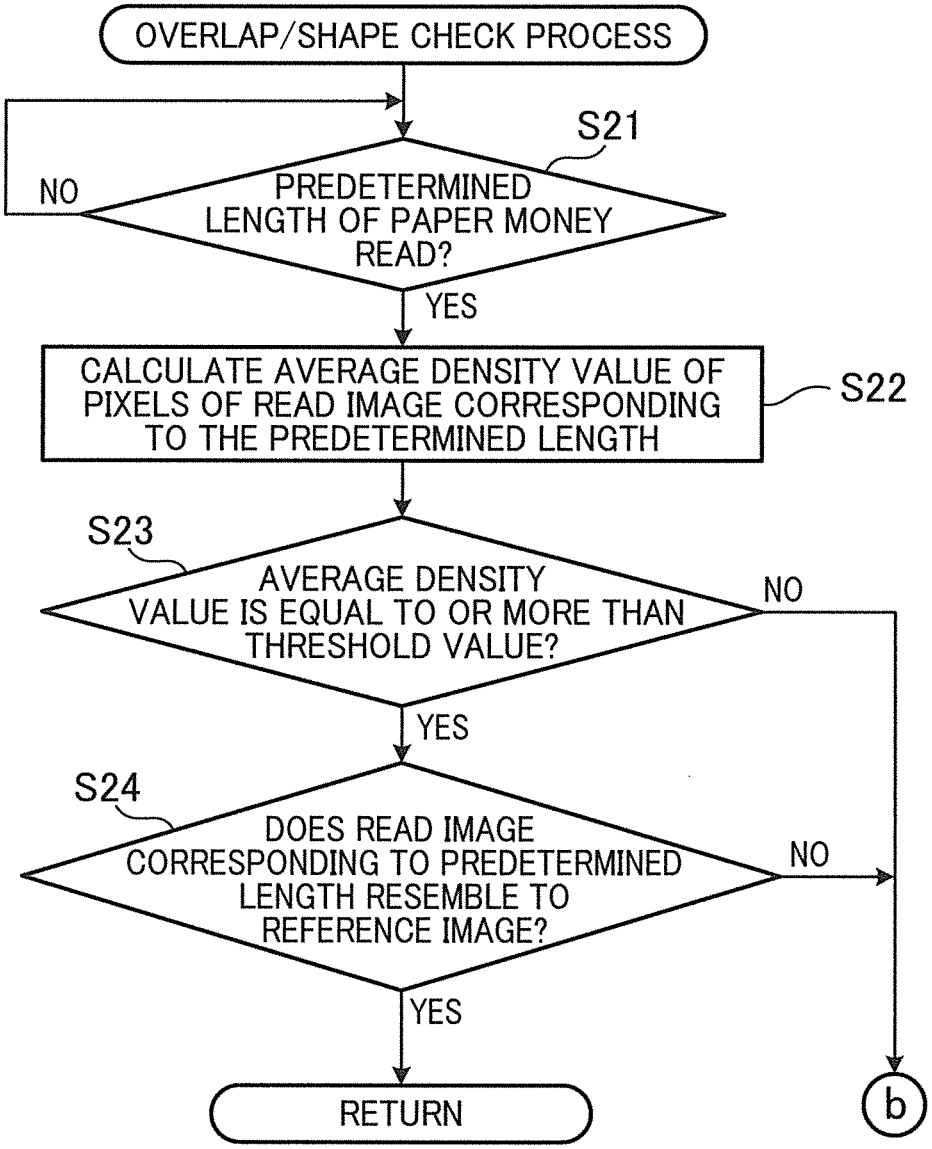
FIG. 18 is a flowchart showing an overlap/shape check process.
Figure 19:
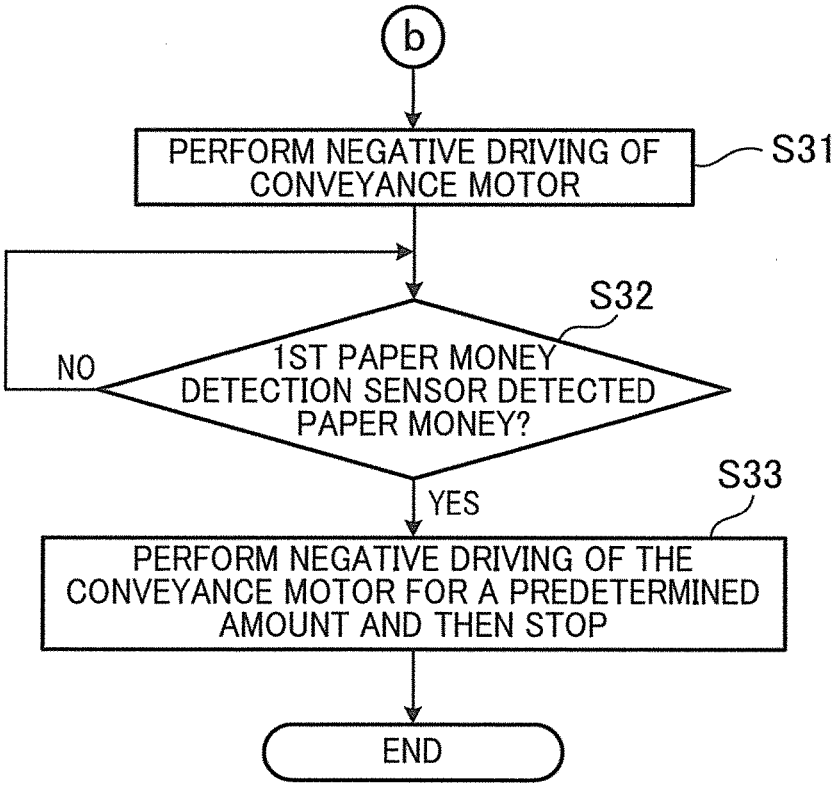
FIG. 19 is a flowchart showing a process of returning the inserted paper money.

In the overlap/shape check process, the reader unit 21 reads a predetermined length of the paper money (step S21: Yes), and an average density value of the pixels of the image read is calculated (step S22), and then whether or not this average density value is equal to a threshold value (reference data) stored in the ROM 102 is determined (step S23), as shown in the flowchart of FIG. 18.

When the average density value calculated is less than the threshold value (step S23: No), it is determined that there is an overlapped portion in the paper money inserted (i.e., a plurality of pieces of paper money are overlapped, or a leading end of the paper money is folded over). In this case, the conveyance motor 53 is driven backward (step S31) to take the paper money back to the insertion slot 2, as described in the flowchart of in FIG. 19. More specifically, the conveyance motor 53 is driven backward for a predetermined amount from the time point of detecting, by the first paper money detection sensor 24, the leading end of the paper money (step S32: Yes, step S33) so that the paper money is partially ejected from the insertion slot 2.

Further, when the average density value calculated is equal to or more than the threshold value (step S23: Yes), the shape of the read image of the predetermined length of the paper money is compared with a reference image stored in the ROM 102. When the images do not resemble to each other (step S24: No), it is determined that the paper money has a torn part and the like, and the conveyance motor 53 is driven backward to immediately eject that paper money from the insertion slot 2 (step S31 to step S33).

Further, when the shape of the read image is determined as to resemble to the reference image (step S24: Yes), the reading process for the paper money is continued. When the reader unit 21 finishes reading the trailing end of the paper money (step S6: Yes), the verification process is started (step S7). Then, the conveyance motor 53 is driven a predetermined amount after the reader unit 21 finishes reading the trailing end of the paper money so as to stop the trailing end of the paper money at a position (escrow position) between the reader unit 21 and the second paper money detection sensor 25 (step S8).

Further, when the paper money is determined as not to be a genuine note as the result of the verification process (step S9: No), the conveyance motor 53 is driven backward to immediately eject the paper money from the insertion slot 2 (step S31 to step S33).

Figure 20:
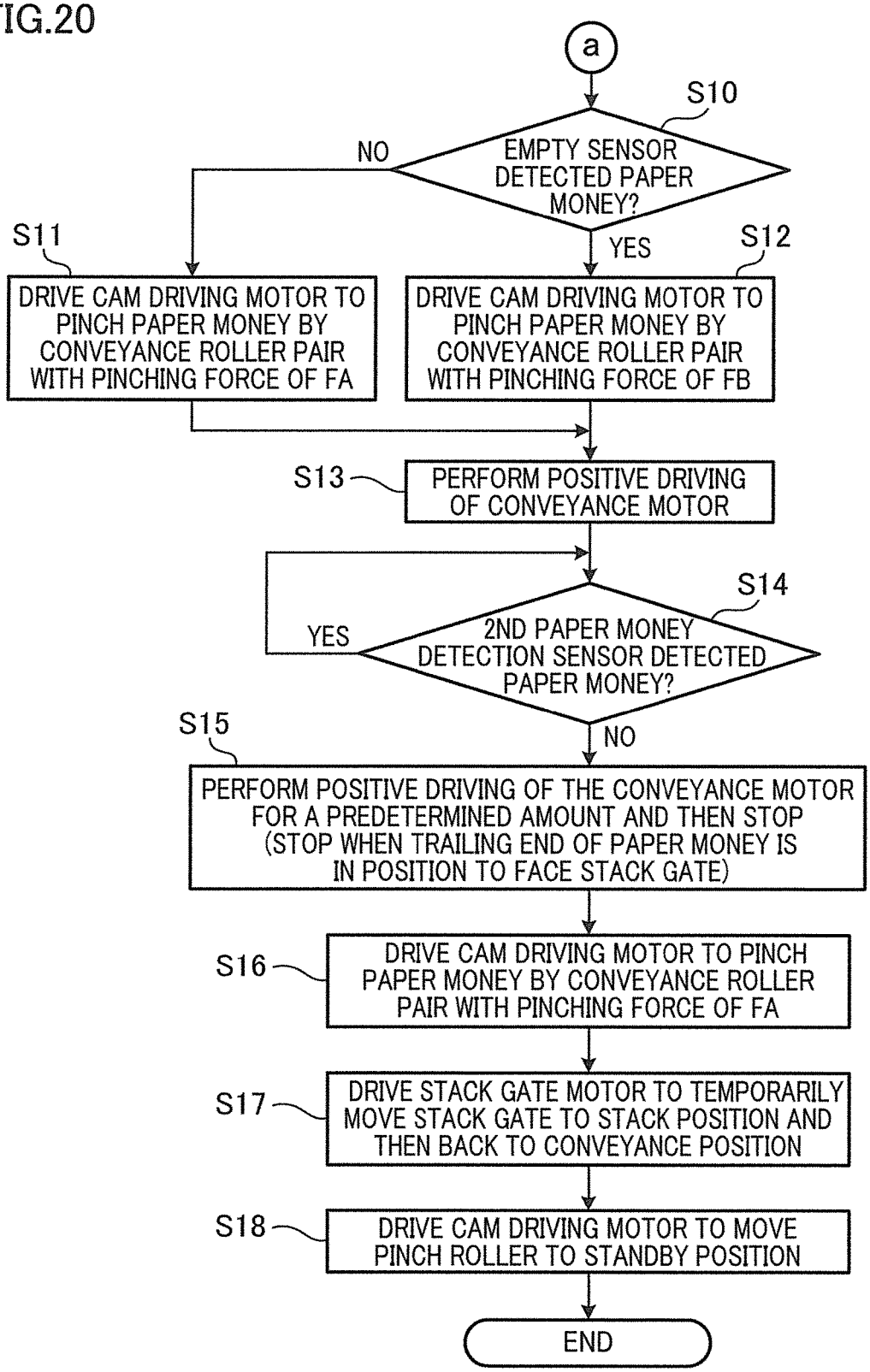
FIG. 20 is a flowchart showing a process of causing a valid paper money to be layered and stored in the storage unit.

When the paper money M is determined as to be a genuine note as the result of the verification process (step S9: Yes), and when the empty sensor 34 does not detect paper money (step S10: No) as shown in the flowchart of FIG. 20, the cam driving motor 94 is driven to have the engagement protrusion 72*a* of the slide member 72 with the large diameter portion 91*a* of the cam plate 90, thereby moving the pinch roller 33*b* toward the drive roller 33*a* to pinch a piece of paper money by the conveyance roller pair 33 with the pinching force Fa (step S11).

When the paper money M is determined as to be a genuine note as the result of the verification process (step S9: Yes), and when the empty sensor 34 detects paper money (step S10: Yes), the cam driving motor 94 is driven according to the number of pieces of the paper money stored in the RAM 103 to have the engagement protrusion 72*a* of the slide member 72 with the intermediate portion 91*b* of the cam plate 90, thereby moving the pinch roller 33*b* toward the drive roller 33*a* to pinch the paper money by the conveyance roller pair 33 with the pinching force Fb (step S12).

After the step S11 and step S12, the conveyance motor 53 is driven in the normal direction (step S13). Then, the conveyance motor 53 is driven forward for a predetermined amount from the time point where the paper money is not detected by the second paper money detection sensor 25, so as to stop the trailing end of the conveyed paper money carried in at a position to face the stacking part 37 (step S14: Yes, step S15).

Then, the cam driving motor 94 is driven to have the engagement protrusion 72*a* of the slide member 72 with the large diameter portion 91*a* of the cam plate 90, thereby driving the pinch roller 33*b* to pinch the paper money by the conveyance roller pair 33 with the pinching force Fa (step S16). It should be noted that, when the paper money is not detected in the above step S10, the cam driving motor 94 stays stopped.

Next, the stack gate motor 64 is driven to temporarily move the stack gate 31 to the stack position, the trailing end part of the conveyed paper money carried in is moved in between the stacking part 37 and the pressing plate 32, and then the stack gate 31 is moved back to the import position (step S17). This way, the trailing end part of the paper money moves to the space between the stacking part 37 and the pressing plate 32, over the stacking part 37. Then, the cam driving motor 94 is driven to move the pinch roller 33*b* away from the drive roller 33*a* and bring it back to the standby position (step S18). It should be noted that the number of pieces of paper money stored in the RAM 103 is updated when the stack gate 31 returns to the import position.

In the above step S12, if the thickness of the stack of paper money pinched by the conveyance roller pair 33 is determined as to have reached the predetermined value, based on the detection by the thickness detection sensor 97, the filled-up signal is transmitted from the paper money processing device 1 to the management server 203 and the control circuit 200*a* of the gaming media lending device 200*a* for the purpose of notifying the need of collecting the paper money. Further, after the thickness of the stack of paper money reaches the predetermined value, the above described processing operation at the time of entering the paper money is not performed even if paper money is inserted into the insertion slot 2. As such, by managing the timing of collection work according to the thickness of a stack of paper money in the storage unit 5, it is possible to achieve more stable and highly reliable management of timings for collecting paper money, without being affected by the state of the paper money (i.e., wrinkles and the like), as compared with a management based on the number of pieces of paper money stored in RAM 103.

(Processing Operation when Collecting Paper Money)

Figure 21:
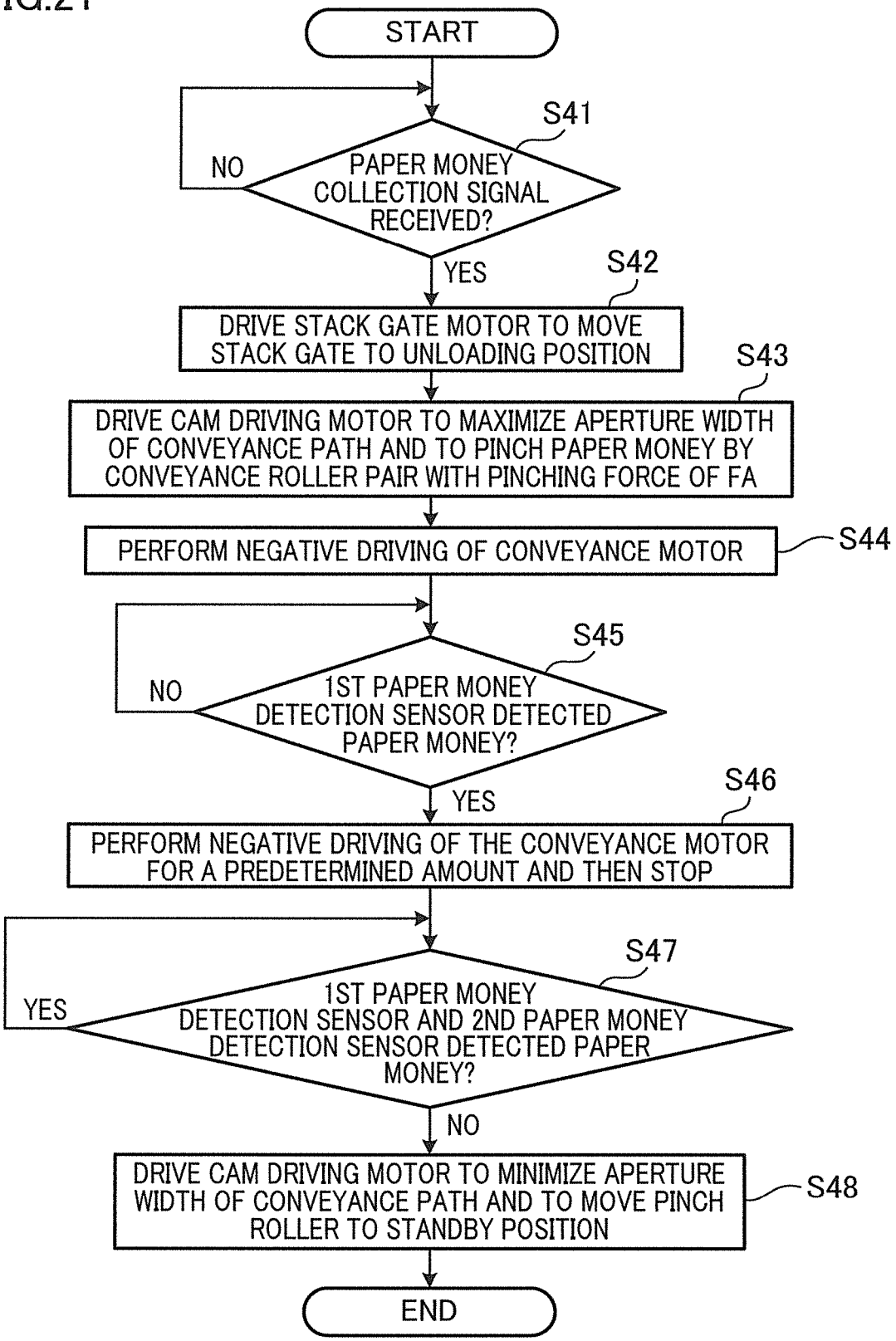
FIG. 21 is a flowchart showing a process of collecting the paper money stored in the storage unit, through the insertion slot.

The following describes processing operation of the paper money processing device 1 at a time of collecting the paper money M stored in the storage unit 5, with reference to the flowchart of FIG. 21.

When a paper money collection signal is received from the management server 203 (step S41: Yes), the stack gate motor 64 is driven to move the stack gate 31 from the import position to the export position (step S42).

Then, the cam driving motor 94 is driven to have the engagement protrusion 72*a* of the slide member 72 engaged with the large diameter portion 91*a* of the cam plate 90, thereby moving the pinch roller 33*b* from a default position toward the drive roller 33*a* to pinch the paper money by the conveyance roller pair 33 with the pinching force Fa; and to have the engagement protrusion 83*a* of the slide member 83 engaged with the large diameter portion 92*c* of the cam plate 90, thereby moving the upper guide 20 to make the aperture width of the conveyance path 4 maximum (step S43).

Subsequently, the conveyance motor 53 is driven in the reverse direction (step S44) to convey the stack of paper money pinched by the conveyance roller pair 33 toward the insertion slot 2. More specifically, the conveyance motor 53 is driven backward for a predetermined amount from the time point of detecting, by the first paper money detection sensor 24, the leading end of the paper money (step S45: Yes, step S46) so that the stack of paper money is partially ejected from the insertion slot 2. It should be noted that the rotation speed of the conveyance motor 53 at the time of ejecting the paper money is preferably slower than the rotation speed at the time of inserting the paper money, for the purpose of conveying a plurality of pieces of paper money without fail.

When the stack of paper money is pulled out by the person collecting the paper money and the paper money is no longer detected by the first paper money detection sensor 24 and the second paper money detection sensor 25 (step S47: No), the cam driving motor 94 is driven to move the upper guide 20 to make the aperture width of the conveyance path 4 minimum, while moving the pinch roller 33*b* away from the drive roller 33*a*, back to the standby position (step S48). It should be noted that when the first paper money detection sensor 24 and the second paper money detection sensor 25 no longer detects the paper money, the number of pieces of paper money stored in the RAM 103 is initialized to zero.

Embodiment 1 of the present invention thus described above solely serve as specific examples of the present invention, and are not to limit the scope of the present invention. The specific structures and the like are suitably modifiable. Further, the effects of the above embodiment are not more than examples of most preferable effects achievable by the present invention. The effects of the present invention are not limited to those described in the embodiments described above.

In the above embodiment 1, a pair of members (conveyance roller pair 33) is adopted as a member for conveying the paper money stored in the storage unit 5; however, the structure of the conveyance member is not limited to this. For example, a conveyance member may be structured with a rotatable belt arranged on one side of the paper money relative to its thickness direction, and a roller arranged on the other side of the paper money relative to its thickness direction.

Further, the above embodiment 1 deals with a case where, when the paper money is pinched by the conveyance roller pair 33 during the operation of collecting or stacking the paper money, the pinch roller 33*b* is pressed against the drive roller 33*a* by the torsion coil springs 71 so that the relative distance between the pinch roller 33*b* and the drive roller 33*a* is a value according to the thickness of the paper money. That is, with the resilience of the torsion coil springs 71, the relative distance between the pinch roller 33*b* and the drive roller 33*a* is set according to the thickness of the paper money. However, it is possible to adopt a structure such that the relative distance between the pinch roller 33*b* and the drive roller 33*a* is set according to the number of pieces of paper money stored, only by the shapes of the cam grooves 91. That is, of the cam grooves 91, a portion that engages with the engagement protrusion 72*a* when the engagement protrusion 83*a* engages with the second large diameter portion 92*c* is formed in a shape with continuously varying diameter, and the position to engage with the engagement protrusion 72*a* is determined according to the number of pieces of paper money stored, which number is stored in the RAM 103.

Further, the above embodiment 1 deals with a case where the stacking part 37 and the guide 38 of the stack gate 31 are jointed at both ends relative to the direction in which these members extend; however, the stacking part 37 and the guide 38 may be jointed at only one end.

Further, the above embodiment 1 deals with a case where the cam groves 91 and 92 have an annular shape; however, the cam grooves 91 and 92 do not necessarily have to have an annular shape, provided that the cam driving motor 94 is capable of rotating forward and backward.

Further, the above embodiment 1 deals with an example case of applying the paper stock processing device of the present invention to a paper money processing device to be mounted on the gaming media lending device; however, the application of the paper stock processing device of the present invention is not limited to this.

Further, the above embodiment 1 deals with a case where the paper money processing device 1 is installed so that the length direction of the insertion slot 2 is in the upward/downward directions; however, the direction of installing the paper stock processing device of the present invention is not limited to this. For example, the device may be installed so that the length of the insertion slot is horizontal.

Embodiment 2

Now, the following will describe a paper money processing device A1 of another embodiment of the present invention. It is noted that, the same reference numerals are assigned to components having substantially identical arrangements as those of Embodiment 1 and the descriptions thereof are omitted, and points of difference from Embodiment 1 are mainly described.

(Left Cover 111)

Figure 22:
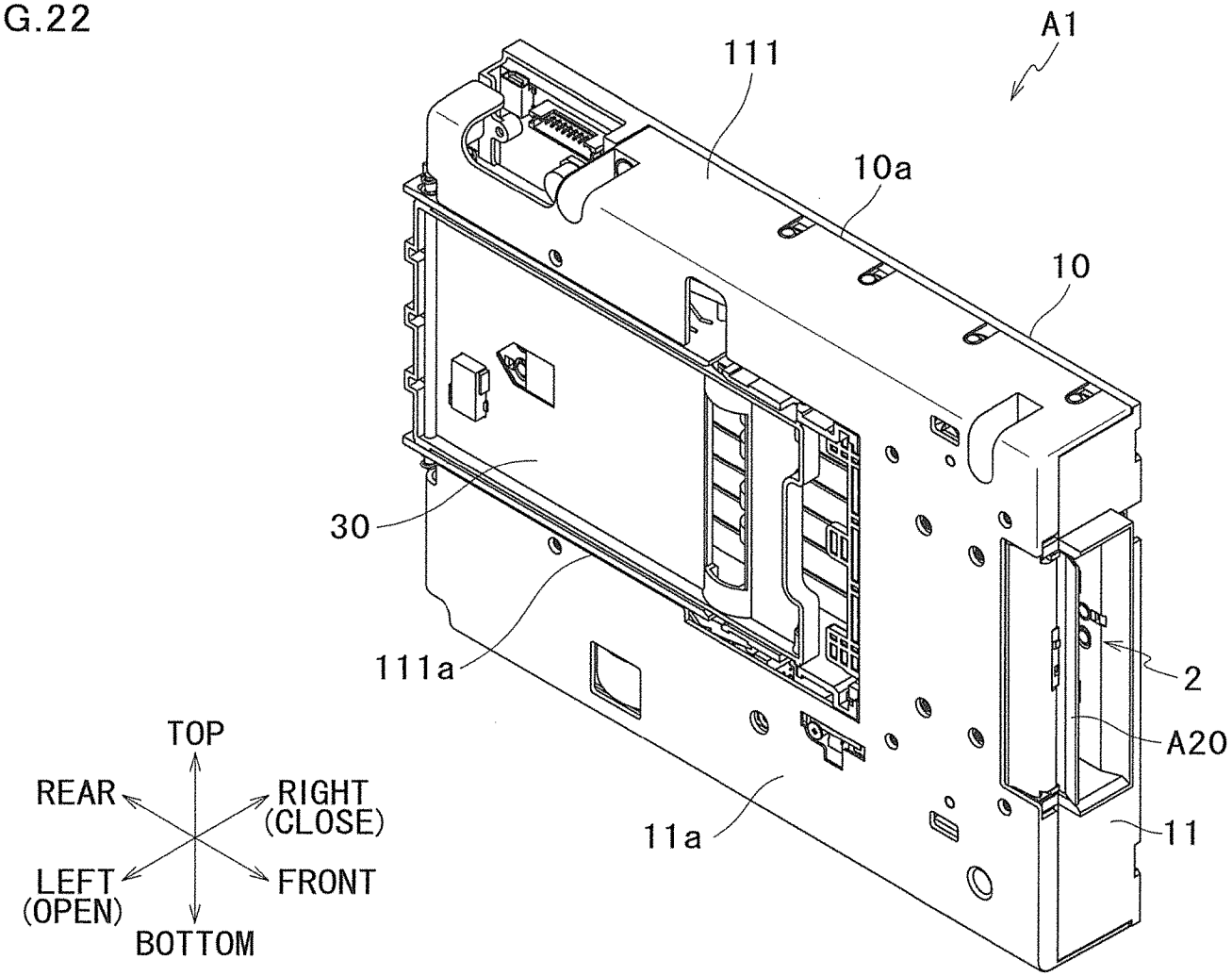
FIG. 22 is an oblique perspective of a paper money processing device of Embodiment 2.
Figure 23:
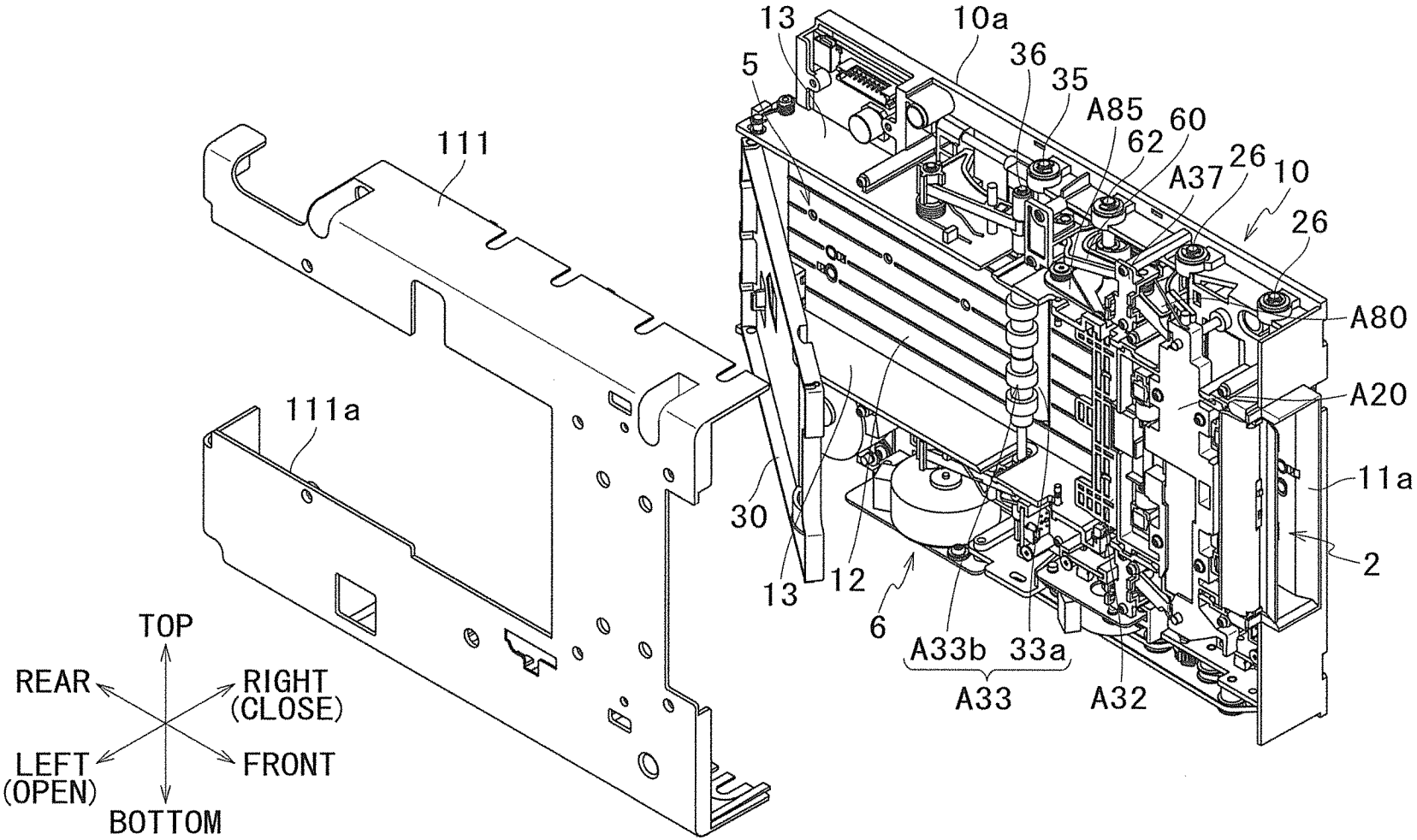
FIG. 23 is an oblique perspective showing a state in which a left cover is removed from the paper money processing device of FIG. 22.
Figure 24:
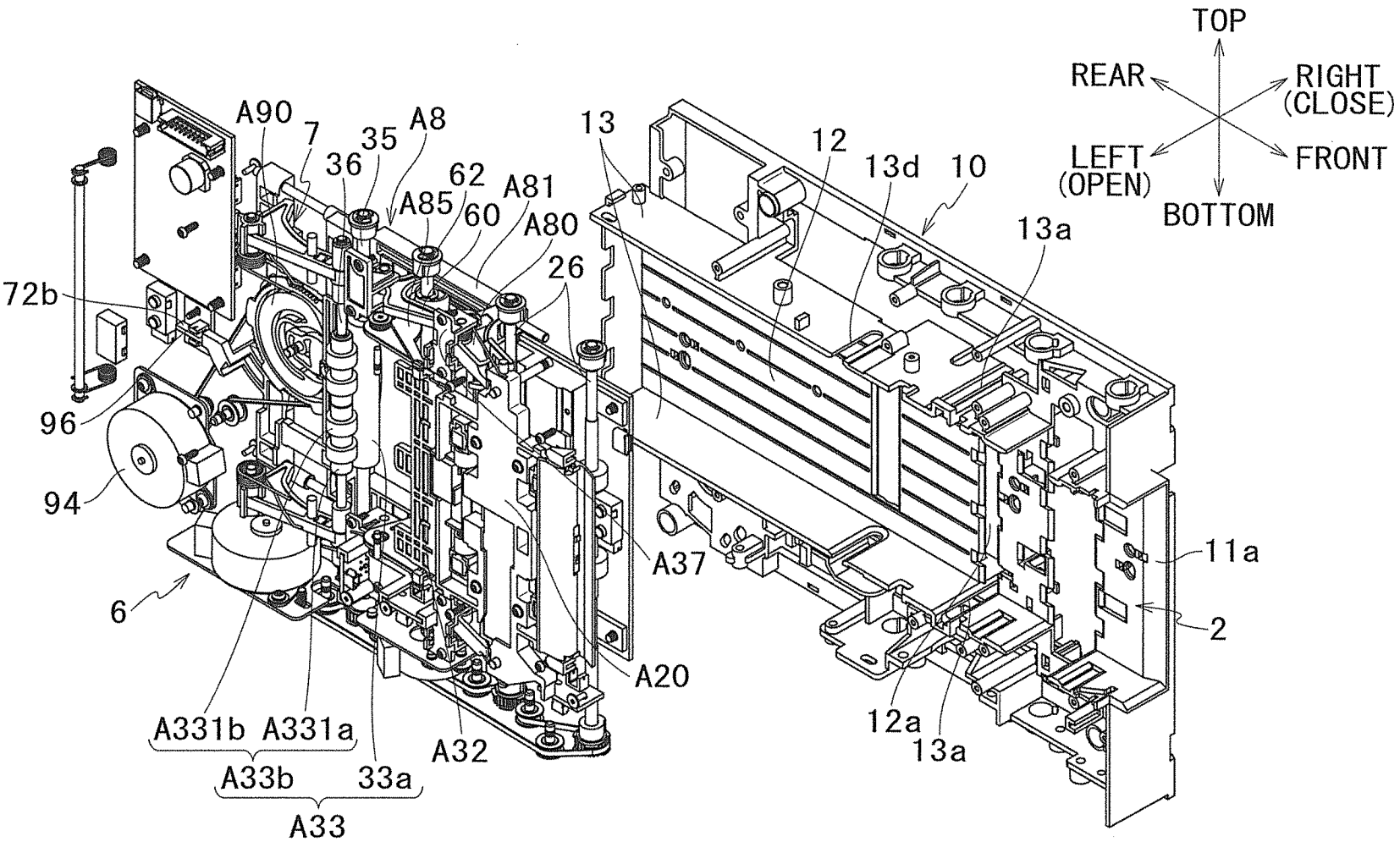
FIG. 24 is an exploded oblique perspective of the paper money processing device.

As shown in FIG. 22, FIG. 23, and FIG. 24, the paper money processing device A1 of Embodiment 2 includes a frame 10 to which members are mounted, a front cover 3 provided to cover a front wall 11 of the frame 10, and a left cover 111 which is provided to cover a part of the frame 10 which part is to the left of a right wall 10*a*. With this arrangement, the paper money processing device A1 is shaped to be a box formed of the right wall 10*a* of the frame 10, the front wall 11, and the left cover 111, so as to protect paper money and mechanisms in the paper money processing device A1.

The left cover 111 above has a U-shaped part 111*a* at a left wall 111*b*. The U-shaped part 111*a* is formed to allow the storage cover 30 to be exposed to the outside. With this arrangement, in the paper money processing device A1, the storage cover 30 can be opened and closed without detaching the left cover 111 from the frame 10. The left cover 111 is detachably fixed to the frame 10 by screwing.

(Expansion Mechanism A8)

Figure 26:
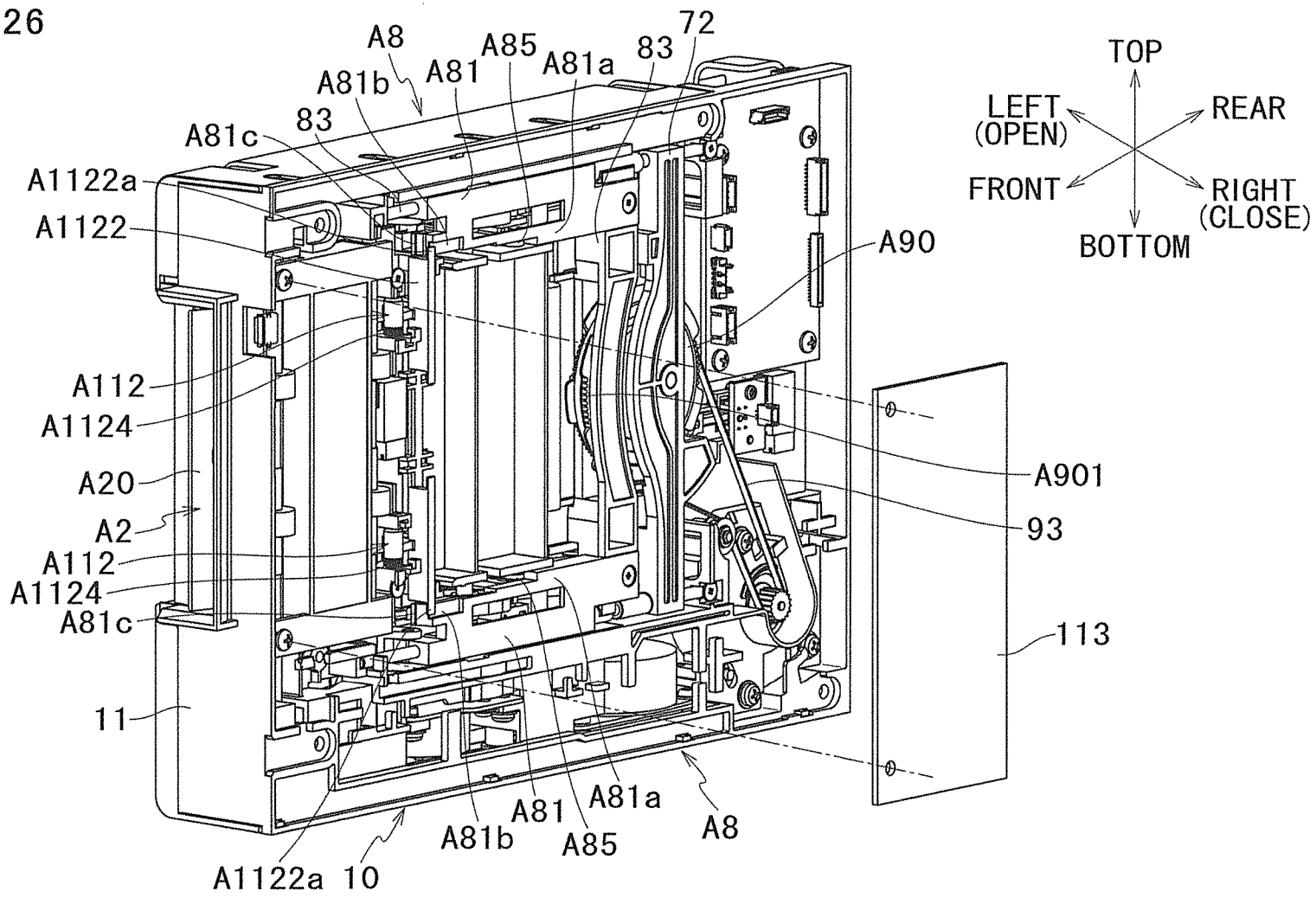
FIG. 26 is an oblique perspective showing a state in which a right cover is removed from the paper money processing device.

The expansion mechanism A8 is provided to move the upper guide A20 and the pressing plate A32 in the left/right direction and move a safety mechanism A112 which is biased leftward in the left/right direction. In other words, the expansion mechanism A8 has a function of driving the upper guide A20, a function of driving the pressing plate A32, and a function of driving the safety mechanism A112 shown in FIG. 26. A cam pulley A90 rotated by a cam driving motor 94 which is a drive source of the expansion mechanism 8 is shared by the two driving functions and one moving function above. FIG. 26 shows a state in which the right cover 111 is removed from the frame 10.

(Expansion Mechanism A8: Function of Driving Upper Guide A20)

The expansion mechanism A8 realizes the function of driving the upper guide A20 by two first arms A80 supporting protrusions A20*a* at the upper and lower end portions of the upper guide A20 in the left/right direction, two joining members A81, two torsion coil springs A801, and a slide member 83.

The two first arms A80 are provided above and below the upper/lower walls 13, respectively. Each first arm A80 is substantially L-shaped when viewed in the left/right direction. At around the corner of the L-shape, the first arm A80 is rotatably connected to an axis A19 of the frame 10.

At one leading end part of the L-shaped first arm A80, an axis A16 is provided. The axis 16 is engaged with a front end part of the joining member A81 to be rotatable and movable in the left/right direction. In the meanwhile, a rear end part of the joining member A81 is connected with a slide member 83. The joining member A81 is attached to a guide shaft 18 to be movable along the guide shaft 18. The axis of the guide shaft 18 is in parallel to the front/back direction. With this, the joining members A81 are moved by the slide member 83 only in the front/back directions. In accordance with the movement of the joining members A81 in the front/back direction, each first arm A80 moves one leading end part where the axis A16 is provided in the front/back direction, and moves the other leading end part in the left/right direction about the axis A19.

The other leading end part of the L-shaped first arm A80 is branched into a right supporting section A80*a* and a left supporting section A80*b*. The right supporting section A80*a* is in contact with a right side surface of a protrusion A20*a* of the upper guide A20. Furthermore, each first arm A80 is provided with a torsion coil spring A801. The torsion coil spring A801 is attached to an axis A19 of the first arm A80 at its central part, and a leading end part of the torsion coil spring A801 is in contact with the left side surface of the protrusion A20*a* of the upper guide A20 to bias the protrusion A20*a* rightward. With this, the upper guide A20 and the other leading end parts of the first arm A80 (i.e., the right supporting section A80*a* and the left supporting section A80*b*) are biased rightward by the torsion coil spring A801 (i.e., the direction of closing the insertion slot 2), and are movable leftward (i.e., the direction of opening the insertion slot 2) by the cam driving motor 94 via the protrusion A20*a*, the right supporting section A80*a* of the first arm A80, or the like.

Figure 32A:
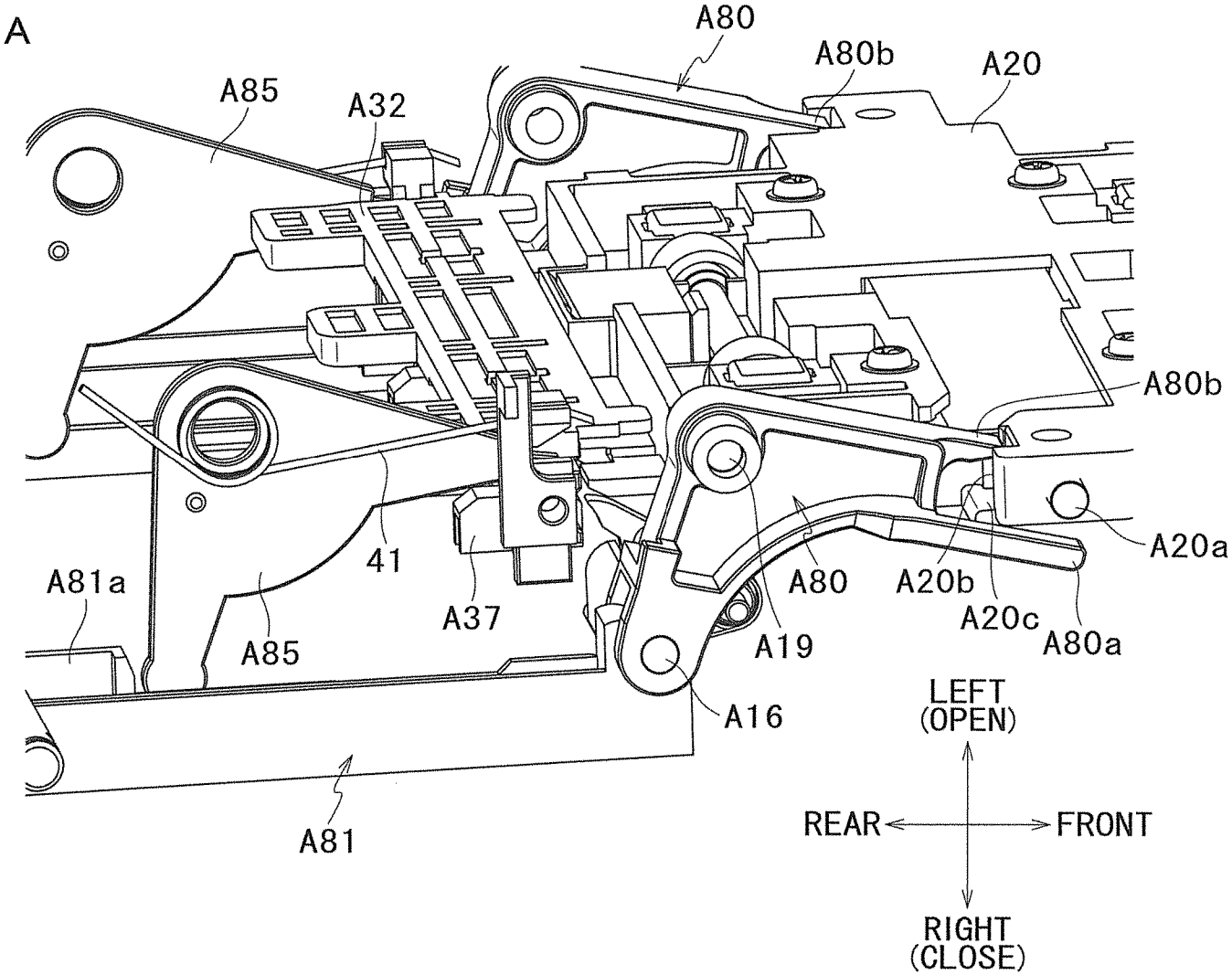
FIG. 32A is an explanatory diagram showing an operation of a first arm.
Figure 32B:
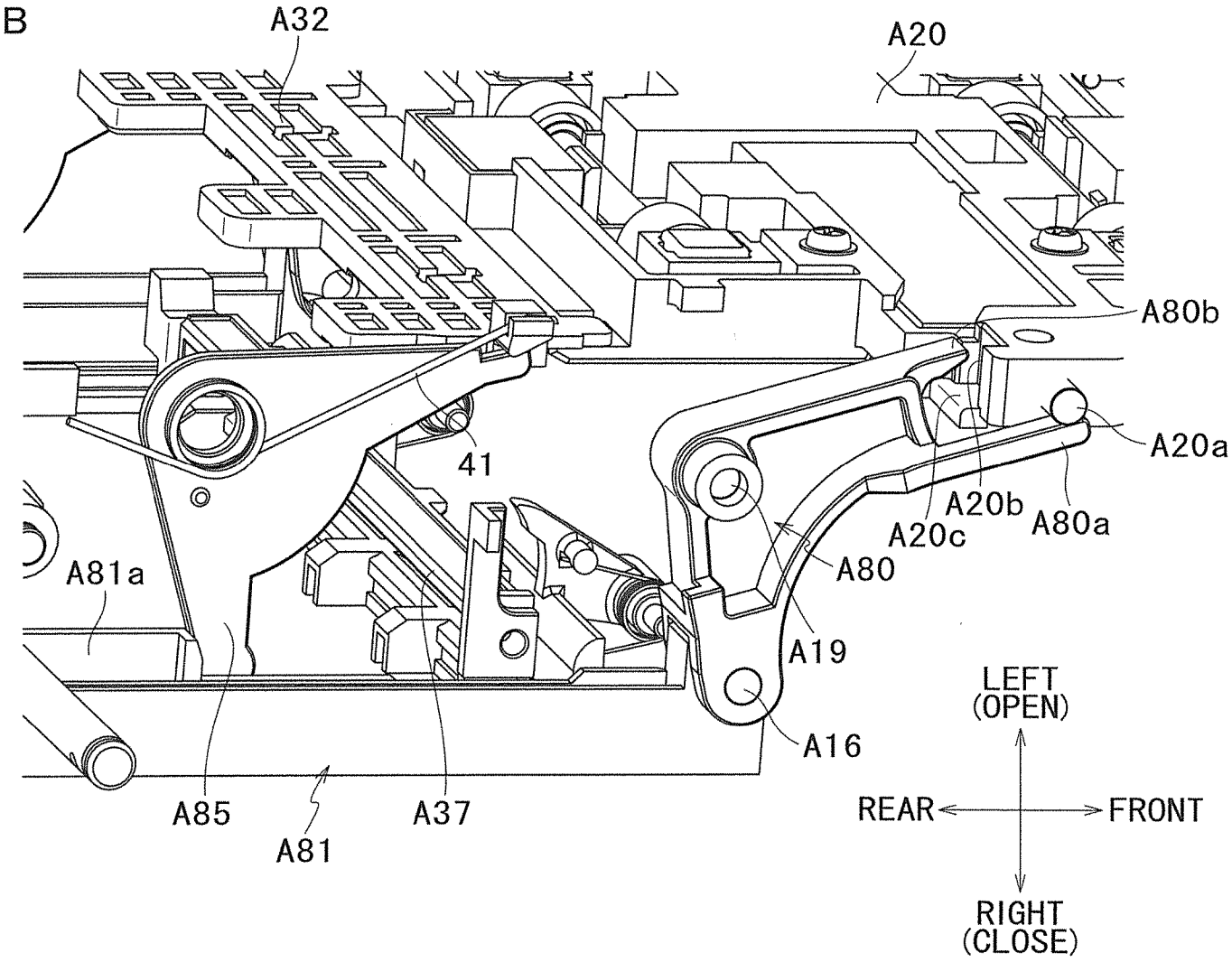
FIG. 32B is an explanatory diagram showing an operation of the first arm.
Figure 32C:
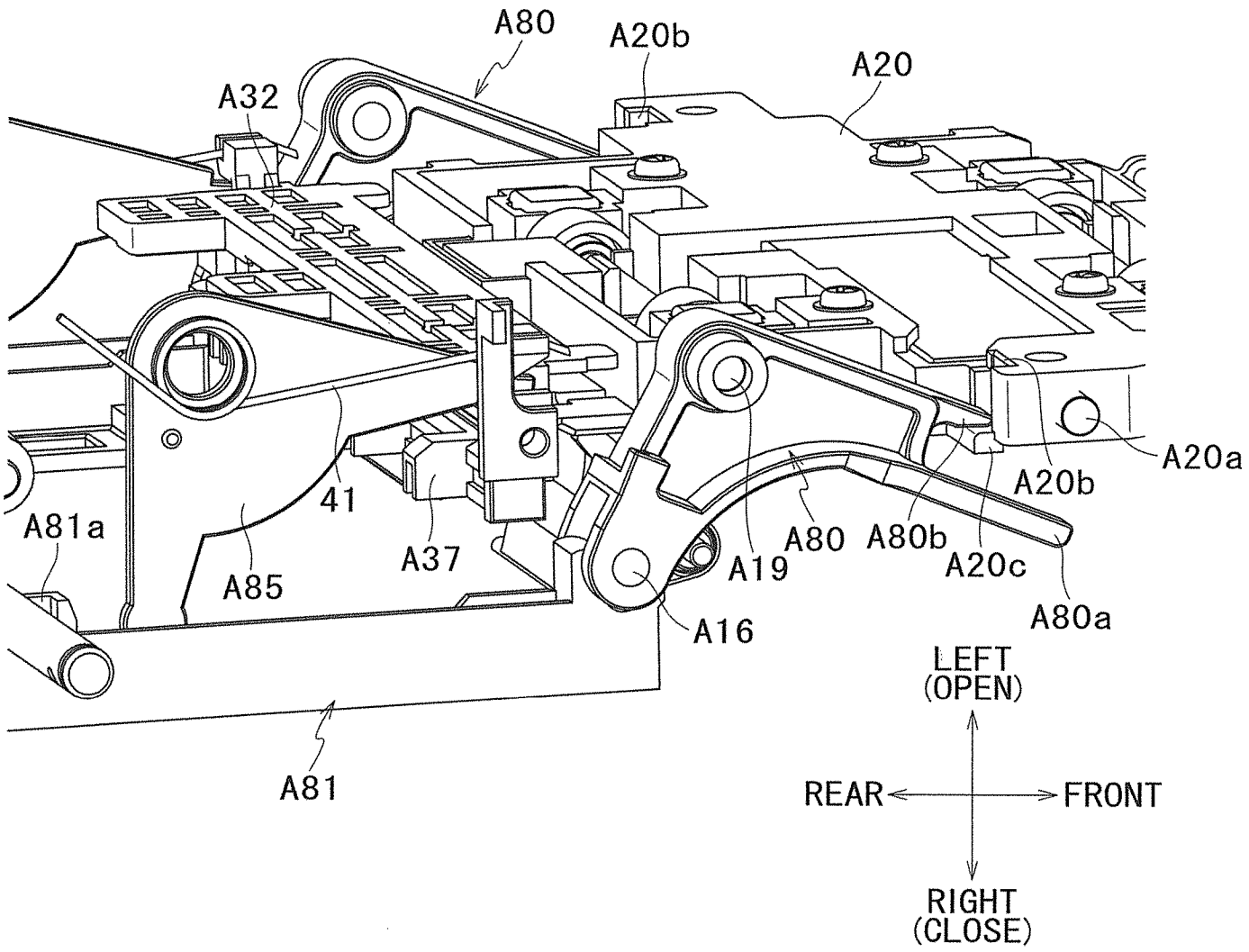
FIG. 32C is an explanatory diagram showing an operation of the first arm.

In the meanwhile, as shown in FIG. 32A, FIG. 32B, and FIG. 32C, the left supporting section A80*b* of the first arm A80 is arranged to be engaged with a guide groove part A20*b* of the upper guide A20. The guide groove part A20*b* is formed to extend in the left/right direction of the upper guide A20. The left edge of the guide groove part A20*b* is an open end at the left surface of the upper guide A20. In the meanwhile, the right edge of the guide groove part A20*b* is a closed end A20*c* at the right surface of the upper guide A20. As shown in FIG. 32C, the left supporting section A80*b* of the first arm A80 is arranged so that a leading end part thereof is in contact with the closed end A20*c* when the upper guide A20 is moved to the position where the insertion slot 2 is closed. With this, the leftward movement (in the opening direction) of the upper guide A20 is prohibited as the left supporting section A80*b* of the first arm A80 which cannot rotate on account of the joining member A81 is in contact with the closed end A20*c* of the guide groove part A20*b*. As a result, as the state in which the insertion slot 2 is closed is firmly maintained by the first arms A80, the upper guide A20 prevents a fraud performed by forcibly moving the upper guide A20 leftward (in the opening direction) from the outside.

(Expansion Mechanism A8: Function of Driving Pressing Plate A32)

The expansion mechanism A8 realizes a function of driving the pressing plate A32 as it includes two second arms A85 supporting, in the left/right direction, protrusions A32*b* of upper and lower end parts of the pressing plate A32, two joining members A81, two torsion coil springs 41, and a slide member 83.

Figure 25:
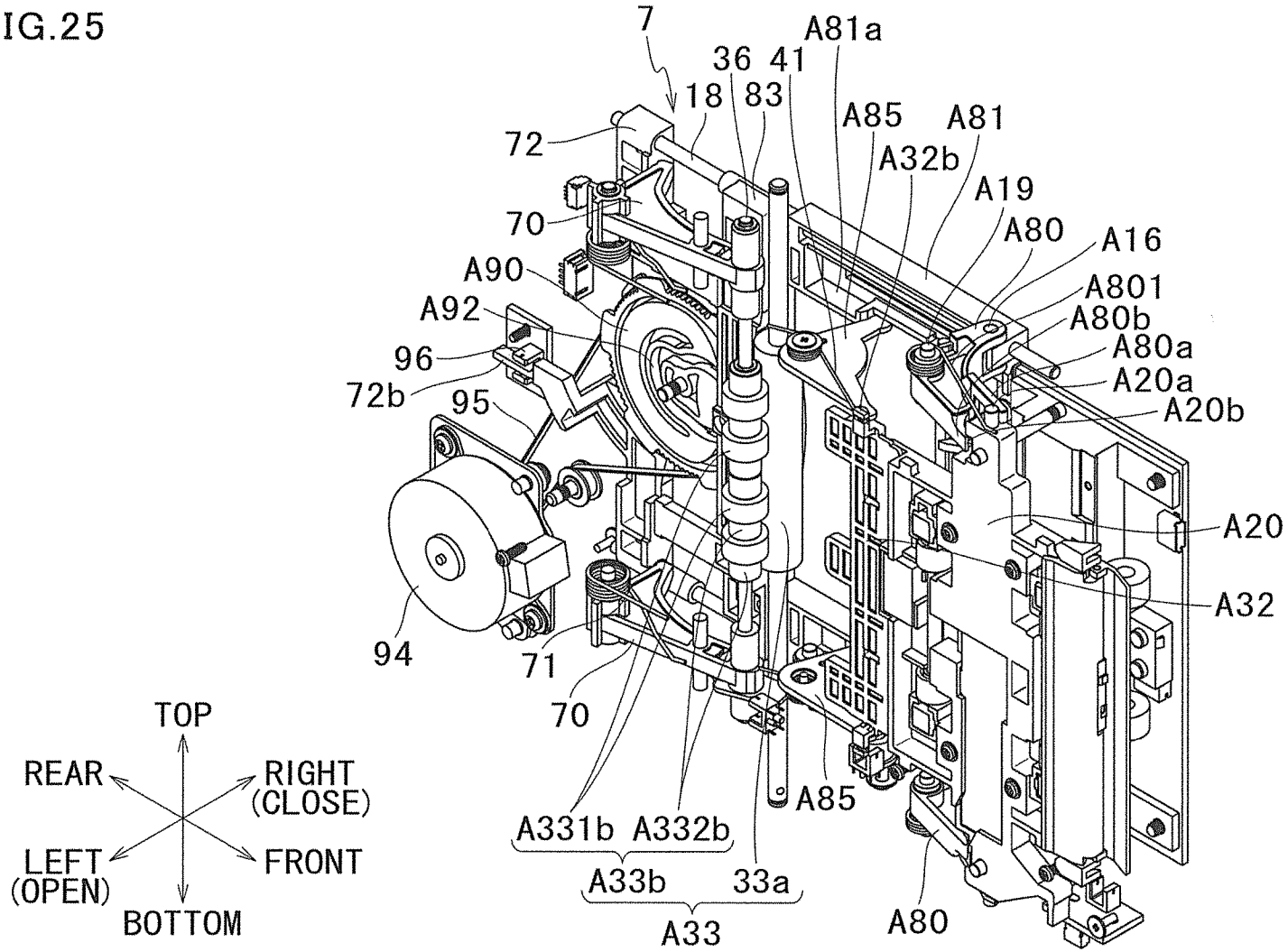
FIG. 25 is an oblique perspective of an important part of the paper money processing device.

As shown in FIG. 23, the two second arms A85 are provided between the upper/lower walls 13 and stack arms 60. As shown in FIG. 25, each second arm A85 is substantially L-shaped in the left/right direction. At around the corner of the L-shape, the second arm A85 is supported by the frame 10 to be rotatable. One leading end part of the L-shaped second arm A85 is in contact with the right side surface of the protrusion A32*b* of the pressing plate A32. The second arm A85 is provided with the torsion coil spring 41. The central part of the torsion coil spring 41 is attached to the axis of the second arm A85, and the leading end part of the torsion coil spring 41 is in contact with the left side surface of the protrusion A32*b* of the pressing plate A32 to bias the protrusion A32*b* rightward.

In the meanwhile, the other leading end part of the L-shaped second arm A85 is provided to be able to make contact with the protrusion A81*a* of the joining member A81. When moved forward by the slide member 83, the joining member A81 causes the protrusion A81*a* to be in contact with the other leading end part of the second arm A85, and moves one leading end part of the second arm A85 leftward so as to move the pressing plate A32 leftward. When moved backward by the slide member 83, the joining member A81 causes the protrusion A81*a* to be away from the other leading end part of the second arm A85 and rotates the second arm A85 rightward so as to move the pressing plate A32 rightward with the biasing force of the torsion coil spring 41.

(Expansion Mechanism A8: Function of Moving Safety Mechanism A112)

As shown in FIG. 26, the expansion mechanism A8 realizes a function of moving the safety mechanism A112 as it includes the two joining members A81 and the slide member 83.

Each joining member A81 includes a first engagement groove A81*b* and a second engagement groove A81*c*. The first engagement groove A81*b* and the second engagement groove A81*c* are formed so that a protruding part A1122*a* of the safety mechanism A112 is movably engaged. The safety mechanism A112 is biased leftward by the spring A1124. The safety mechanism A112 will be detailed later.

Figure 31A:
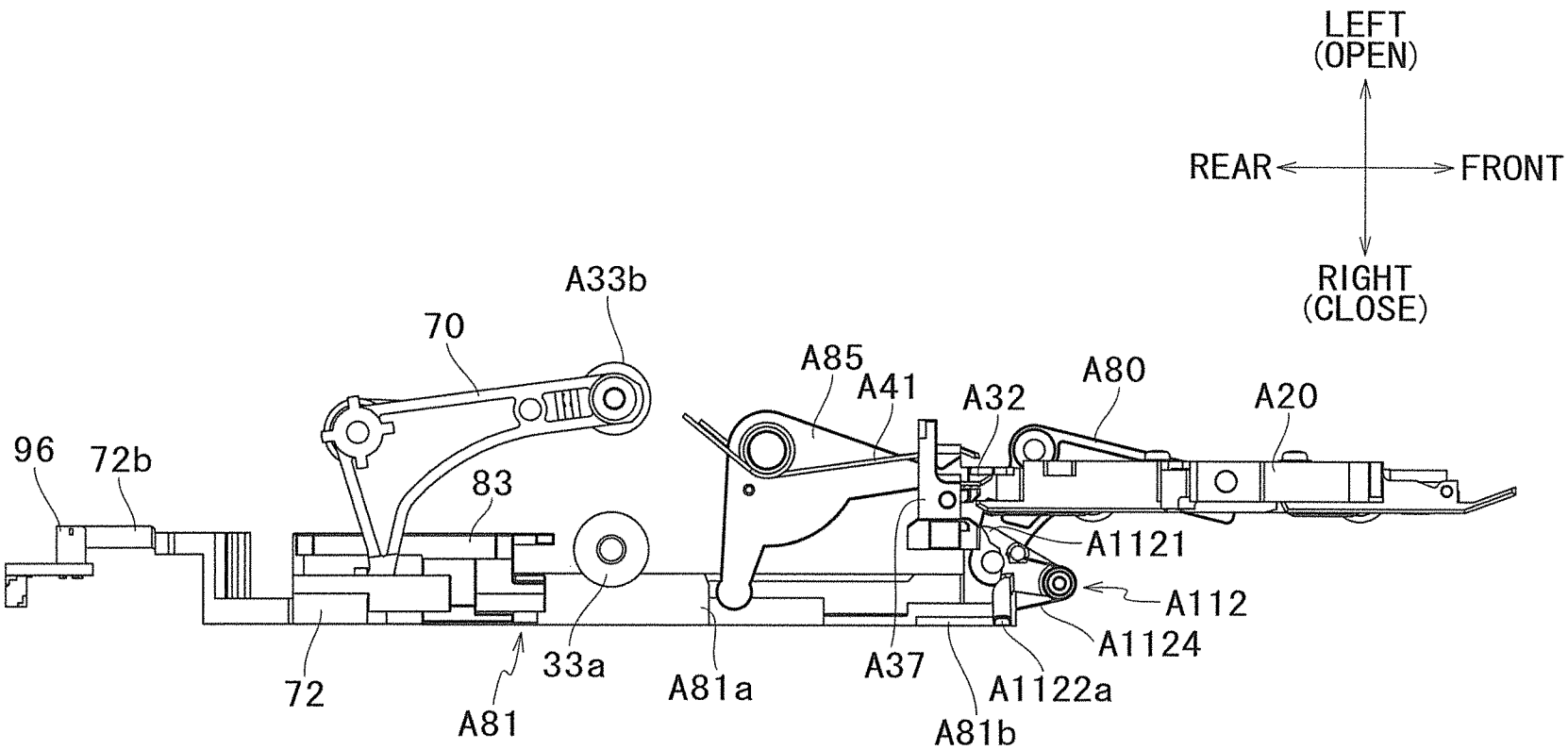
FIG. 31A is an explanatory diagram showing an operations of the units by the expansion mechanism.
Figure 31B:
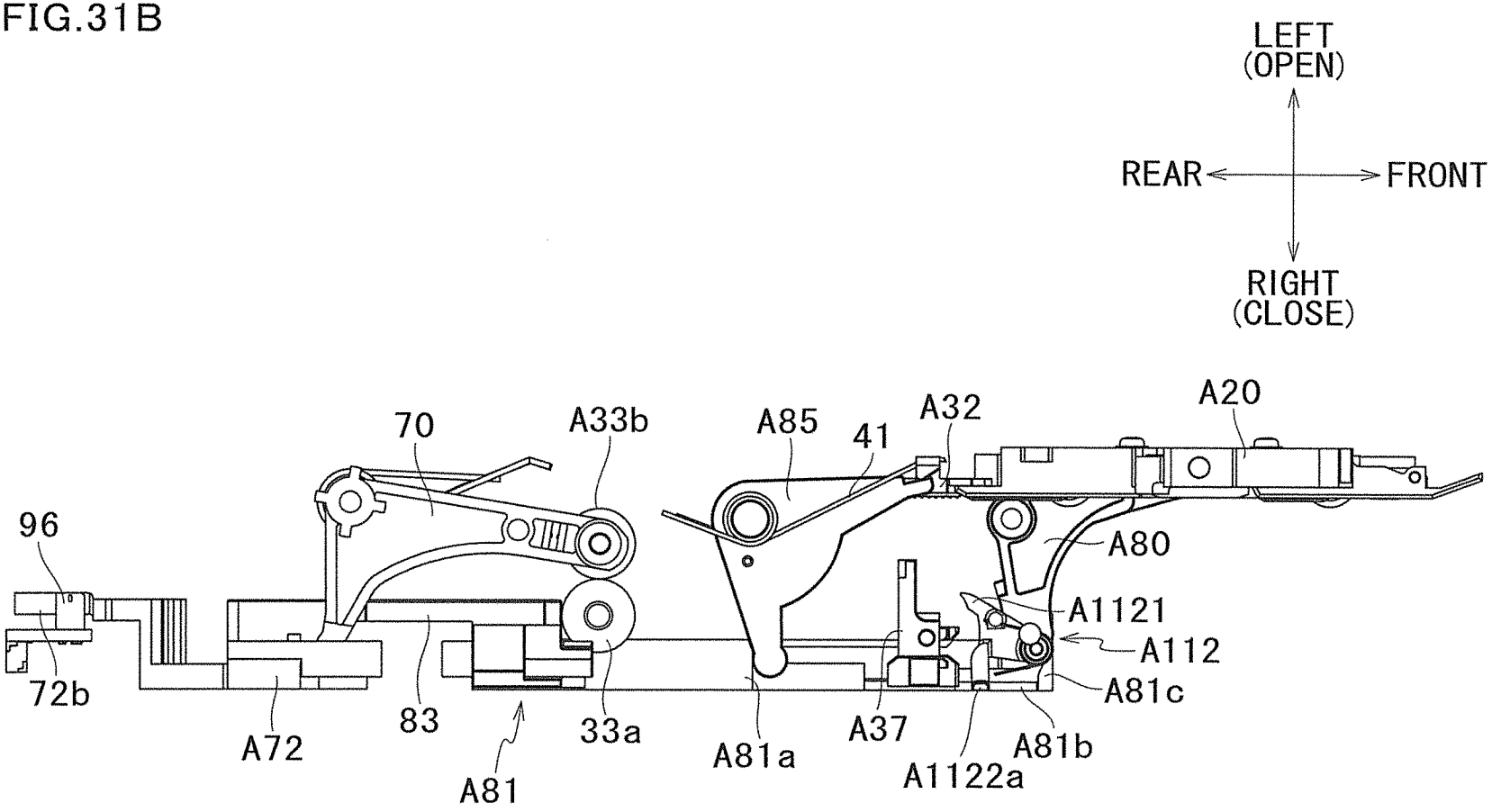
FIG. 31B is an explanatory diagram showing operations of the units by the expansion mechanism.
Figure 31C:
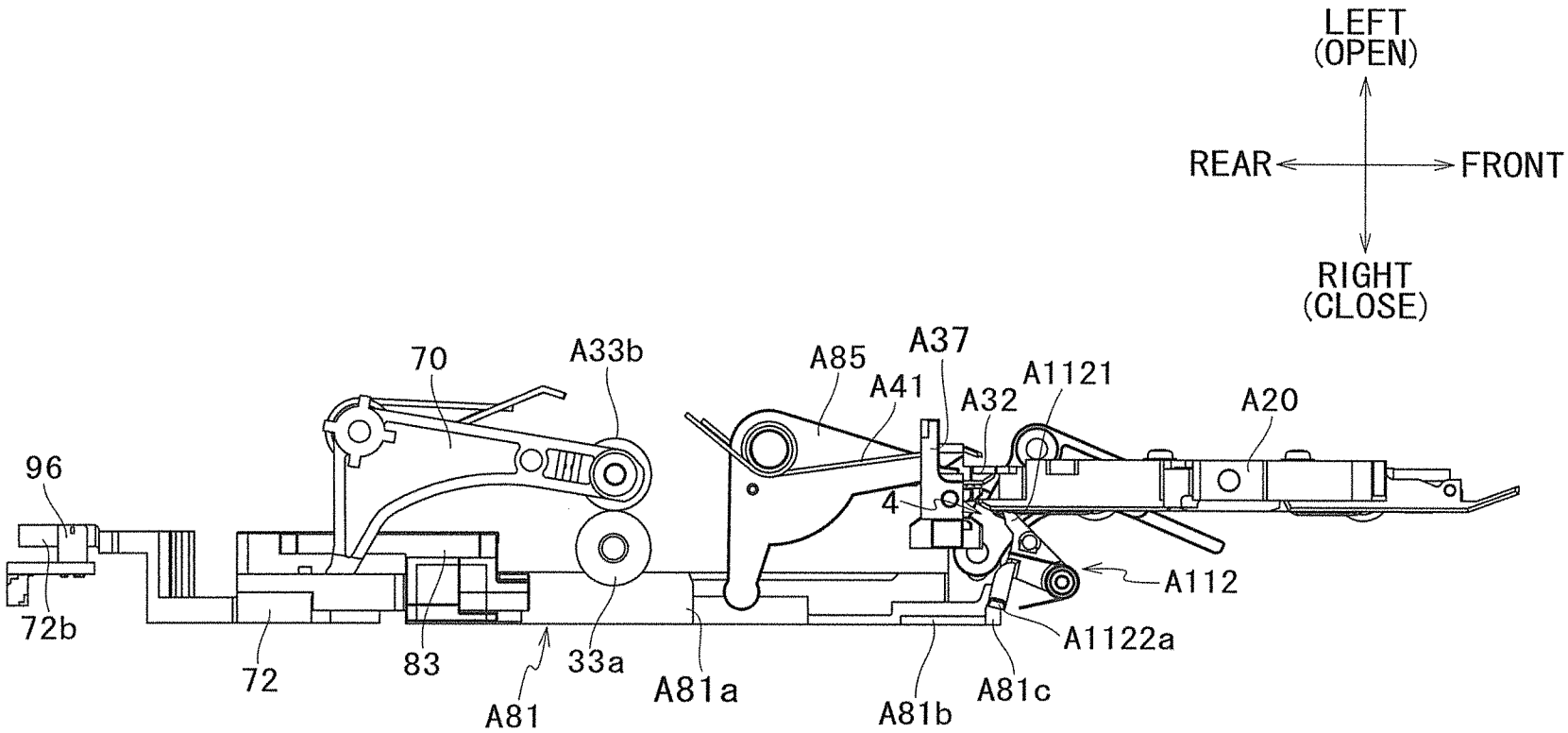
FIG. 31C is an explanatory diagram showing operations of the units by the expansion mechanism.

As shown in FIG. 31B, the first engagement groove A81*b* is formed on the wall part 12 side of the right wall front end part of the joining member A81. The second engagement groove A81*c* is connected with the first engagement groove A81*b* and is formed in a front side wall of the joining member A81. When moved forward by the slide member 83, the joining member A81 causes the protruding part A1122*a* of the safety mechanism A112 to be engaged with the first engagement groove A81*b*. With this, a shutter part A1121 of the safety mechanism A112 becomes to the right of the conveyance path and is therefore is sunk in the conveyance path. Furthermore, as shown in FIG. 31C, when the joining member A81 is moved backward by the slide member 83 and the protruding part A1122*a* of the safety mechanism A112 reaches the second engagement groove A81*c*, the joining member A81 moves the protruding part A1122*a* to the left edge of the second engagement groove A81*c* as the safety mechanism A112 is biased leftward. With this, the shutter part A1121 of the safety mechanism A112 becomes to the left of the conveyance path and therefore protrudes into the conveyance path.

(Pressing Plate A32)

The pressing plate A32 moved in the left/right direction by the arms A80 of the expansion mechanism A8 is, as shown in FIG. 31A, provided to oppose the left side of the stacking part A37. The upper and lower end parts of the pressing plate A32 are provided inside slits 13*a* which are formed in the upper/lower walls 13 shown in FIG. 24. As shown in FIG. 25, the protrusion A32*b* of the pressing plate A32 is arranged such that one end thereof is in contact with the other end of the torsion coil spring 41 engaged with the frame 10, and the pressing plate A32 is biased rightward by this torsion coil spring 41.

Figure 27A:
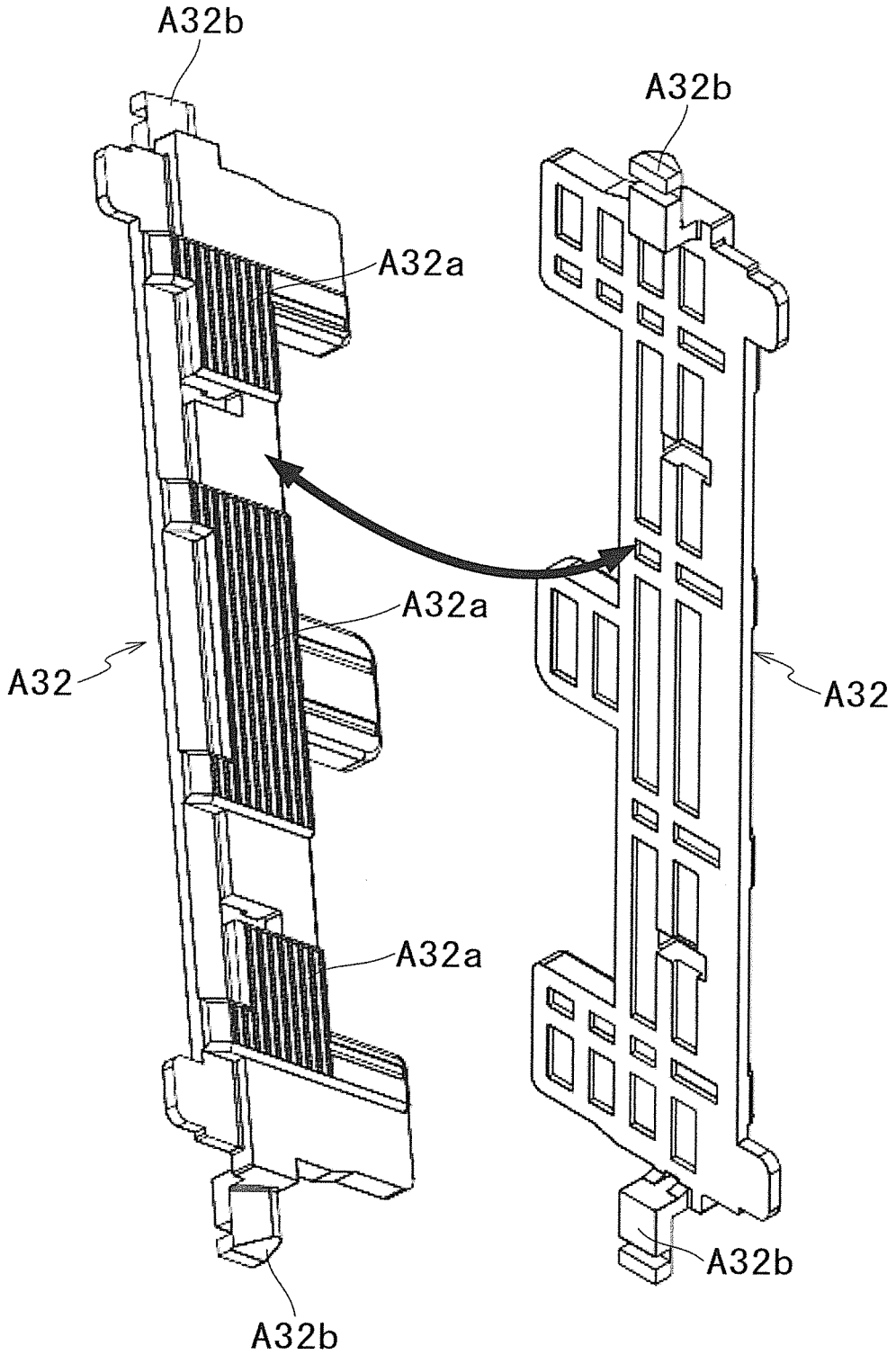
FIG. 27A is an explanatory diagram showing a pressing plate.
Figure 27B:
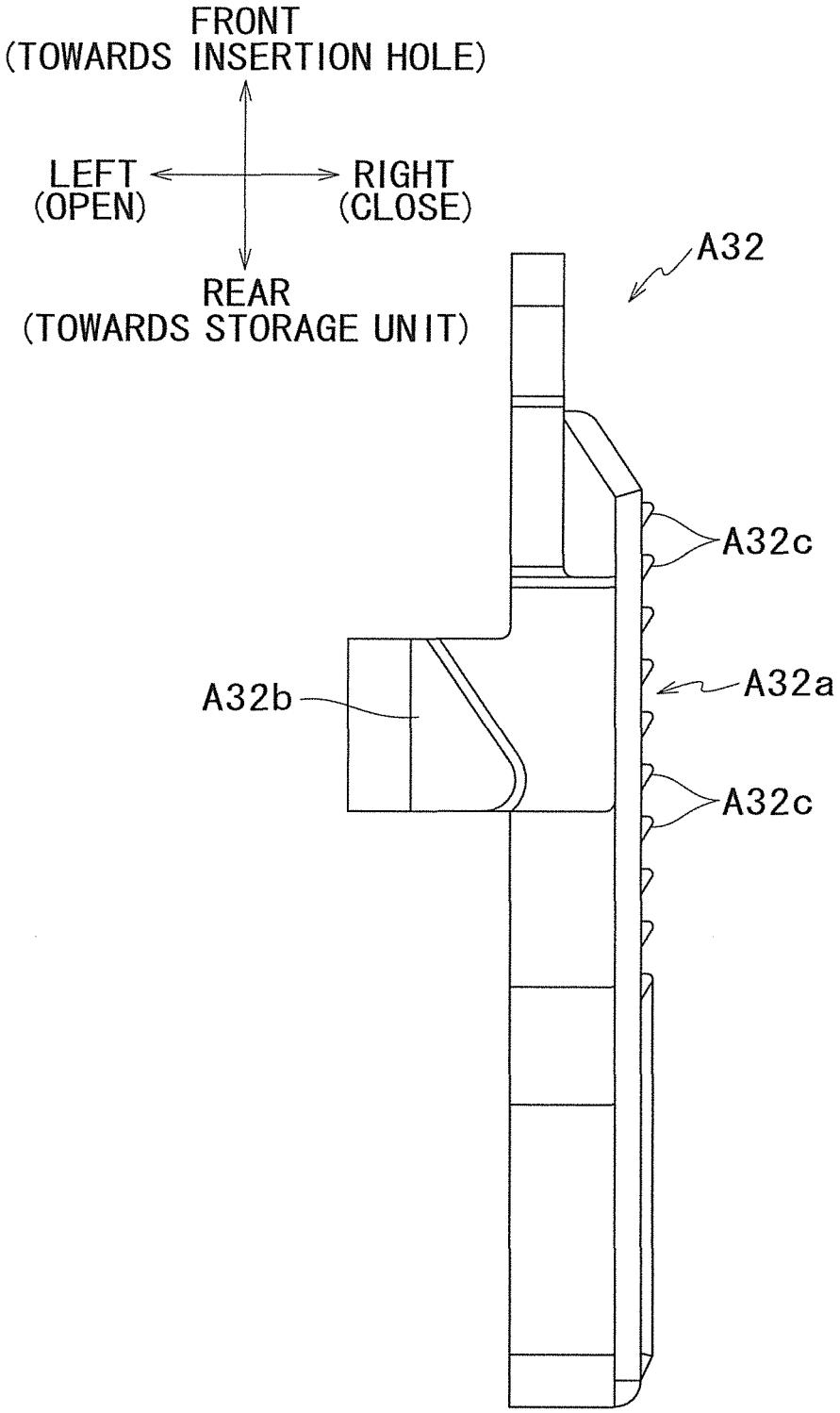
FIG. 27B is a side view of the pressing plate when viewed from above.

As shown in FIG. 27A, the right surface of the pressing plate A32 (i.e., the surface opposing the stacking part A37) has plural regulating members A32*a* (first regulating members). The regulating members A32*a* are provided at an upper region, a central region, and a lower region of the pressing plate A32. As shown in FIG. 27B, each regulating member A32*a* is formed on the surface contacting the paper stock so that the friction force when the paper stock moves toward the insertion slot 2 is smaller than the friction force when the paper stock moves toward the storage unit. To be more specific, each regulating member A32*a* includes plural protruding portions A32*c*. Each protruding portion A32*c* is formed to protrude rightward and extend along the upward/downward direction, and the protruding portions A32*c* are formed at regular intervals in the front/back direction. When viewed in the upward/downward direction, the cross-sectional shape of each protruding portion A32*c* is such that the line extending from the central point of the bottom part to the apex is inclined frontward.

With this, when the paper stock inserted into the insertion slot 2 is conveyed to the storage unit 5, the pressing plate A32 is able to prevent the layered state of the paper stock layered and stored in the storage unit 5 from being disturbed. Furthermore, when the paper stock stored in the storage unit 5 is conveyed toward the insertion slot 2, the friction force of the regulating member A32*a* is restrained, and hence a possibility of the occurrence of poor conveyance is restrained when the paper stock is collected.

(Stacking Part A37)

As shown in FIG. 24, the stacking part A37 (movable piece) opposing the pressing plate A32 is provided with a second regulating member with which the friction force between the stacking part A37 and the layered and stored paper stock is larger than the friction force between pieces of the layered and stored paper stock. For example, the second regulating member is made of silicon rubber and is formed at least at a position in contact with the paper stock. This prevents the stored paper stock from becoming unstable as pieces of the paper stock layered and stored in the storage unit 2 are deviated from one another on account of a shock at the emergence and sinking of the stacking part A37 in and from the import space 31*a*. Furthermore, the arrangement prevents the stored paper stock from becoming unstable as pieces of the paper stock layered and stored in the storage unit 5 are deviated from one another on account of a shock at the application of an external force to the paper money processing device A1.

(Safety Mechanism A112)

Figure 28:
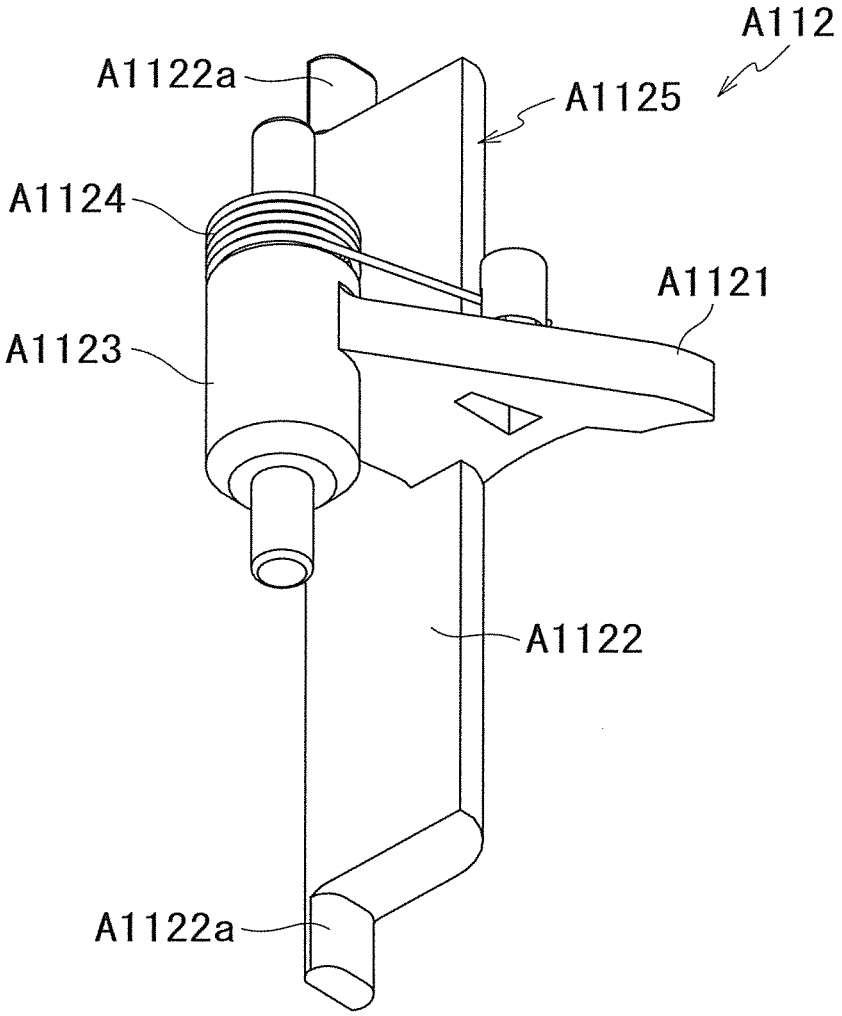
FIG. 28 is an oblique perspective of a safety mechanism.

As shown in FIG. 28, the safety mechanism A112 driven by the expansion mechanism A8 is provided with a shutter member A1125. The shutter member A1125 includes a flat plate part A1122, protruding parts A1122*a* provided at both end surfaces in the upward/downward direction of the flat plate part A1122, and a movement regulating member A1123 and a shutter part A1121 which are provided at a central part of the flat plate part A1122. The movement regulating member A1123 is provided with a spring A1124. This spring A1124 biases the shutter part A1121 to cause the shutter part A1121 to rotate about the movement regulating member A1123 and protrude into the conveyance path 4.

The protruding part A1122*a* is movably engaged with the first engagement groove A81*b* and the second engagement groove A81*c* of the joining member A81. As shown in FIG. 31A and FIG. 31B, when the joining member A81 is moved frontward by the slide member 83, the safety mechanism A112 causes the protruding part A1122*a* to be engaged with the first engagement groove A81*b* and moves the shutter part A1121 to be sunk from the conveyance path 4. In the meanwhile, as shown in FIG. 31C, when the joining member A81 is moved backward by the slide member 83, the safety mechanism A112 causes the protruding part A1122*a* to be engaged with the second engagement groove A81*c* and moves the shutter part A1121 to protrude into the conveyance path 4 by the biasing force of the spring A1124. With this arrangement, the safety mechanism A112 prevents the paper stock stored in the storage unit 5 from being pulled off, when deal is waited for.

In addition to the above, because the safety mechanism A112 conducts the movement and the stop of the movement of the shutter part A1121 by the reciprocating movement of the expansion mechanism A8, cost reduction is achieved as compared to cases where a dedicated movement switching mechanism is additionally provided to switch the movement and the stop of the movement of the safety mechanism A112 (shutter part A1121).

(Conveyance Roller Pair A33)

Figure 29:
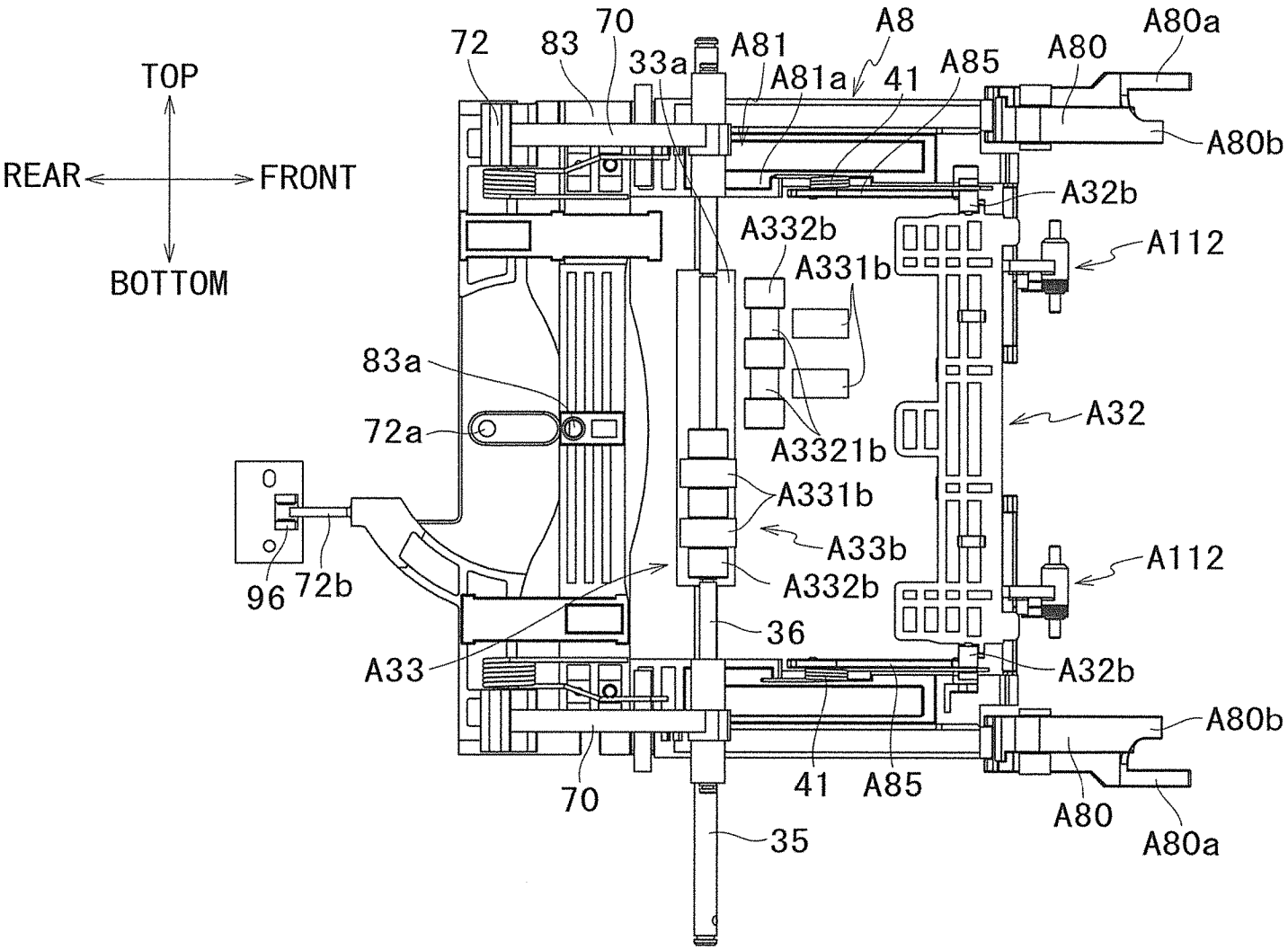
FIG. 29 is an explanatory diagram showing a state in which the pinch roller is exploded.

As shown in FIG. 29, the conveyance roller pair A33 is formed of a drive roller 33*a* provided on the wall part 12 side and a pinch roller A33*b* provided on the storage cover 30 side. The conveyance roller pair A33 is driven by the conveyance mechanism 6 and conveys the paper money. The space between the insertion slot 2 and the conveyance roller pair A33 is shorter than the length of the paper money relative to the conveyance direction.

The drive roller 33*a* is fixed to a drive shaft 35 rotatably supported by the frame 10, and slightly protrudes from the left surface of the wall part 12. The drive shaft 35 is driven by a conveyance mechanism 6. The pinch roller A33*b* is fixed to the spindle 36. The spindle 36 is driven in the left/right direction by the change mechanism 7. During a state in which the spindle 36 is farthest from the drive shaft 35, the pinch roller A33*b* is exposed to the outside from an opening formed on the storage cover 30.

The friction coefficient of the outer circumference of the drive roller 33*a* with respect to the paper money is greater than the friction coefficient of pieces of paper money with respect to each other. The friction coefficient of the outer circumference of the pinch roller 33*b* is greater than or smaller than the friction coefficient of pieces of paper money with respect to each other.

The pinch roller A33*b* includes first contact members A331*b* each of which deforms when it is in contact with the paper stock and presses the paper stock due to an elastic force generated on account of the return from the deformed shape to the original shape. Each first contact member A331*b* is formed of a low-hardness elastic body such as urethane foam. Furthermore, the first contact members A331*b* are each formed to be circular in shape and with a short axis, and four first contact members A331*b* are provided at regular intervals in the upward/downward direction.

The conveyance roller pair A33 is rotationally driven by the conveyance mechanism 6 so as to convey the pinched paper stock. When conveying the paper stock inserted into the insertion slot 2 toward the storage unit 5, the conveyance roller pair A33 changes the relative distance between the pinch roller 33*b* and the drive roller 33*a* so that the first contact members A331*b* are in contact with the paper stock.

With this, in the paper stock storing process of conveying the paper stock toward the storage unit 5, the first contact members A331*b* of the pinch roller A33*b* are in contact with the layered paper stock on account of the force generated by the elastic deformation, and hence a constant friction force is applied from the first contact members A331*b* to the conveyed paper stock irrespective of the state of the layered paper stock. This makes it possible to stably perform the paper stock storing process.

In addition to the above, the pinch roller A33*b* is provided with second contact members 332*b* which are formed to be harder than the first contact members A331*b*. Each second contact member 332*b* is cylindrical in shape. Each second contact member 332*b* is inserted into the first contact member A331*b*. On the outer circumferences of the second contact members 332*b*, concave fitting members A3321*b* are formed to extend in the circumferential direction. Four fitting members A3321*b* are formed at regular intervals in the upward/downward direction. Each fitting member A3321*b* is fitted to the inner circumferential part of the first contact member A331*b*. The axis of the second contact members 332*b* corresponds to the axis of the first contact members A331*b*. In other words, the conveyance roller pair A33 is arranged such that the first contact members A331*b* and the second contact members 332*b* share the same axis.

The outer diameter of the second contact members 332*b* is arranged to be shorter than the outer diameter of the first contact members A331*b* so that the outer circumference of the second contact members 332*b* is on the inner side of the outer circumference of the first contact members A331*b* fitted to the fitting members A3321*b*. When the paper stock stored in the storage unit 5 is conveyed toward the insertion slot 2, the conveyance roller pair A33 changes the relative distance between the drive roller 33*a* and the pinch roller A33*b* so that the second contact members 332*b* are in contact with the paper stock.

With this, in the paper stock collection in which the paper stock is conveyed toward the insertion slot 2, as the relative distance between the drive roller 33*a* and the pinch roller A33*b* is shortened, the first contact members A331*b* are crushed because the second contact members 332*b* are harder than the first contact members A331*b*, with the result that the second contact members 332*b* are in contact with the paper stock. As such, the first contact members A331*b* and the second contact member 332*b* having different elasticities are switched only by changing the relative distance, of the conveyance roller pair A33, i.e., by changing the moving distance of the pinch roller A33*b*.

(Cam Pulley A90)

As shown in FIG. 25, the slide member 83 of the expansion mechanism A8 is provided behind the joining member A81. Through the upper and lower ends of the slide member 83 are penetrated guide shafts 18. The slide member 83 moves in the front/back directions along the guide shafts 18. The slide member 83 is driven by the rotation of the cam pulley A90 which is a cam plate.

Figure 30A:
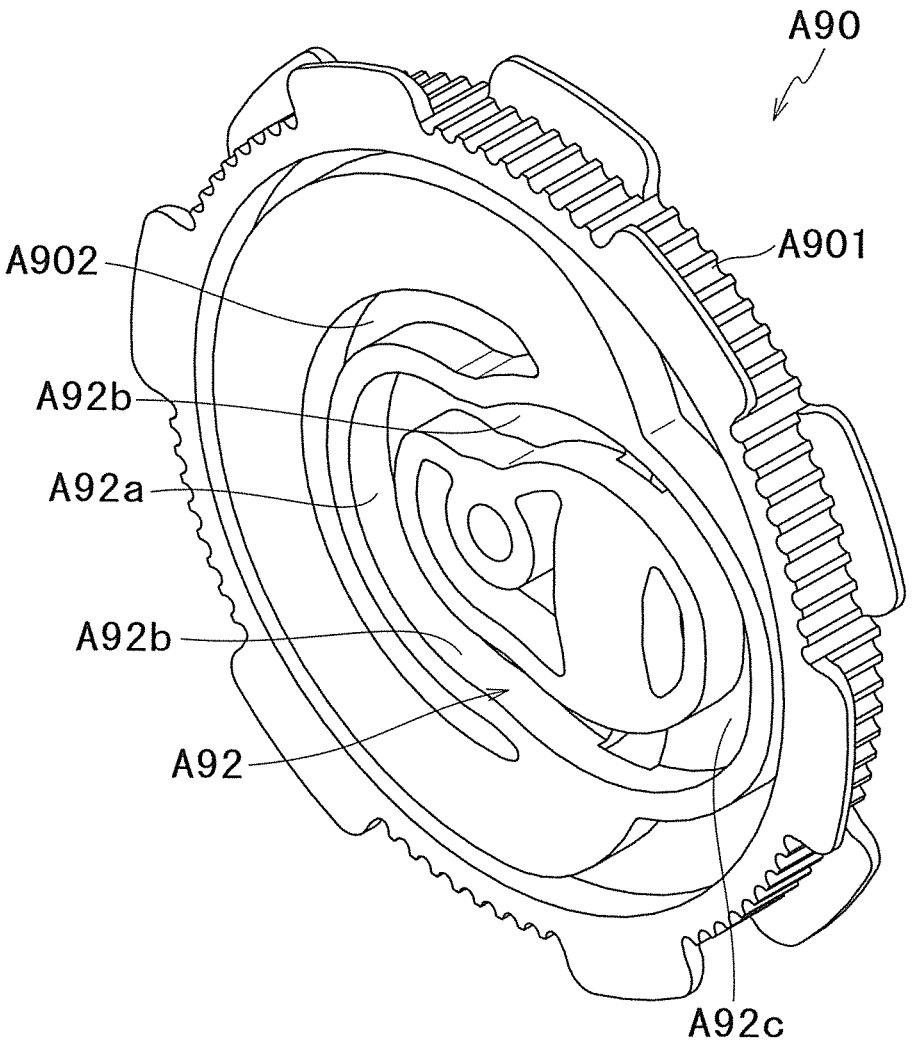
FIG. 30A is an oblique perspective of a cam plate.

As shown in FIG. 30A, the cam pulley A90 is an integral disc-shaped member. On the outer circumference of the cam pulley A90 is formed a gear part A901. The gear part A901 is engaged with a belt 93 which is a timing belt. An engagement protrusion 83*a* of the slide member 83 shown in FIG. 29 is engaged with a second cam groove A92 which is formed in the left surface of the cam pulley A90. As shown in FIG. 30A and the FIG. 30C, the second cam groove A92 is annular in shape, is formed of a small diameter portion A92*a* which is constant in diameter, two intermediate portions A92*b* which are connected with the respective sides of the small-diameter part A92*a* and linearly change in diameter, and a large diameter portion A92*c* which is constant in diameter and is larger in diameter than the small diameter portion A92*a*. On the left surface of the cam pulley A90, a third cam groove A902 is formed.

Figure 30B:
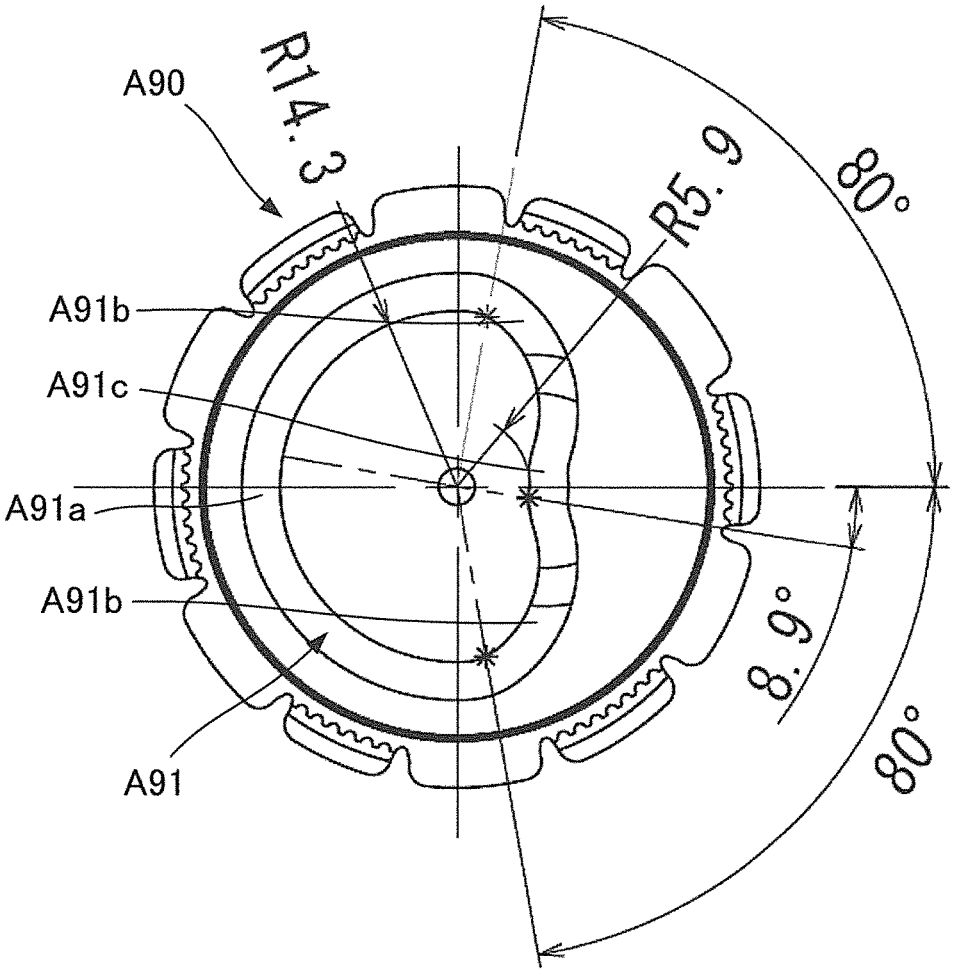
FIG. 30B is an explanatory diagram showing a state of a cam groove in one surface of the cam plate.
Figure 30C:
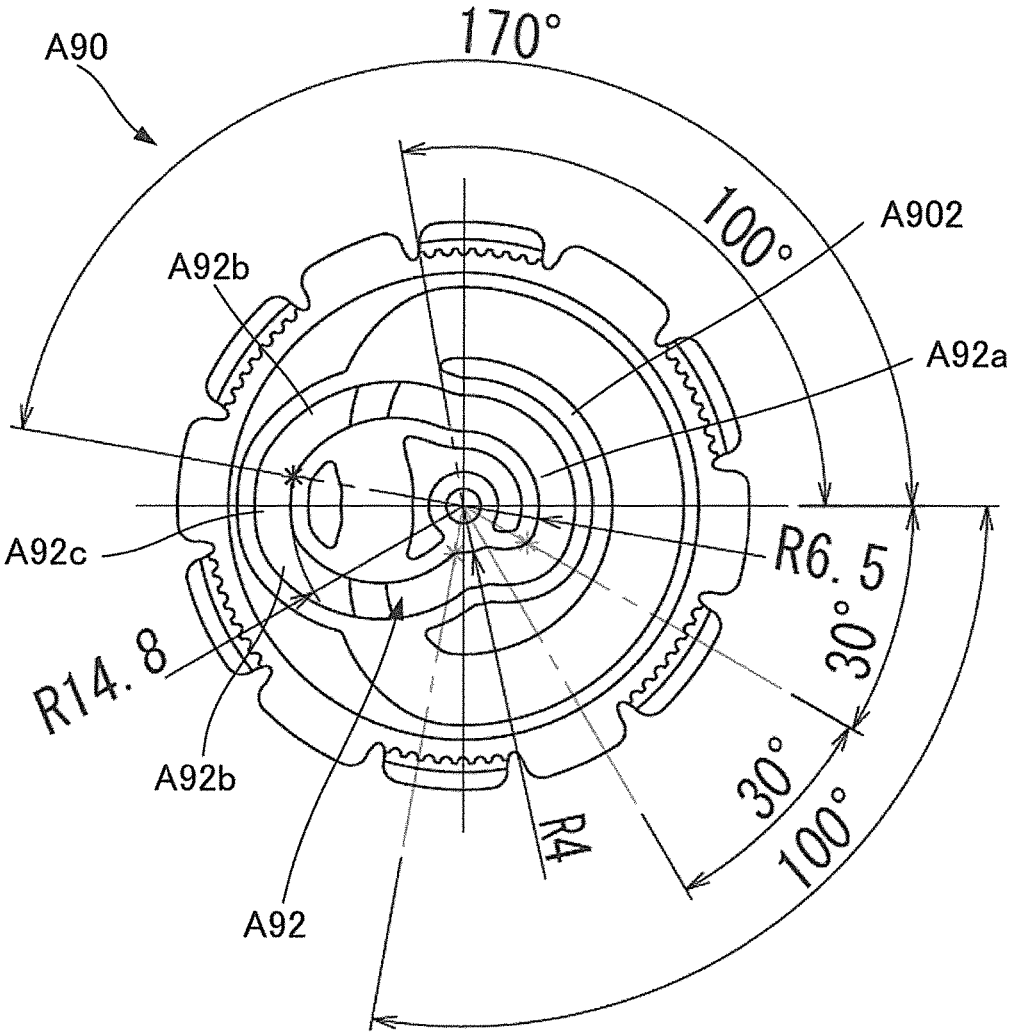
FIG. 30C is an explanatory diagram showing a state of a cam groove in the other surface of the cam plate.

In the meanwhile, as shown in FIG. 30B, a first cam groove A91 is formed on the right surface of the cam pulley A90. The first cam groove A91 is annular in shape and is formed of a large diameter portion A91*a* which is constant in diameter, two intermediate portions A91*b* which are connected with the respective sides of the large diameter portion A91*a* and each of which gradually changes in diameter, and a small diameter portion A91*c* which is constant in diameter and is smaller in diameter than the large diameter portion A91*a*. The details of the first cam groove A91 and the second cam groove A92 are identical with the first cam groove 91 and the second cam groove 92 of Embodiment 1. The other arrangements in Embodiment 2 are identical with those in Embodiment 1 and the explanations thereof are therefore omitted.

(Operation of Cam Pulley A90)

Figure 30D:
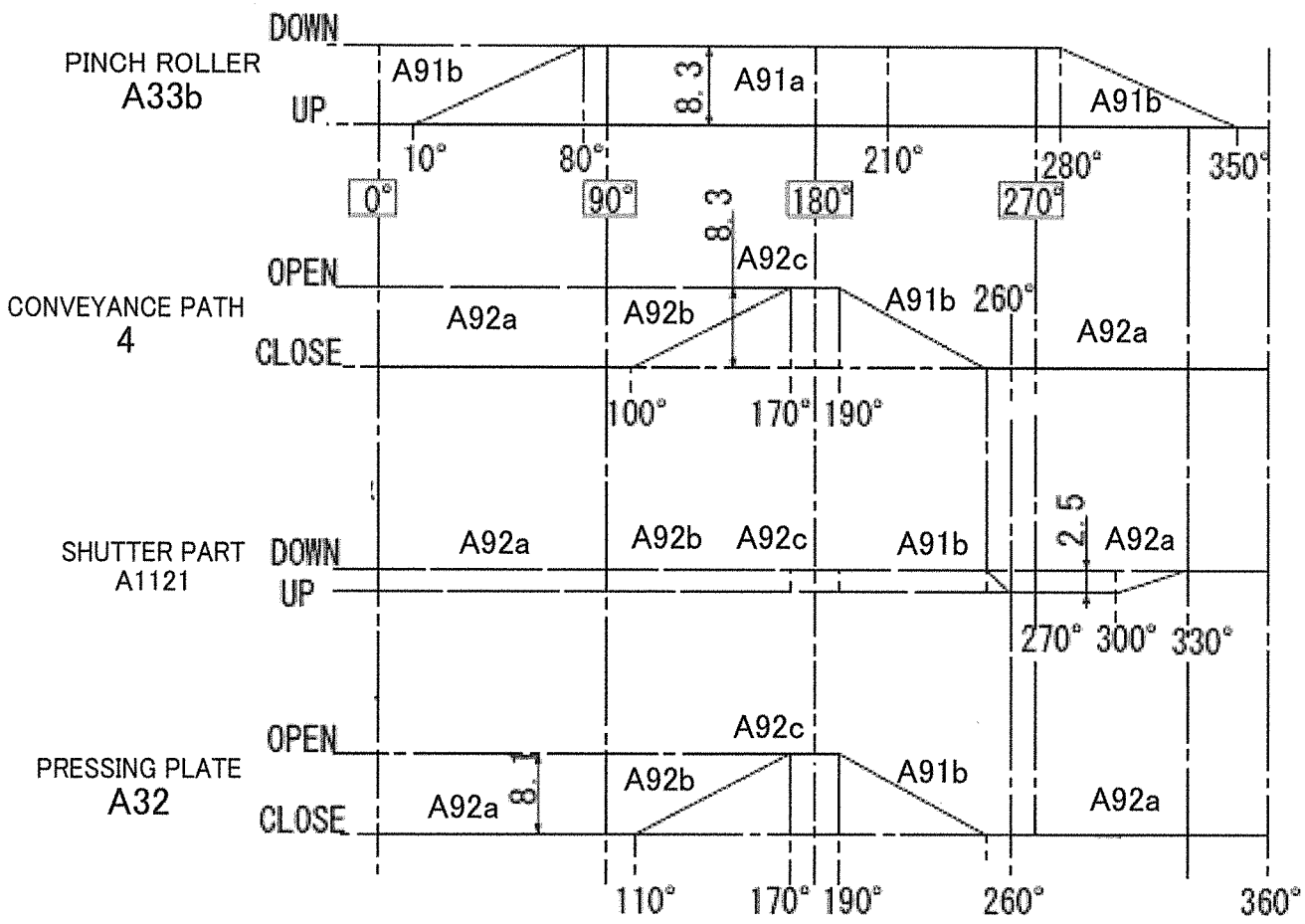
FIG. 30D is an explanatory diagram showing operations of the units based on an angle position of the cam plate.

As shown in FIG. 30B, assume that the line connecting the rotational center of the cam pulley A90 and the intermediate point of the small diameter portion A91*c* of the first cam groove A91 is the front/back direction, and the state in which the rotational center of the cam pulley A90 is in front of the intermediate point of the small diameter portion A91*c* is a rotational angle position of the cam pulley A90 at which the angle is 0 degree (reference position). When, as shown in FIG. 30D, the cam pulley A90 rotates from the 0-degree position to the 360-degree position, the slide member 72 engaged with the first cam groove A91 and the joining member A81 engaged with the second cam groove A92 move in the front/back direction, with the result that the pinch roller A33*b*, the conveyance path 4, the shutter part A1121, and the pressing plate A32 operate at respective timings (i.e., take rotational angle positions).

In regard to the above, the 0-degree position (reference position) of the cam pulley A90 is, as shown in FIG. 25, detected by a cam detection sensor 96. To be more specific, as the protrusion 72*b* formed at the rear end part of the slide member 72 is detected by the cam detection sensor 96, the 0-degree position (reference position) of the cam pulley A90 is detected. The 0-degree position (reference position) of the cam pulley A90 is provided to reset an error in the rotational angle position when the cam pulley A90 is rotationally driven by the cam driving motor 94. The resetting operation with reference to the reference position may be done at every predetermined time or each time the cam pulley A90 is rotated at a predetermined rotational angle, at a timing of the shifting from a predetermined operation to the next operation, or at a timing of executing at least one specific operation selected from plural operations.

The following will specifically describe the operation when the cam pulley A90 rotates from the 0-degree position to the 360-degree position. The resetting operation, which will not be described below, is performed at a timing of the shifting from a predetermined operation to the next operation. As shown in FIG. 31A, when the cam pulley A90 is at a position in the range of the 0-degree position to the 10-degree position, the pinch roller A33*b* has been moved up (moved leftward) and in a stopped state at a standby position which is the farthest from the drive roller 33*a*. Furthermore, as the upper guide A20 supported by the arm A80 is moved rightward, the conveyance path 4 is closed. The shutter part A1121 is moved to be below (to the right of) the stacking part 37, and is in a stopped state at a sunk position where the shutter part A1121 is sunk in the import space 31*a* (conveyance path 4). The pressing plate A32 supported by the second arm A85 is in a closed state (is positioned on the right side).

When the cam pulley A90 rotates from the 10-degree position toward the 80-degree position, the pinch roller A33*b* starts to descend (move rightward) toward the drive roller 33*a*. At this stage, the conveyance path 4, the shutter part A1121, and the pressing plate A32 maintain the respective states.

As the cam pulley A90 rotates from the 80-degree position toward the 100-degree position, the pinch roller A33*b* is in a stopped state at a shortest roller distance position where the pinch roller A33*b* is at the lowermost, the conveyance path 4 is in a closed state, the shutter part A1121 is in a stopped state at the sunk position, and the pressing plate A32 is in a closed state (positioned on the right side).

When the cam pulley A90 reaches the 100-degree position, the conveyance path 4 starts to open. When the cam pulley A90 reaches the 110-degree position, then the pressing plate A32 starts to open. When the cam pulley A90 reaches the 170-degree position, the conveyance path 4 and the pressing plate A32 are in fully-open states. To put it differently, as shown in FIG. 31B, the pinch roller A33*b* has been moved to the shortest roller distance position where the pinch roller A33*b* is at the lowermost, the conveyance path 4 is in a fully-opened state, the shutter part A1121 has been moved to the sunk position, and the pressing plate A32 is in a fully-opened state. The states above are maintained during the rotation of the cam pulley A90 from the 170-degree position to the 190-degree position.

When the cam pulley A90 reaches the 190-degree position, the conveyance path 4 and the pressing plate A32 start to close. Immediately before the cam pulley A90 reaches the 260-degree position, the shutter part A1121 starts to move up. When the cam pulley A90 reaches the 260-degree position, the shutter part A1121 is at the uppermost position and hence at a protruding position where the shutter part A1121 protrudes into the import space 31*a* (conveyance path 4). The conveyance path 4 and the pressing plate A32 are fully-closed positions. These states are maintained during the rotation of the cam pulley A90 from the 260-degree position to the 280-degree position.

When the cam pulley A90 reaches the 280-degree position, the pinch roller A33*b* starts to move up. When the cam pulley A90 reaches the 300-degree position, the shutter part A1121 starts to move down. When the cam pulley A90 reaches the 330-degree position, the shutter part A1121 is at the lowermost position and is sunk from the import space 31*a*. When the cam pulley A90 reaches the 350-degree position, the pinch roller A33*b* is at the uppermost position and has been moved to the standby position. As such, the cam pulley A90 returns to the state show in FIG. 31A in which the cam pulley A90 is at the 0-degree position.

(Process Operation when Paper Money is Entered)

Now, operations of the paper money processing device A1 when the paper money is inserted will be described with reference to flowcharts shown in FIGS. 32 to 36 and FIGS. 39 to 41 executed by a CPU 101.

As shown in the flowchart of FIG. 32, when the paper money is inserted into the insertion slot 2 and the paper money is detected by a first paper money detection sensor 24 (T1: YES), the cam driving motor 94 is driven so that the shutter part A1121 is moved from the protruding position to the sunk position and the pinch roller A33*b* is moved from the shortest roller distance position to the standby position (T2). In other words, as shown in FIG. 31A, as the cam pulley A90 is moved from the 270-degree position to the 0-degree position (reference position), the shutter part A1121 of the safety mechanism A112 is sunk into the conveyance path 4 and the pinch roller A33*b* is moved to the standby position (moved from DOWN to UP). Furthermore, as the cam detection sensor 96 detects the protrusion 72*b*, the rotational angle position is reset.

Thereafter, a black level correction process is carried out (T3). The conveyance motor 53 is driven forward (T4), so that the inserted paper money is conveyed toward the storage unit 5 by insertion conveyance roller pairs 22 and 23. When the conveyed paper money passes the reader unit 21, a reading process of reading the paper money which is a reading target starts (T5), and an overlap/shape check process is executed (T6).

Figure 36:
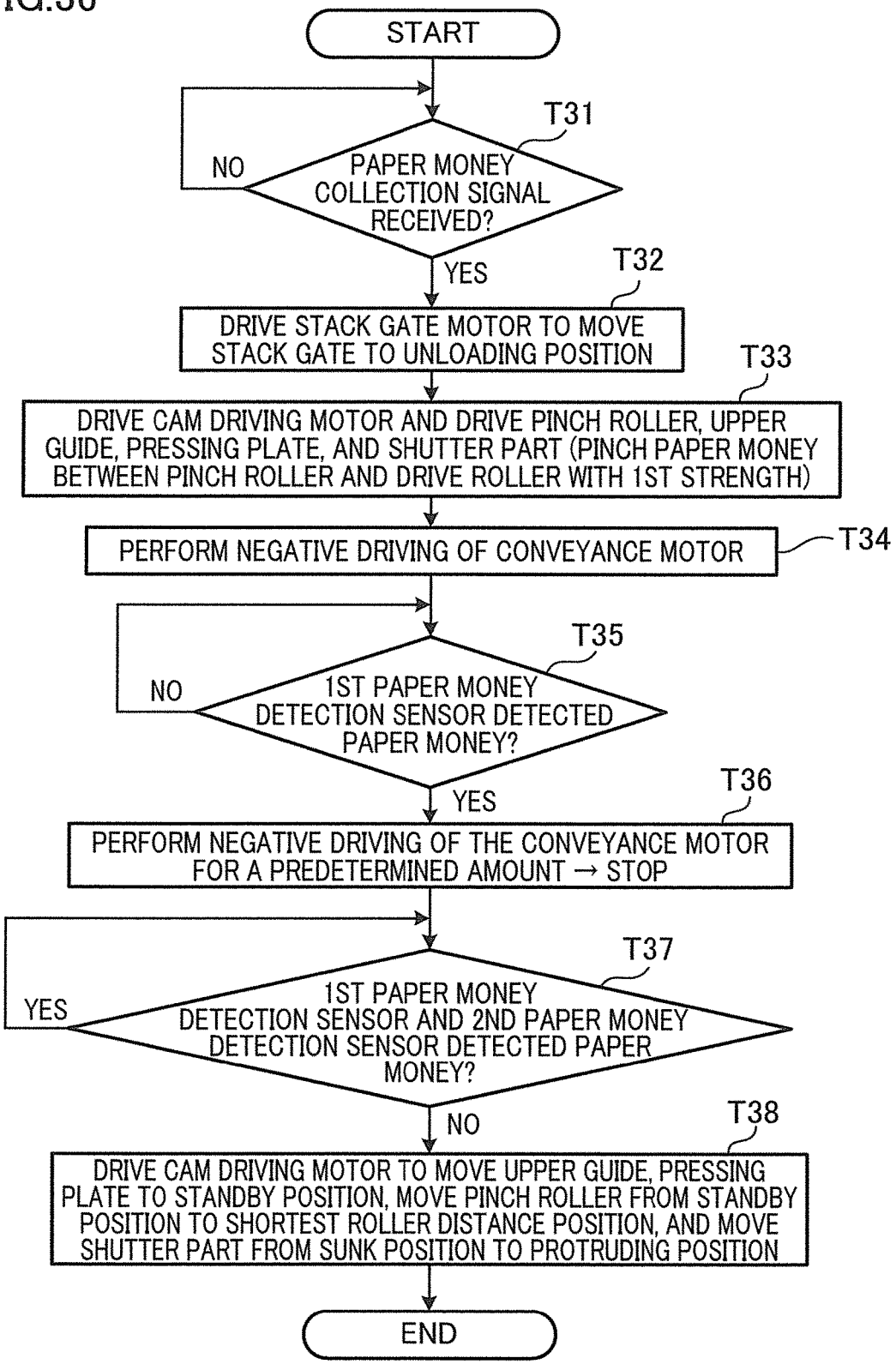
FIG. 36 is a flowchart showing a process of returning inserted paper money.
Figure 37:
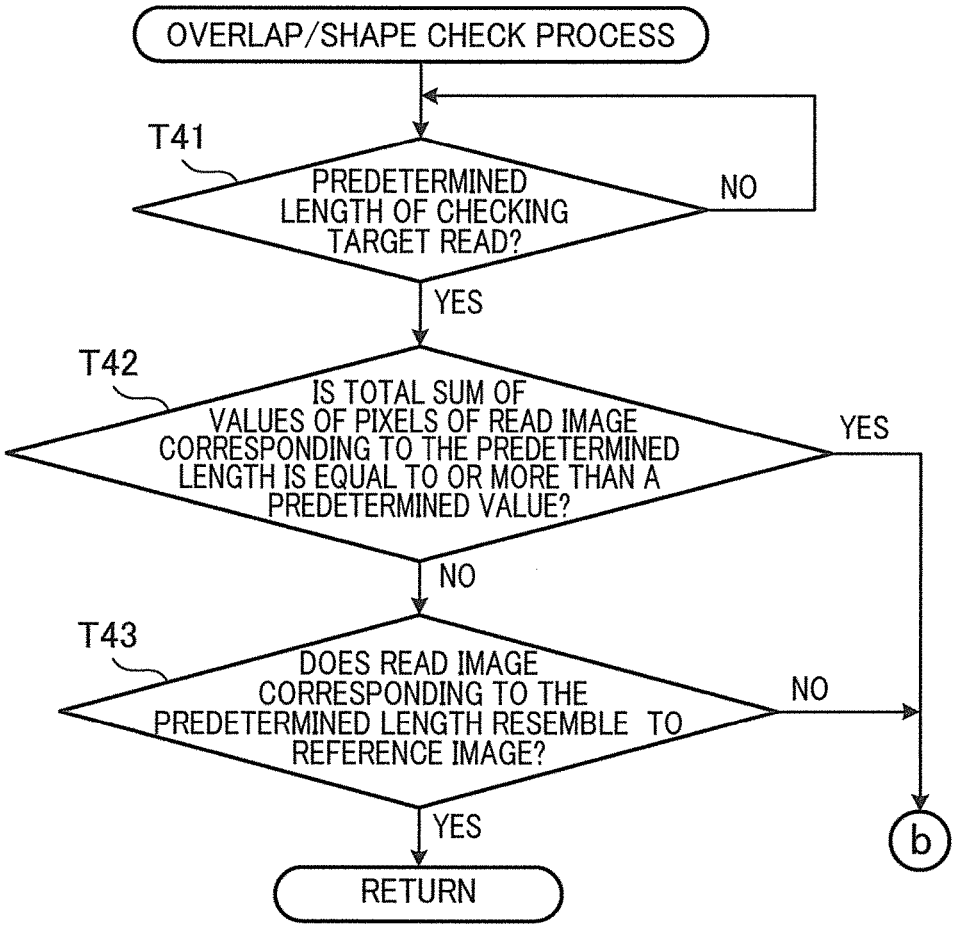
FIG. 37 is a flowchart showing an overlap/shape check process.

In the overlap/shape check process, as shown in the flowchart of FIG. 36, when the reader unit 21 has read the paper money which is a checking target for a predetermined length (T41: YES), the total sum of the pixels of the read image is calculated as a pixel total value, and whether this pixel total value is not lower than a predetermined value (threshold value based on reference data) stored in a ROM 102 is determined (T42). In this regard, as shown in FIG. 37, assume that each pixel has a number in a numerical range of, for example, 0 (black) to 255 (white). Because the paper money (paper stock) typically has a margin region outside a printed region, the value of each pixel in the margin region is large. On this account, when the total sum of the values of the pixels (pixel total value) is not smaller than the predetermined value, it is determined that overlap has occurred. As the transmitted light, infrared light or visible light is employed.

Figure 34:
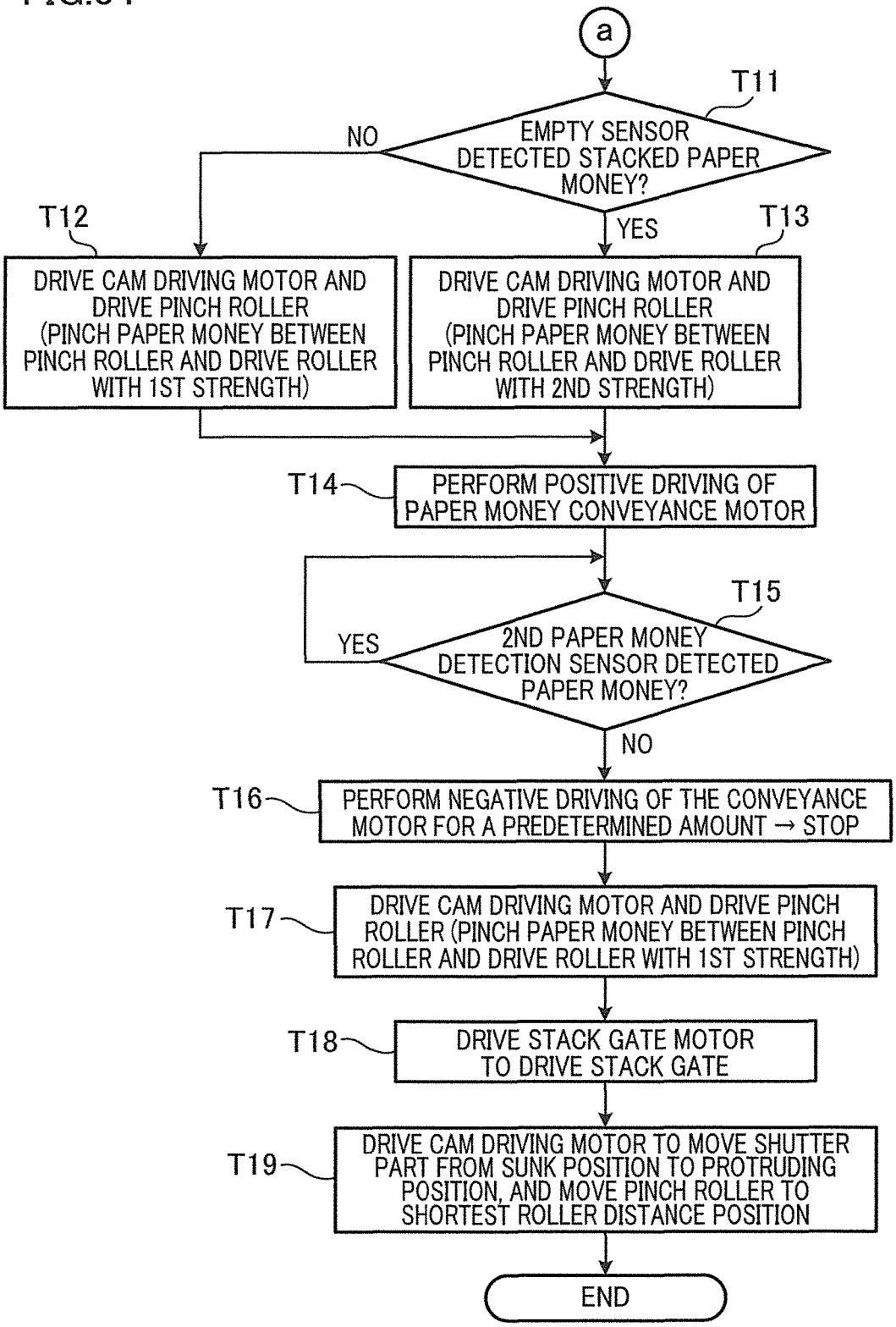
FIG. 34 is a flowchart showing a process of causing valid paper money to be layered and stored in the storage unit.
Figure 35:
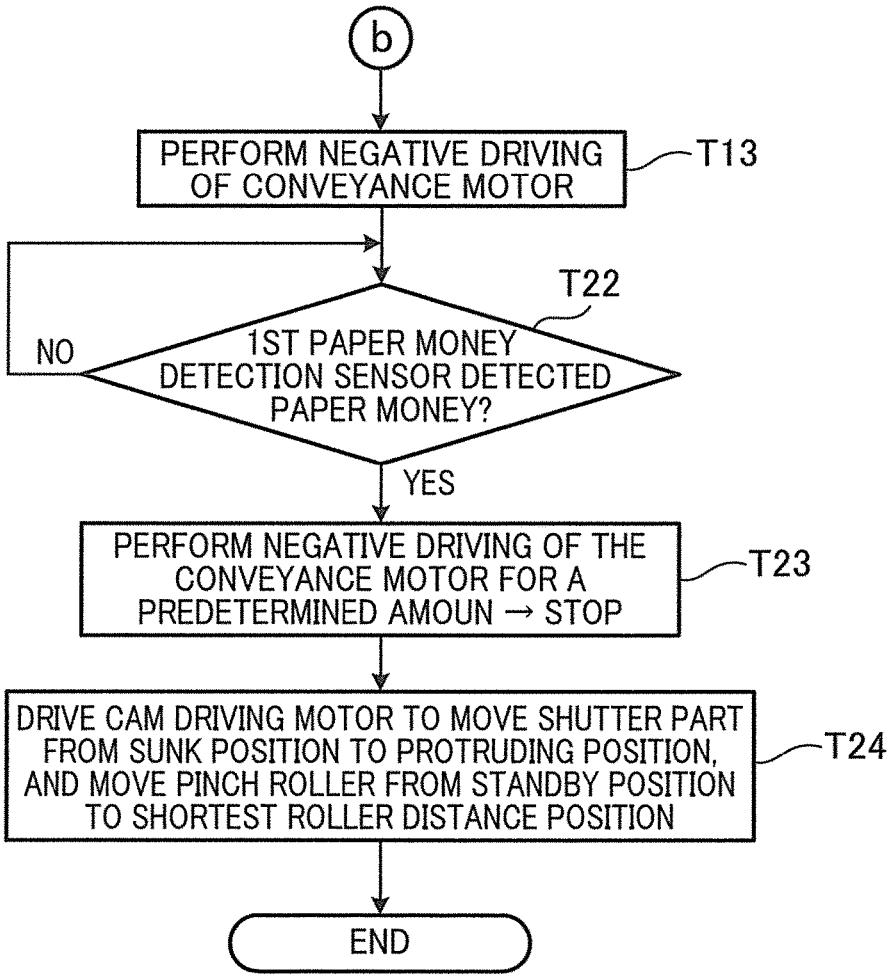
FIG. 35 is a flowchart showing a process of returning inserted paper money.

As shown in FIG. 36, when the pixel total value is not smaller than the predetermined value (T42: YES), it is determined that the inserted paper money overlaps (i.e., plural piece of paper money are overlapped or a leading end part of the paper money is folded). Then, as shown in FIG. 34, the conveyance motor 53 is reversely driven (T21) and the paper money is conveyed to return to the insertion slot 2. When the first paper money detection sensor 24 detects the leading end of the paper money, the conveyance motor 53 is driven backward for a predetermined amount (T22: YES, T23), and a part of the paper money is ejected from the insertion slot 2. To be more specific, the paper money is ejected and the ejection is stopped when the motor is driven for 38 mm after the detection of the paper money.

Thereafter, as the cam driving motor 94 is driven, the shutter part A1121 is moved from the sunk position to the protruding position and the pinch roller A33*b* is moved from the standby position to the shortest roller distance position (T24). In other words, as the cam pulley A90 at the reference position (0-degree position) is moved to the 270-degree position, the shutter part A1121 protrudes from the conveyance path 4 and the pinch roller A33*b* is moved to the shortest roller distance position (UP to DOWN). With this, when the paper money is not inserted and deal is waited for, it is possible to prevent the paper stock stored in the storage unit 5 from being taken off.

Figure 38:
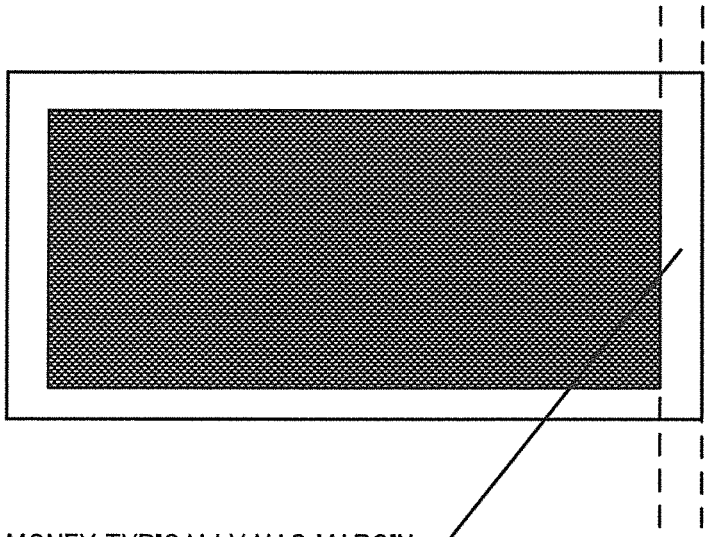
FIG. 38 is an explanatory diagram showing the overlap check.

As shown in FIG. 36, when the pixel total value is smaller than the predetermined value (T42: NO), it is determined that the inserted paper money does not overlap. Subsequently, the shape of the image as a result of the reading of the paper money for the predetermined length is compared with a reference image stored in the ROM 102 and whether these images are similar to each other is determined (T43). To be more specific, as shown in FIG. 38, the shape of the thick line in the figure is compared with the reference image. As the transmitted light, infrared light or visible light is employed.

As shown in FIG. 36, when the images are not similar to each other (T43: NO), it is determined that the paper money is, for example, broken, and the conveyance motor 53 is driven backward so that the paper money is immediately ejected from the insertion slot 2 (T21 to T24).

When the shape of the read image is similar to the reference image (T43: YES), as shown in FIG. 32, the reading process of reading the paper money is continued. When the reader unit 21 finishes the reading of the trailing end of the paper money (T7: YES), a verification process starts (T8). The verification process will be detailed later. After the reader unit 21 finishes the reading of the trailing end of the paper money, the conveyance motor 53 is driven for the predetermined amount so that the trailing end of the paper money is stopped at a position (escrow position) between the reader unit 21 and a second paper money detection sensor 25 (T9).

Thereafter, when it is determined in the verification process the paper money is not valid (T10: NO), the conveyance motor 53 is driven backward so that the paper money is immediately ejected from the insertion slot 2 (T21 to T24).

Figure 33:
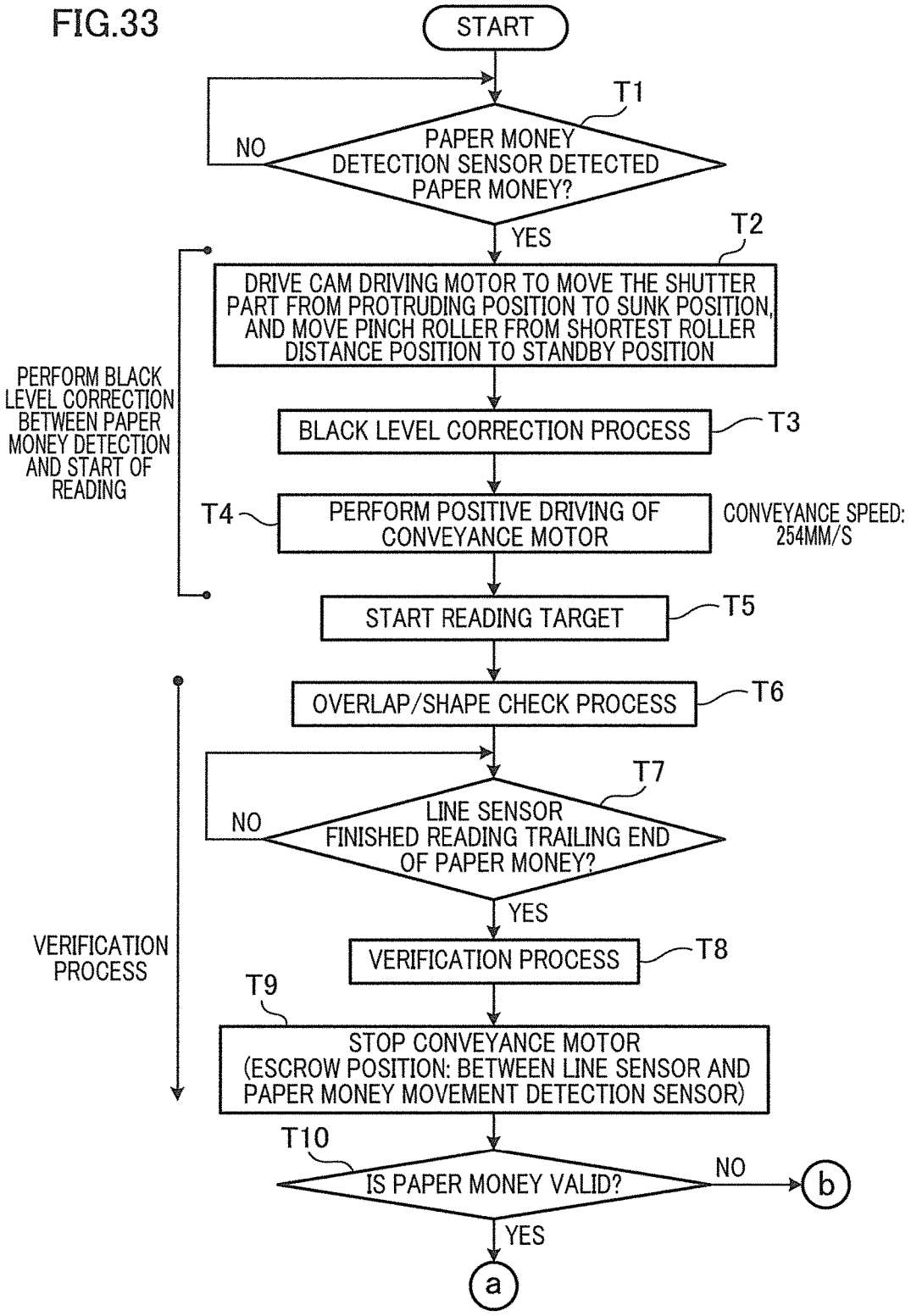
FIG. 33 is a flowchart showing a process up to the verification of inserted paper money.

In the meanwhile, when it is determined in the verification process that the paper money is valid (T10: YES), as shown in FIG. 33, whether the empty sensor 34 detects the paper money is determined (T11). When the paper money is not detected (T11: NO), the cam driving motor 94 is driven so that the engagement protrusion 72*a* of the slide member 72 is engaged with the large diameter portion A91*a* of the cam pulley A90, with the result that the pinch roller A33*b* is moved to the drive roller 33*a* side. Then the paper money is pinched by the conveyance roller pair A33 with first strength (T12). The first strength indicates a relationship (a friction coefficient of the contact surface of the roller with which the paper stock such as paper money is in contact)>a friction coefficient between pieces of stored paper stock, in a condition that the pinch roller A33*b* is fully in contact with the drive roller 33*a*.

In the meanwhile, when the paper money is detected (T11: YES), the cam driving motor 94 is driven in accordance with number of pieces of the paper money stored in the RAM 103, the engagement protrusion 72*a* of the slide member 72 is engaged with a predetermined part of the intermediate portion A91*b* of the cam pulley A90, with the result that the pinch roller A33*b* is moved to the drive roller 33*a* side. In other words, the distance between the drive roller 33*a* and the pinch roller A33*b* is changed in accordance with the number of stored pieces. Then the paper money is pinched by the conveyance roller pair A33 with second strength (T13). The second strength indicates a relationship (a friction coefficient of the contact surface of the roller with which the paper stock is in contact)<a friction coefficient between pieces of stored paper stock, in a condition that the pinch roller A33*b* is fully in contact with the drive roller 33*a*.

After the execution of T12 or T13, the conveyance motor 53 is driven forward (T14). The conveyance motor 53 is driven forward for a predetermined amount (9.3 mm) after the second paper money detection sensor 25 becomes no longer detect the paper money, and the trailing end of the piece of inserted paper money carried in is stopped at a position opposing the stacking part A37 (T15: YES, T16).

Thereafter, the cam driving motor 94 is driven so that the engagement protrusion 72*a* of the slide member 72 is engaged with the large diameter portion A91*a* of the cam pulley A90, and the pinch roller A33*b* is driven to cause the conveyance roller pair A33 to pinch the paper money with the first strength (T17). This is done to press the paper money by the pinch roller A33*b* to prevent the paper money from moving when the paper money is pinched between the stack gate 31 and the pressing plate A32.

Subsequently, a stack gate motor 64 is driven to temporarily move the stack gate 31 to the stack position. After the trailing end part of the inserted paper money carried in is moved to a position between the stacking part A37 and the pressing plate A32, the stack gate 31 is returned to the import position (T18). With this, the trailing end part of the paper money passes the stacking part A37 and is positioned between the stacking part A37 and the pressing plate A32. Thereafter, as the cam driving motor 94 is driven, the shutter part A1121 is moved from the sunk position to the protruding position and the pinch roller A33*b* is moved from the standby position to the shortest roller distance position (T24). To put it differently, the cam pulley A90 at the 90-degree position is moved to the reference position (0-degree position), and after the resetting of the rotational angle position performed when the cam detection sensor 96 detects the protrusion 72*b*, the cam pulley A90 is further moved to the 270-degree position, with the result that the shutter part A1121 protrudes from the conveyance path 4 and the pinch roller A33*b* is moved from the standby position to the shortest roller distance position (DOWN to UP to DOWN). With this, when the paper money is not inserted and deal is waited for, it is possible to prevent the paper stock stored in the storage unit 5 from being taken off.

When a thickness detection sensor 97 detects that the thickness of paper money pinched by the conveyance roller pair A33 reaches a predetermined value, the paper money processing device A1 sends a filled-up signal to the management server 203 and the control circuit 200*a* of the gaming media lending device 200 to notify that collection is required. Further, after the thickness of the stack of paper money reaches the predetermined value, the above described processing operation at the time of entering the paper money is not performed even if paper money is inserted into the insertion slot 2. As such, as the timing of the collection is managed in accordance with the thickness of the paper money in the storage unit 5, stable and reliable paper money collection is possible without depending on the state of the paper money (such as wrinkle), as compared to cases where the management is done based on the number of pieces of the paper money stored in the RAM 103.

(Processing Operation when Collecting Paper Money)

Now, operations of the paper money processing device A1 when plural pieces of the paper money stored in the storage unit 5 are collected will be described with reference to the flowchart of FIG. 36.

When a paper money collection signal sent from the management server 203 is received (T31: YES), the stack gate motor 64 is driven so that the stack gate 31 is moved from the import position to the export position (T32). The cam driving motor 94 is driven so that the pinch roller A33*b*, the upper guide A20, and the pressing plate A32 are driven. Then the paper money between the pinch roller A33*b* and the drive roller 33*a* is pinched with the first strength (T33). To be more specific, the cam pulley A90 at the 270-degree position is moved to the reference position (0-degree position), and after the resetting of the rotational angle position by the detection of the protrusion 72*b* by the cam detection sensor 96, the cam pulley A90 is further moved to the 180-degree position, with the result that the upper guide A20 and the pressing plate A32 are moved and the conveyance path 4 is widened, and the shutter part A1121 is moved from the protruding position to the sunk position.

Thereafter, the conveyance motor 53 is driven backward (T34), and pieces of the paper money pinched by the conveyance roller pair A33 are conveyed toward the insertion slot 2. The conveyance motor 53 is driven backward for a predetermined amount (38 mm) after the first paper money detection sensor 24 detects the leading end of the paper money (T35: YES, T36), and a part of the paper money protrudes from the insertion slot 2. It should be noted that the rotation speed of the conveyance motor 53 at the time of ejecting the paper money is preferably slower than the rotation speed at the time of inserting the paper money, for the purpose of conveying a plurality of pieces of paper money without fail. To be more specific, the conveyance speed is 127 mm/s, which is half as much as the speed in the insertion direction.

When a paper money collector takes off the pieces of the paper money and the paper money is no longer detected by the first paper money detection sensor 24 and the second paper money detection sensor 25 (T37: NO), the cam driving motor 94 is driven so that the upper guide A20 and the pressing plate A32 are moved to the waiting position, the pinch roller A33*b* is moved from the standby position to the shortest roller distance position, and the shutter part A1121 is moved from the sunk position to the protruding position (T38).

(Verification Process)

Figure 39:
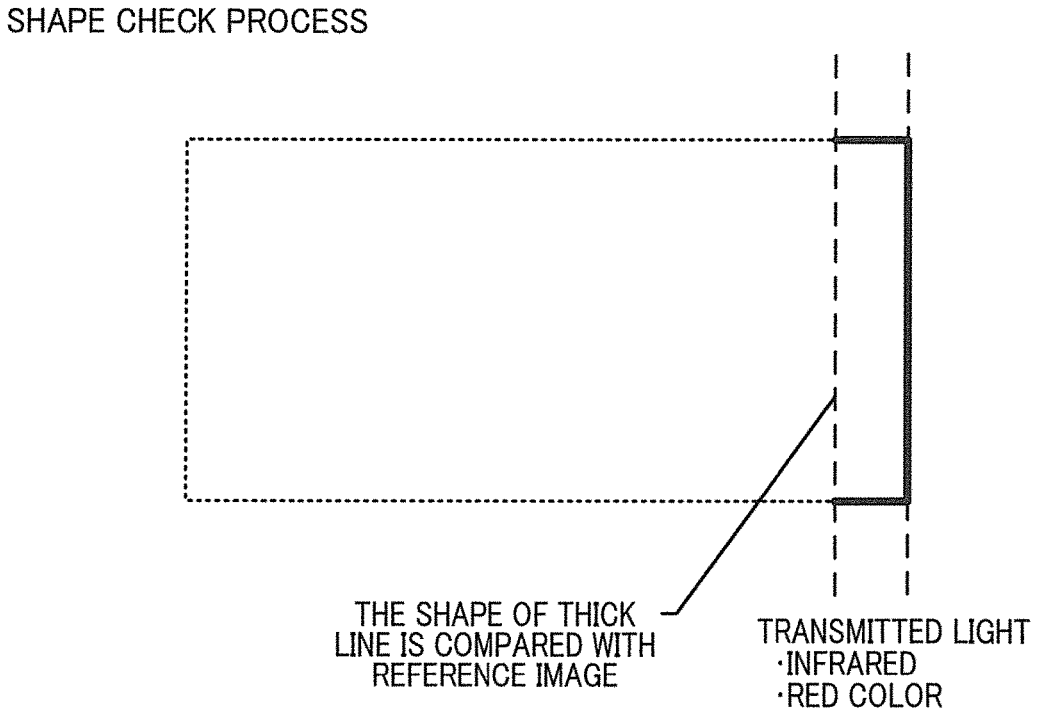
FIG. 39 is an explanatory diagram showing the shape check.

When the verification process is executed in T8 shown in FIG. 32, as shown in FIG. 39, a watermark verification process (folding removal) is executed (T51), and then a watermark verification process (brightness inversion) is executed (T52).

Figure 40:
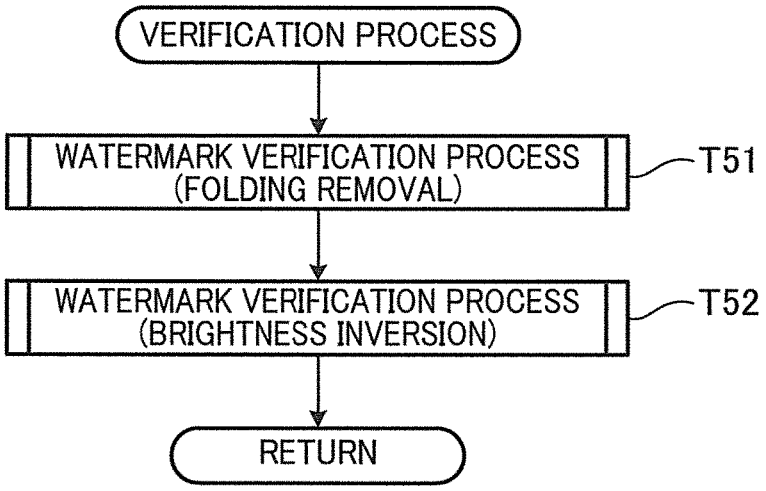
FIG. 40 is a flowchart showing a verification process.

To be more specific, in the watermark verification process, as shown in FIG. 40, a watermark (human character) is obtained from a standard image stored in the ROM 102 (T61). Then an average density value of the vertical line at the coordinates[x, y] is calculated (T62), an average density value of the horizontal line at the coordinates[x, y] is calculated (T63), an average density value of the front surface of the watermark is calculated (T64), a density value of each pixel of the watermark after the correction is calculated (T65), and a correlation coefficient R is obtained from g[x, y] of the watermark after the correction (T66). The folding is removed by the series of the processes (T61 to T66).

Then the verification is performed. In other words, whether the correlation coefficient R is not lower than a threshold is determined (T67). When the correlation coefficient R is not smaller than the threshold value (T67: YES), it is determined that the paper money is valid (T68). In the meanwhile, when the correlation coefficient R is smaller than the threshold value (T67: NO), it is determined that the paper money is invalid (T69).

Figure 41:
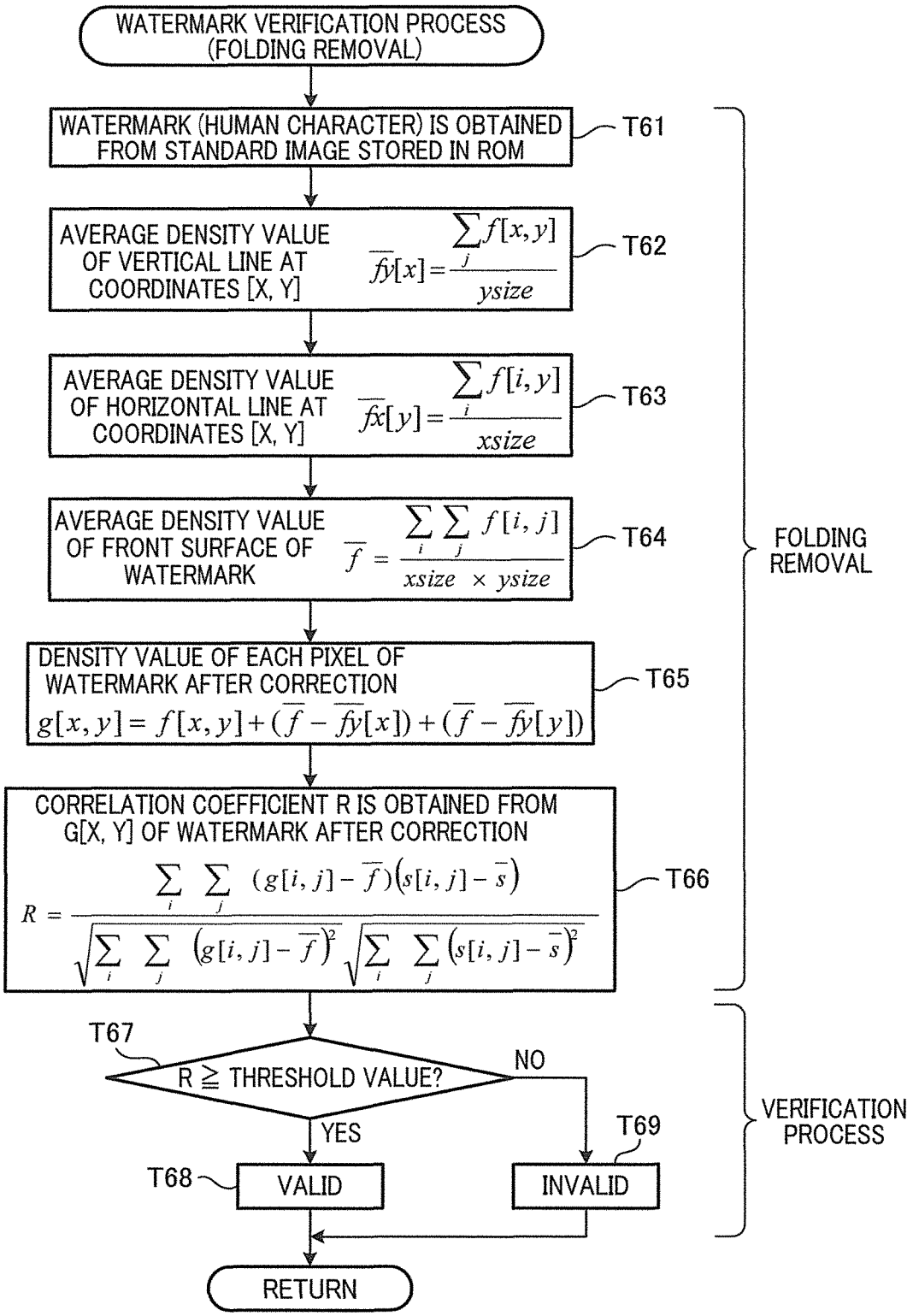
FIG. 41 is a flowchart of a watermark verification process.
Figure 42:
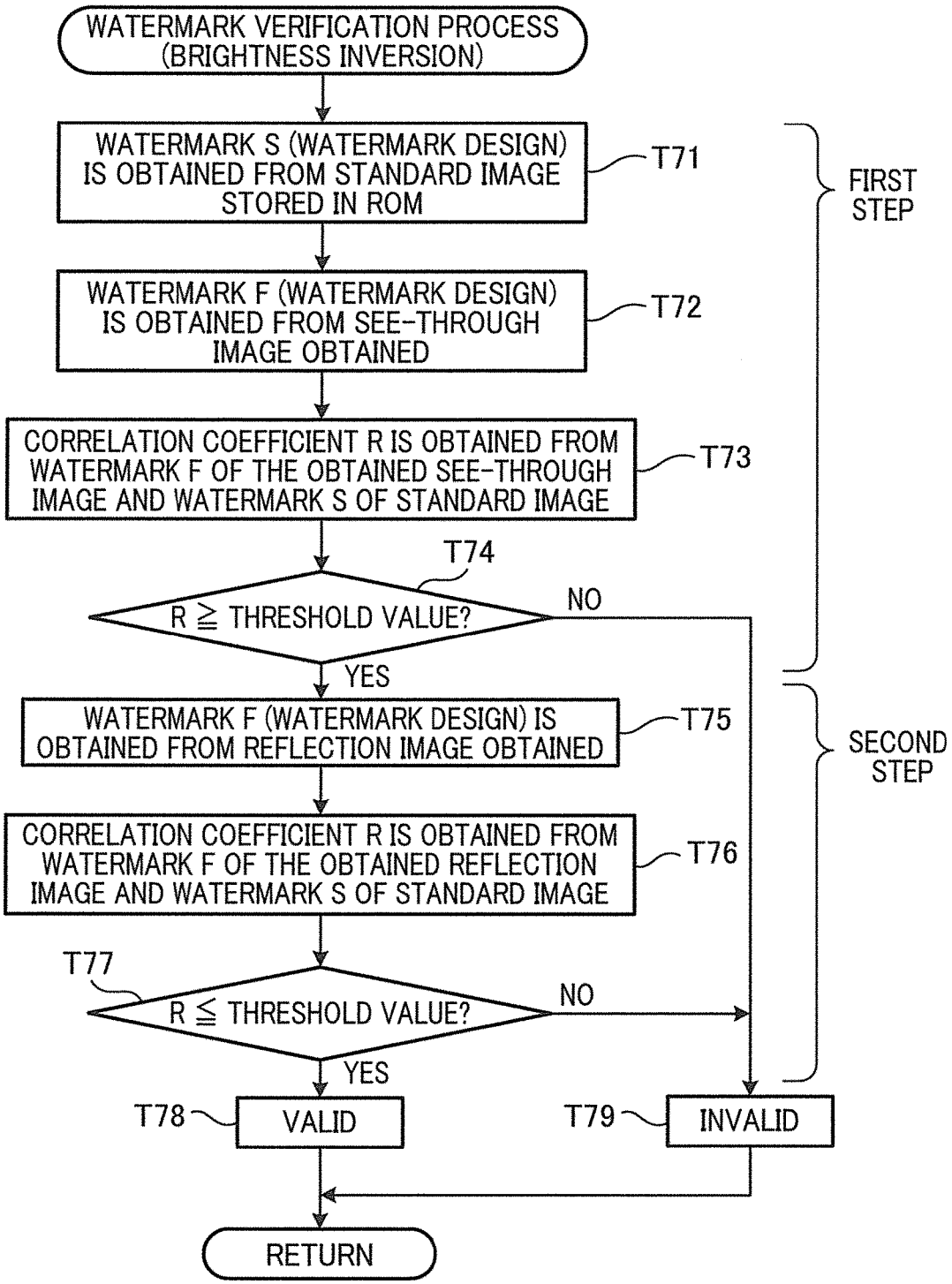
FIG. 42 is a flowchart of a watermark verification process (brightness inversion).

Furthermore, in the watermark verification process (brightness inversion), as shown in FIG. 41, a watermark s (watermark design) is obtained from the standard image stored in the ROM 102 (T71), a watermark f (watermark design) is obtained from the see-through image (T72), and a correlation coefficient R is obtained from the watermark f of the obtained see-through image and the watermark s of the standard image (S1). Then whether the correlation coefficient R is not smaller than a threshold value is determined (T74). The series of the processes (T71 to T74) are the processes of the first step. The watermark f of the obtained see-through image is subjected to position correction (i=−4 to −4, j=−4 to +4), and the value with the highest correlation coefficient is selected as a target of comparison.

In the processes of the first step, and the correlation coefficient R is lower than the threshold value (T74: NO), it is determined that the paper money is invalid (T79). In the meanwhile, when the correlation coefficient R is not smaller than the threshold value (T74: YES), then a watermark f (watermark design) is obtained from the obtained reflection image (T75), and a correlation coefficient R is obtained from the watermark f of the reflection image and the watermark s of the standard image (T76). Then whether the correlation coefficient R is not smaller than a threshold value is determined (T77). The series of the processes (T75 to T77) are the processes of the second step, and the watermark f of the obtained reflection image is subjected to position correction (i=−4 to −4, j=−4 to +4), and the value with the highest correlation coefficient is selected as a target of comparison.

When the correlation coefficient R is smaller than the threshold value in the processes of the second step (T77: NO), it is determined that the paper money is invalid (T79). In the meanwhile, when the correlation coefficient R is not smaller than the threshold value (T77: YES), it is determined that the paper money is valid (T78).

(Outline)

As described above, each of the paper money processing device 1 of Embodiment 1 and the paper money processing device A1 of Embodiment 2 has, as shown in FIG. 4, FIG. 5, and FIG. 23, a first aspect of including an insertion slot 2 in which paper stock such as paper money is inserted, a storage unit 5 configured to store paper stock inserted into the insertion slot 2, and a conveyance mechanism 6 which is able to convey the paper stock inserted into the insertion slot 2 to the storage unit 5, wherein the conveyance mechanism 6 is able to convey the paper stock stored in the storage unit 5 toward the insertion slot 2 until the paper money is ejected from the insertion slot 2.

In the first aspect, a second aspect is arranged such that the conveyance mechanism 6 is able to convey pieces of paper stock inserted into the insertion slot 2 one by one to the storage unit 5, and is able to convey plural pieces of the paper stock layered and stored in the storage unit 5 toward the insertion slot 2.

In the second aspect, a third aspect is arranged such that the insertion slot 2 is able to change the aperture width in the thickness direction of the paper stock, and when the paper stock stored in the storage unit 5 is conveyed toward the insertion slot 2 by the conveyance mechanism 6, the aperture width is widened.

In the second or third aspect, a fourth aspect is arranged such that a conveyance path 4 where the paper stock passes is provided between the insertion slot 2 and the storage unit 5, the conveyance path 4 is able to change the aperture width in the thickness direction of the paper stock, and when the paper stock stored in the storage unit 5 is conveyed toward the insertion slot 2 by the conveyance mechanism 6, the aperture width is widened.

In the first or second aspect, as shown in FIG. 24 and FIG. 25, the paper money processing device A1 of the Embodiment 2 includes a pair of conveyance members (the drive roller 33*a* and the pinch roller A33*b*) which are able to pinch the paper stock stored in the storage unit 5 in the thickness direction, the conveyance member (pinch roller A33*b*) on one side is provided with a first contact member A331*b* which is deformed when making contact with the paper stock and presses the paper stock by utilizing the elastic force which is power of returning to the original state from the deformed state, the conveyance mechanism 6 is arranged to be able to convey the paper stock sandwiched by the conveyance member, and when the paper stock inserted into the insertion slot 2 is conveyed toward the storage unit 5 by the conveyance mechanism 6, the relative distance between the pair of conveyance members is changed so that the first contact member A331*b* is in contact with the paper stock.

In the aspect above, in the storing of the paper stock in which the paper stock is conveyed toward the storage unit 5, the first contact member A331*b* is in contact with the layered paper stock on account of the force generated by elastic deformation of the first contact member A331B. With this, it is possible to apply a constant friction force to the conveyed paper stock and the conveyance member (the first contact member A331*b* of the pinch roller A33*b*) irrespective of the state of the layered paper stock. This makes it possible to stably perform the operations in the storing of the paper stock.

In the fifth aspect, a sixth aspect is arranged such that a conveyance member (pinch roller A33*b*) on one side includes a second contact member 332*b* which is smaller in diameter than the first contact member A331*b* and harder than the first contact member A331*b* and a spindle 36 on which the first contact member A331*b* and the second contact member 332*b* are provided, wherein, when the paper stock stored in the storage unit 5 is conveyed toward the insertion slot 2, the relative distance between the conveyance member pair is changed so that the second contact member 332*b* is in contact with the paper stock.

In the aspect above, in the paper stock collection in which the paper stock is conveyed toward the insertion slot 2, the paper stock is arranged to be in contact with the second contact member 332*b*. Because the second contact member 332*b* is harder than the first contact member A331*b*, the first contact member A331*b* is crushed and hence the second contact member 332*b* is in contact with the paper stock. With this, two types of the contact members (the first contact member A331*b* and the second contact member 332*b*) are switched only by changing the movement amount of the conveyance member, and hence unnecessary arrangements and controls are omitted and cost reduction is achieved.

In the first aspect, the conveyance mechanism 6 includes a contact member (pinch roller A33*b*) which is in contact with the surface of the paper stock stored in the storage unit 5, in the thickness direction of the paper stock. The surface of the contact part of this contact member has a convex and concave shape in which two types of elastic members (the first contact member A331*b* and the second contact member 332*b*) which are different in hardness are alternately provided. According to a seventh aspect, when the paper stock inserted into the insertion slot 2 one by one is conveyed to the storage unit 5, the surface of the convex elastic member (first contact member A331*b*) is in contact with the surface of the paper stock, and when plural pieces of the paper stock layered and stored in the storage unit 5 are conveyed toward the insertion slot 2, the contact force when in contact with the surface of the paper stock is varied so that the convex shape is elastically deformed and the surface of the concave elastic member (second contact member 332*b*) is in contact with the surface of the paper stock.

In the aspect above, the conveyance mechanism 6 is able to easily change the contact force when in contact with the paper stock between a case where pieces of the paper stock are conveyed one by one from the insertion slot 2 and a case where pieces of the paper stock stored in the storage unit 5 are conveyed toward the insertion slot 2, by utilizing the difference in the hardness between the contact members (first contact member A331*b* and second contact member 332*b*). As a result, the contact force is lowered to prevent the occurrence of jamming or the like when the paper stock is inserted through the insertion slot 2, whereas the contact force is increased when the paper stock layered in the storage unit 5 is conveyed toward the insertion slot 2, with the result that layered pieces of the paper stock is stably conveyed to the insertion slot 2.

Each of the paper money processing device 1 of Embodiment 1 and the paper money processing device A1 of Embodiment 2 has, as shown in FIG. 4, FIG. 5, and FIG. 23, an eighth aspect of including an insertion slot 2 in which paper stock is inserted, a storage unit 5 in which plural pieces of the paper stock inserted into the insertion slot 2 are layered in the thickness direction and stored, a conveyance member (conveyance roller pair 33, A33) which is able to pinch, in the thickness direction, the paper stock stored in the storage unit 5, and a conveyance mechanism 6 which is able to convey the paper stock pinched by the conveyance member toward the insertion slot 2 until the paper stock is ejected from the insertion slot 2.

In the eighth aspect, a ninth aspect is arranged such that the conveyance member includes: a drive source (cam driving motor 94) which is formed of paired members (the drive roller 33*a* and the pinch roller 33*b*, A33*b*) provided on the respective sides in the thickness direction of the paper stock stored in the storage unit 5, is connected with the conveyance member, and is movable between the paired members in the direction of pinching the paper stock; and a control unit (control circuit board 100) configured to control the drive source, wherein the control unit controls the drive source so that the friction force between the conveyance member and the paper stock is smaller than the friction force between the pieces of the paper stock.

In the eighth or ninth aspect, a tenth aspect is arranged such that a conveyance path 4 where the paper stock passes is provided between the insertion slot 2 and the storage unit 5, the conveyance path 4 is able to change the aperture width in the thickness direction of the paper stock, and the aperture width is widened when the paper stock stored in the storage unit 5 is conveyed toward the insertion slot 2.

In the eighth or ninth aspect, an eleventh aspect is arranged such that, in the paper money processing device 1, A1, the distance between the insertion slot 2 and the conveyance member is shorter than the length in the conveyance direction of the paper stock.

In the ninth aspect, the paper money processing device A1 of Embodiment 2 has a twelfth aspect in which a member (pinch roller A33*b*) on one side includes a first contact member A331*b* which deforms when being in contact with the paper stock and presses the paper stock by utilizing an elastic force generated when the deformed first contact member A331*b* returns to the original shape, a conveyance mechanism 6 is able to convey the paper stock inserted into the insertion slot 2 toward the storage unit 5, and a control unit changes the relative distance between paired members to cause the first contact member A331*b* to be in contact with the paper stock, when the paper stock inserted into the insertion slot 2 is conveyed toward the storage unit 5 by the conveyance mechanism 6.

In the aspect above, in the storing of the paper stock in which the paper stock is conveyed toward the storage unit 5, the first contact member A331*b* is in contact with the layered paper stock on account of the force generated by elastic deformation of the first contact member A331B. With this, it is possible to apply a constant friction force to the conveyed paper stock and the conveyance member irrespective of the state of the layered paper stock. This makes it possible to stably perform the operations in the storing of the paper stock.

In the twelfth aspect, a 13th aspect is arranged such that a conveyance member on one side includes a second contact member 332*b* which is smaller in diameter than the first contact member A331*b* and harder than the first contact member A331*b* and an axis (spindle 36) on which the first contact member A331*b* and the second contact member 332*b* are provided, wherein, when the paper stock stored in the storage unit 5 is conveyed toward the insertion slot 2, the relative distance between the conveyance member pair (conveyance roller pair A33) is changed so that the second contact member 332*b* is in contact with the paper stock.

In the aspect above, in the paper stock collection in which the paper stock is conveyed toward the insertion slot 2, the paper stock is arranged to be in contact with the second contact member 332*b*. Because the second contact member 332*b* is harder than the first contact member A331*b*, the first contact member A331*b* is crushed and hence the second contact member 332*b* is in contact with the paper stock. With this, two types of the contact members (the first contact member A331*b* and the second contact member 332*b*) are switched only by changing the movement amount of the conveyance member, and hence unnecessary arrangements and controls are omitted and cost reduction is achieved.

The paper money processing device A1 of the eighth aspect includes a 14th aspect in which the conveyance mechanism 6 includes a contact member (pinch roller A33*b*) which is in contact with the surface of the paper stock stored in the storage unit 5 in the thickness direction of the paper stock, wherein, the surface of a contact part of this contact member is convex and concave as two types of elastic members which are different in hardness are alternately provided, when the paper stock inserted into the insertion slot 2 one by one is conveyed to the storage unit 5, the convex parts of the surfaces of the elastic members are in contact with the surface of the paper stock, whereas, when plural pieces of the paper stock layered and stored in the storage unit 5 are conveyed toward the insertion slot 2, the contact force when in contact with the surface of the paper stock is changed so that the convex parts are elastically deformed and the concave parts of the surfaces of the elastic members are in contact with the surface of the paper stock.

In the aspect above, the conveyance mechanism 6 is able to easily change the contact force when in contact with the paper stock between a case where pieces of the paper stock are conveyed one by one from the insertion slot 2 and a case where pieces of the paper stock stored in the storage unit 5 are conveyed toward the insertion slot 2, by utilizing the difference in the hardness between the contact members. As a result, the contact force is lowered to prevent the occurrence of jamming or the like when the paper stock is inserted through the insertion slot 2, whereas the contact force is increased when the paper stock layered in the storage unit 5 is conveyed toward the insertion slot 2, with the result that layered pieces of the paper stock is stably conveyed to the insertion slot 2.

Each of the paper money processing device 1 of Embodiment 1 and the paper money processing device A1 of Embodiment 2 has, as shown in FIG. 4, FIG. 5, and FIG. 23, a 15th aspect of including a storage unit 5 forming a storage space in which paper stock is layered and stored, a conveyance mechanism 6 configured to convey the paper stock to the storage unit 5, and a movable piece (stacking part 37) which is provided in the direction orthogonal to the conveyance direction of the paper stock conveyed by the conveyance mechanism 6 and emerges in and is sunk from the storage space, wherein, after the trailing end part of the paper stock conveyed to the storage unit 5 by the conveyance mechanism 6 stops at a position opposing the movable piece, the movable piece performs an emerging/sinking operation so that the trailing end part of the paper stock opposing the movable piece is moved to the storage space side and the paper stock is layered and stored in the storage space.

In the 15th aspect, a 16th aspect is arranged such that, when provided on the storage space side of the storage unit 5, the movable piece forms an import space for conveying the paper stock conveyed by the conveyance mechanism 6 to the storage unit 5.

In the 16th aspect, a 17th aspect is arranged such that a hole 12*a* which is made through a wall part of the storage unit 5 and allows the movable piece to emerge and to be sunk, a guide piece (guide 38) which opposes the movable piece and moves together with the movable piece, a drive source (stack gate motor 64) configured to cause the movable piece to perform the emerging/sinking operation, and a control unit (control circuit board 100) configured to control the drive source are further provided, the control unit controls the drive source so that the hole 12*a* is closed by the guide piece at a position where the movable piece is moved to the storage space side, after the conveyance mechanism 6 stops the conveyance at a position where the rear end part of the paper stock opposes the movable piece, the emerging/sinking operation is performed so that the movable piece is moved from the storage space side to the import space side so that the movable piece is sunk in the hole 12*a*, and then the movable piece sunk in the hole 12*a* is moved back to the storage space side.

In any one of the 15th to 17th aspects, an 18th aspect is arranged such that a pair of contact members (the conveyance roller pair 33, A33) which pinches the paper stock layered and stored in the storage space is provided.

In the paper money processing device A1 of the 15th aspect, a 19th aspect includes an insertion slot 2 in which the paper stock is inserted, the storage unit 5 includes a pressing plate A32 which is provided to oppose the movable piece and pinches the layered and stored paper stock with the movable piece, and the pressing plate A32 has, at a surface in contact with the layered and stored paper stock, a first regulating member A32*a* the friction force of which is larger when moving toward the storage unit 5 than when moving toward the insertion slot 2 of the paper stock.

According to this aspect, it is possible to prevent the state of the layered and stored paper stock in the storage unit 5 from being disturbed when the paper stock inserted into the insertion slot 2 is conveyed to the storage unit 5.

In the paper money processing device A1 of the 15th aspect, a 20th aspect is arranged such that the movable piece includes a second regulating member in which the friction force between pieces of the layered and stored paper stock is smaller than the friction force between a contact surface of the movable piece in contact with the layered and stored paper stock and the layered and stored paper stock.

This prevents the stored paper stock from becoming unstable as pieces of the paper stock layered and stored in the storage unit 5 are deviated from one another on account of a shock due to the movement of the movable piece with respect to the import space.

Each of the paper money processing device 1 of Embodiment 1 and the paper money processing device A1 of Embodiment 2 has, as shown in FIG. 4, FIG. 5, and FIG. 23, a 21st aspect of including an insertion slot 2 in which paper stock is inserted, a storage unit 5 capable of storing plural pieces of paper stock inserted in the insertion slot 2 to be layered in the thickness direction, conveyance members (the conveyance roller pair 33, A33) capable of pinching the paper stock stored in the storage unit 5 from one and the other sides in the thickness direction, a conveyance mechanism 6 capable of conveying the paper stock pinched by the conveyance member from the storage unit 5 to the insertion slot 2, and a change unit (change mechanism 7) which is configured to change the relative distance between the conveyance members on the one side and the other side so as to change the friction force between the conveyance members and the paper stock and the friction force between pieces of the paper stock.

In the 21st aspect, a 22nd aspect is arranged such that a drive source (cam driving motor 94) which is connected with the change unit and moves in the direction of pinching the paper stock between the conveyance members on the one side and the other side, a control unit (control circuit board 100) configured to control the drive source, and a memory unit configured to store the number of pieces of the paper stock stored in the storage unit 5 are provided, the conveyance mechanism 6 is able to convey the paper stock inserted in the insertion slot 2 toward the storage unit 5, and the control unit changes the relative distance in accordance with the number of pieces of the paper stock stored in the memory unit.

In the 21st or 22nd aspect, a 23rd aspect is arranged such that a conveyance path 4 where the paper stock passes is provided between the insertion slot 2 and the storage unit 5, the conveyance path 4 is able to change the aperture width in the thickness direction of the paper stock, and the aperture width is widened when the paper stock stored in the storage unit 5 is conveyed toward the insertion slot 2.

The paper money processing device A1 of the 22nd aspect has a 24th aspect in which a member (pinch roller A33*b*) on one side includes a first contact member A331*b* which deforms when being in contact with the paper stock and presses the paper stock by utilizing an elastic force generated when the deformed first contact member A331*b* returns to the original shape, a conveyance mechanism 6 is able to convey the paper stock inserted into the insertion slot 2 toward the storage unit 5, and a control unit changes the relative distance between paired members to cause the first contact member A331*b* to be in contact with the paper stock, when the paper stock inserted into the insertion slot 2 is conveyed toward the storage unit 5 by the conveyance mechanism 6.

In the aspect above, in the storing of the paper stock in which the paper stock is conveyed toward the storage unit 5, the first contact member A331*b* is in contact with the layered paper stock on account of the force generated by elastic deformation of the first contact member A331B. With this, it is possible to apply a constant friction force to the conveyed paper stock and the conveyance member irrespective of the state of the layered paper stock. This makes it possible to stably perform the operations in the storing of the paper stock.

In the 24th aspect, a 25th aspect is arranged such that a conveyance member on one side includes a second contact member 332*b* which is smaller in diameter than the first contact member A331*b* and harder than the first contact member A331*b* and an axis (spindle 36) on which the first contact member A331*b* and the second contact member 332*b* are provided, wherein, when the paper stock stored in the storage unit 5 is conveyed toward the insertion slot 2, the relative distance between the conveyance member pair (conveyance roller pair A33) is changed so that the second contact member 332*b* is in contact with the paper stock.

In the aspect above, in the paper stock collection in which the paper stock is conveyed toward the insertion slot 2, the paper stock is arranged to be in contact with the second contact member 332*b*. Because the second contact member 332*b* is harder than the first contact member A331*b*, the first contact member A331*b* is crushed and hence the second contact member 332*b* is in contact with the paper stock. With this, two types of the contact members are switched only by changing the movement amount of the conveyance member, and hence unnecessary arrangements and controls are omitted and cost reduction is achieved.

The paper money processing device A1 of the 21st aspect includes a 26th aspect in which the conveyance mechanism 6 includes a contact member (pinch roller A33*b*) which is in contact with the surface of the paper stock stored in the storage unit 5 in the thickness direction of the paper stock, wherein, the surface of a contact part of this contact member is convex and concave as two types of elastic members which are different in hardness are alternately provided, when the paper stock inserted into the insertion slot 2 one by one is conveyed to the storage unit 5, the convex parts of the surfaces of the elastic members are in contact with the surface of the paper stock, whereas, when plural pieces of the paper stock layered and stored in the storage unit 5 are conveyed toward the insertion slot 2, the contact force when in contact with the surface of the paper stock is changed so that the convex parts are elastically deformed and the concave parts of the surfaces of the elastic members are in contact with the surface of the paper stock.

In the aspect above, the conveyance mechanism 6 is able to easily change the contact force when in contact with the paper stock between a case where pieces of the paper stock are conveyed one by one from the insertion slot 2 and a case where pieces of the paper stock stored in the storage unit 5 are conveyed toward the insertion slot 2, by utilizing the difference in the hardness between the contact members. As a result, the contact force is lowered to prevent the occurrence of jamming or the like when the paper stock is inserted through the insertion slot 2, whereas the contact force is increased when the paper stock layered in the storage unit 5 is conveyed toward the insertion slot 2, with the result that layered pieces of the paper stock is stably conveyed to the insertion slot 2.

Each of the paper money processing device 1 of Embodiment 1 and the paper money processing device A1 of Embodiment 2 includes, as shown in FIG. 4, FIG. 5, and FIG. 23, a 27th aspect of including an insertion slot 2 in which paper stock is inserted, a storage unit 5 in which plural pieces of the paper stock inserted into the insertion slot 2 are layered in the thickness direction and stored, a conveyance mechanism 6 capable of conveying the paper stock stored in the storage unit 5 toward the insertion slot 2, and an expansion mechanism 8, A8 which changes the aperture width of the insertion slot 2 in a direction in which the hole 2 is widened in the thickness direction, when the paper stock stored in the storage unit 5 is conveyed toward the insertion slot 2 by the conveyance mechanism 6.

In the 27th aspect, a 28th aspect is arranged such that conveyance member pair (conveyance roller pair 33, A33) capable of pinching the paper stock stored in the storage unit 5 in the thickness direction, a change unit (change mechanism 7) which moves one (pinch roller 33*b*,A33*b*) of the conveyance member pair toward the other conveyance member (drive roller 33*a*), a cam (cam pulley A90) configured to operate the expansion mechanism 8, A8 and the change unit, a drive source (cam driving motor 94) configured to drive the cam, and a control unit (control circuit board 100) configured to control the drive source are provided, the conveyance member pair is driven to convey the paper stock by the conveyance mechanism 6, the control unit controls the drive source so as to control the change unit to pinch the paper stock stored in the storage unit 5 when the paper stock stored in the storage unit 5 is conveyed toward the insertion slot 2 by the conveyance member pair, and controls the expansion mechanism 8, A8 so that the aperture width of the insertion slot 2 is changed in a direction in which the insertion slot 2 is widened in the thickness direction.

In the 28th aspect, a 29th aspect is arranged such that the cam is shaped to stop the operation of one of the expansion mechanism 8, A8 and the change unit when the other one of them is in operation.

In any one of the 27th to 29th aspects, a 28th aspect is arranged such that insertion conveyance member pair, which are provided between the insertion slot 2 and the storage unit 5, pinches the paper stock inserted in the insertion slot 2 in the thickness direction, and are capable of driving the conveyance mechanism 6 to convey the paper stock toward the storage unit 5, wherein, the expansion mechanism 8, A8 widens the aperture width of the insertion slot 2 so as to change the relative distance between the insertion conveyance member pair.

In any one of the 27th to 30th aspects, a 31st aspect includes a reader unit 21 including a light emitter (light emitter 21*b*) which is provided on one side in the thickness direction of the paper stock passing the space between the insertion slot 2 and the storage unit 5 and is configured to apply light to the paper stock and a light receiver (light emission/reception unit 21*a*) which is provided on the other side in the thickness direction of the paper stock passing the space between the insertion slot 2 and the storage unit 5 and is configured to receive the light from the light emitter, wherein, the expansion mechanism 8, A8 is capable of widening the relative distance between the light emitter and the light receiver by widening the aperture width of the insertion slot 2.

In the 31st aspect, a 32nd aspect is arranged such that the reader unit 21 is an image sensor.

In any one of the 28th to 32nd aspects, a 33rd aspect is arranged such that, when plural pieces of the paper stock layered and stored in the storage unit 5 are conveyed toward the insertion slot 2 by the conveyance member pair, the control unit drives the drive source (cam driving motor 94) and controls the change unit (change mechanism 7) so as to set the relative distance between the conveyance member pair so that the friction force between the conveyance members and the paper stock is smaller than the friction force between the pieces of the paper stock.

In any one of the 28th to 33rd aspects, a 34th aspect is arranged such that the control unit is connected with a memory unit configured to store the number of pieces of the paper stock stored in the storage unit 5, and in accordance with the number of pieces of the paper stock stored in the memory unit, the control unit controls the change unit so as to set the relative distance between the conveyance member pair.

The paper money processing device A1 of the 28th aspect includes a 35th aspect of including a conveyance path 4 which is provided between the insertion slot 2 and the storage unit 5 and where the paper stock passes and a shutter part A1121 which is able to emerge in and to be sunk from the conveyance path 4 and prevents the conveyance of the paper stock toward the insertion slot 2 by protruding into the conveyance path 4, wherein, the shutter part A1121 is arranged to be movable by a cam (cam pulley A90).

According to the aspect above, it is unnecessary to additionally provide a drive source for driving the shutter part A1121, and hence cost reduction is achieved.

In the 35th aspect, a 36th aspect is arranged such that, after the paper stock inserted in the insertion slot 2 is stored in the storage unit 5 and before the next paper stock is inserted in the insertion slot 2, the control unit controls the change unit to cause the paper stock stored in the storage unit 5 to be pinched and causes the shutter part A1121 to protrude in the conveyance path 4.

This aspect makes it difficult to take off the paper stock as the paper stock in the storage unit 5 is pinched by the conveyance member pair, in addition to the take-off prevention by the shutter part A1121.

The paper money processing device A1 of the 28th aspect includes a 37th aspect including a pressing plate A32 opposing the paper stock stored in the storage unit 5, a biasing unit (torsion coil spring 41) which biases the pressing plate A32 in the thickness direction toward the paper stock stored in the storage unit 5 to maintain the state of the layered pieces of the paper stock stored in the storage unit 5, and a second change unit (second arm A85) configured to widen the relative distance from the paper stock stored in the pressing plate A32 in the thickness direction, wherein, the second change unit is arranged to be operated by a cam (cam pulley A90), and the control unit widens the aperture width of the insertion slot 2 by the expansion mechanism A8 and controls the second change unit so as to widen the relative distance between the pressing plate and the paper stock stored in the storage unit 5.

According to the aspect above, while the pressing plate is arranged to press the paper stock on account of the biasing force of the biasing unit, the second change unit configured to widen the aperture width of the insertion slot 2 is arranged to be operated by the cam. As such, because the pressing plate and the second change unit independent operate, a malfunction at the time of expanding the conveyance space is prevented.

REFERENCE SIGNS LIST

1 Paper Money Processing Device (Paper Stock Processing Device)
A1 Paper Money Processing Device (Paper Stock Processing Device)
2 Insertion Slot
4 Conveyance Path
5 Storage Unit
6 Conveyance Mechanism
7 Change Mechanism (Change Unit)
8 Expansion Mechanism
12*a* Hole
21 Reader Unit
21*a* Light Emission/Reception Unit (Light Receiver)
21*b* Light Emitter
22, 23 Inserted-Money Conveyance Roller Pair (Insertion Conveyance Member Pair)
31 Stack Gate
33 Conveyance Roller Pair (Conveyance Member Pair)
37 Stacking Part (Movable Piece)
38 Guide (Guide Piece)
31*a* Import Space
64 Stack Gate Motor (Drive Source)
90 Cam Plate (Cam)
94 Cam Driving Motor (Drive Source)
100 Control Circuit Board
101 CPU (Control Unit)
102 ROM
103 RAM (Storage)

The invention claimed is:

1. A paper stock processing device, comprising:

a storage unit having a storage space in which paper stock is layered and stored;

a conveyance mechanism for conveying paper stock to the storage unit; and a movable piece extending in a direction perpendicular to a conveyance direction in which paper stock is conveyed by the conveyance mechanism, the movable piece being configured to emerge and sink with respect to the storage space, wherein the paper stock processing device is configured such that, after conveyance of paper stock to the storage unit by the conveyance mechanism stops in a position where a trailing end part of paper stock faces the movable piece, the movable piece is caused to emerge and sink in a hole which is formed in a wall part of the storage unit to allow the movable piece to emerge and sink so that the rear end part of the paper stock, which is in the position to face the movable piece, is moved toward the storage space, thereby layering and storing the paper stock in the storage space.

2. The paper stock processing device according to claim 1, wherein the movable piece, while being on a side of the storage space of the storage unit, forms an import space through which paper stock conveyed by the conveyance mechanism is sent to the storage space.

3. The paper stock processing device according to claim 2, further comprising a pair of contact members configured to pinch paper stock layered and stored in the storage space.

4. The paper stock processing device according to claim 1, further comprising a pair of contact members configured to pinch paper stock layered and stored in the storage space.

5. The paper stock processing device according to claim 1, wherein the movable piece has a second regulating member with which the friction force between a surface of the movable piece in contact with the layered and stored paper stock and the layered and stored paper stock is larger than the friction force between pieces of the layered and stored paper stock.

6. A paper stock processing device, comprising:

a storage unit having a storage space in which paper stock is layered and stored;

a conveyance mechanism for conveying paper stock to the storage unit;

a movable piece extending in a direction perpendicular to a conveyance direction in which paper stock is conveyed by the conveyance mechanism, the movable piece being configured to emerge and sink with respect to the storage space;

a hole formed on a wall part of the storage unit, in which hole the movable piece emerges and sinks;

a guide piece facing the movable piece, which moves integrally with the movable piece;

a drive source for causing emerging and sinking operation of the movable piece; and a control unit configured to control the drive source, wherein the paper stock processing device is configured such that after conveyance of paper stock to the storage unit by the conveyance mechanism stops in a position where a trailing end part of paper stock faces the movable piece, the movable piece is caused to emerge and sink in the hole so that the rear end part of the paper stock, which is in the position to face the movable piece, is moved toward the storage space, thereby layering and storing the paper stock in the storage space, wherein the movable piece, while being positioned on a side of the storage space of the storage unit, forms an import space through which paper stock being conveyed by the conveyance mechanism passes on its way to the storage space; and wherein the control unit is configured to control the drive source so that the movable piece is moved toward the storage space to close the hole with the guide piece, and after conveyance of paper stock to the storage unit by the conveyance mechanism stops in the position where the trailing end part of the paper stock faces the movable piece, an emerging/sinking operation is executed in which operation the movable piece is moved in a direction from the storage space toward an import space so that the movable piece enters a sunk state with respect to the hole and then the movable piece in the sunk state is moved back toward the storage space.

7. The paper stock processing device according to claim 6, further comprising a pair of contact members configured to pinch paper stock layered and stored in the storage space.

8. A paper stock processing device, comprising:

a storage unit having a storage space in which paper stock is layered and stored;

a conveyance mechanism for conveying paper stock to the storage unit;

a movable piece extending in a direction perpendicular to a conveyance direction in which paper stock is conveyed by the conveyance mechanism, the movable piece being configured to emerge and sink with respect to the storage space; and an insertion slot through which the paper stock is inserted into the paper stock processing device, wherein the paper stock processing device is configured such that after conveyance of paper stock to the storage unit by the conveyance mechanism stops in a position where a trailing end part of paper stock faces the movable piece, the movable piece is caused to emerge and sink so that the rear end part of the paper stock, which is in the position to face the movable piece, is moved toward the storage space, thereby layering and storing the paper stock in the storage space, wherein the storage unit is disposed in a position to face the movable piece and includes a pressing plate configured to pinch the layered and stored paper stock between the movable piece and the pressing plate, and the pressing plate has, at a surface in contact with the layered and stored paper stock, a first regulating member whose friction force is larger when the paper stock moves toward the storage unit than when the paper stock moves toward the insertion slot.

9. A paper stock processing device, comprising:

a storage unit having a storage space that is sized and configured to receive and store therein, in a layered manner, paper stock having a predetermined length;

a conveyance mechanism that is configured to transport paper stock along a conveyance surface in a conveyance direction and to the storage unit;

a first slot formed in the conveyance surface and extending transverse to the conveyance direction;

a stacking member extending generally parallel to the first slot, which stacking member is supported and positioned so as to reciprocate translationally into and out of the first slot; and a pressing member extending generally parallel to the stacking member and being disposed on an opposite side of the stacking member than the first slot;

wherein the paper stock processing device is configured such that paper stock comes to rest in the storage unit, at the end of a conveying-in process, with a trailing end of the paper stock located in the vicinity of the first slot; and wherein the stacking member is configured such that as it reciprocates into the first slot, it presses against a first surface of the paper stock near the trailing end thereof and causes the trailing end of the paper stock to be deflected in the direction of travel of the stacking member, and the stacking member moves to an opposite side of the paper stock as it travels farther into the first slot and the trailing end of the paper stock returns to a non-deflected position; and wherein the stacking member is configured such that as it reciprocates out of the first slot, it presses against a second surface of the paper stock, on said opposite side of the paper stock and near the trailing end thereof, so as to press the trailing end of the paper stock toward the pressing member.

10. The paper stock processing device of claim 9, wherein the stacking member includes a second slot extending along it through which paper stock can pass into the storage space when the stacking member is positioned within the first slot formed in the conveyance surface.

* * * * *